US012564262B2

(12) United States Patent
Brown et al.

(10) Patent No.: US 12,564,262 B2
(45) Date of Patent: Mar. 3, 2026

(54) OBJECT HANGING SYSTEM AND METHOD

(71) Applicant: Hang It Simple, LLC, Pensacola, FL (US)

(72) Inventors: Stuart Brown, Pensacola, FL (US); Dale McCarthy, Pace, FL (US)

(73) Assignee: Hang It Simple, LLC, Pensacola, FL (US)

( * ) Notice: Subject to any disclaimer, the term of this patent is extended or adjusted under 35 U.S.C. 154(b) by 6 days.

(21) Appl. No.: 18/746,693

(22) Filed: Jun. 18, 2024

(65) Prior Publication Data

US 2024/0335037 A1 Oct. 10, 2024

Related U.S. Application Data

(63) Continuation of application No. 17/579,197, filed on Jan. 19, 2022, now Pat. No. 12,053,089.

(60) Provisional application No. 63/139,577, filed on Jan. 20, 2021.

(51) Int. Cl.

| | |
|---|---|
| ***A47B 96/06*** | (2006.01) |
| *A47F 5/08* | (2006.01) |
| *A47F 7/14* | (2006.01) |

(52) U.S. Cl.

CPC ..... *A47B 96/067* (2013.01); *A47F 5/08* (2013.01); *A47F 5/0876* (2013.01); *A47F 7/143* (2013.01)

(58) Field of Classification Search

CPC ..... A47B 96/067; A47B 57/40; A47B 57/404; A47F 5/08; A47F 5/0876; A47F 5/0815; A47F 5/0006; A47F 7/143; A47G 25/06; A47G 25/0607; A47G 25/0678

See application file for complete search history.

(56) References Cited

U.S. PATENT DOCUMENTS

| | | | | | |
|---|---|---|---|---|---|
| 177,936 | A * | 5/1876 | Haines | A47G 25/06 | 211/106.01 |
| 361,248 | A * | 4/1887 | Winton | H01F 7/0252 | 211/DIG. 1 |
| 1,930,965 | A * | 10/1933 | Christy | A47F 5/08 | 211/94.01 |
| 2,414,653 | A * | 1/1947 | Lookholder | A47K 1/09 | 211/DIG. 1 |
| 2,611,492 | A * | 9/1952 | Watts | A47G 25/02 | 211/113 |

(Continued)

*Primary Examiner* — Devin K Barnett

(74) *Attorney, Agent, or Firm* — Christopher A. Proskey; BrownWinick Law Firm

(57) ABSTRACT

A system for hanging objects from a mounting surface is presented. In one or more arrangements, the system includes a mounting rail and one or more hanging members configured to attach to the mounting rail and facilitate hanging of objects therefrom. The mounting rail includes a channel member that provides a channel having a downward facing open end. The hanging members are configured to be inserted into and held within the channel of the channel member. The hanging members each have a body configured to hang or hold one or more objects. Hanging members have a head portion configured to be inserted into and held within the channel. The hanging member also has a neck portion. When the head portion is held within the channel, the neck portion extends through the open end of the channel and connects the head portion to the body of the hanging member.

8 Claims, 81 Drawing Sheets

(56) References Cited

U.S. PATENT DOCUMENTS 2,642,999 A * 6/1953 Mcpherson ..... H01F 7/0252 D6/531
2,926,879 A * 3/1960 Dietrich ..... B63B 29/12 224/406
3,239,182 A * 3/1966 Blanz ..... A47F 5/0068 248/223.41
3,516,634 A * 6/1970 Schafernak ..... A47B 96/061 211/106.01
3,886,698 A * 6/1975 Raith ..... A47B 57/404 211/126.16
4,094,415 A * 6/1978 Larson ..... A47F 5/0823 211/85.15
4,215,840 A * 8/1980 Babberl ..... G09F 1/10 248/220.22
4,226,394 A * 10/1980 Einhorn ..... A47J 47/16 D8/367
4,282,630 A * 8/1981 Toder ..... A47H 15/04 206/343
4,308,961 A * 1/1982 Kunce ..... A47F 5/0853 248/222.51
4,367,819 A * 1/1983 Lewis ..... A47F 5/0876 248/222.51
4,802,580 A * 2/1989 Andersen ..... B25H 3/04 211/DIG. 1
4,817,900 A * 4/1989 Whittington ..... A47F 5/005 248/225.11
4,998,304 A * 3/1991 Sauter ..... A47K 3/34 49/70
5,125,518 A * 6/1992 Ward ..... B60R 9/00 211/87.01
5,154,385 A * 10/1992 Lindberg ..... A47B 57/562 248/245
5,224,607 A * 7/1993 Koresko ..... A47G 25/32 211/116
5,503,277 A * 4/1996 O'Brien ..... A47B 95/008 248/222.51
5,897,002 A * 4/1999 Carlino ..... A47F 5/0846 211/94.01
5,934,637 A * 8/1999 Robinson ..... A47K 1/09 248/311.2
6,119,878 A * 9/2000 Zen ..... A47F 5/0846 248/222.51
6,131,866 A * 10/2000 Kesinger ..... A47B 96/067 248/225.11
6,349,507 B1 * 2/2002 Muellerleile ..... A47F 5/0846 108/106
6,364,141 B1 * 4/2002 Ehrgott ..... B60P 7/15 211/208
6,591,541 B1 * 7/2003 Cummings ..... A01K 97/10 248/514
6,719,155 B1 * 4/2004 Chang ..... B25H 3/04 211/DIG. 1
6,749,156 B1 * 6/2004 Buehlmeyer ..... E04D 13/0722 248/48.1
6,763,957 B1 * 7/2004 Mullerleile ..... A47F 5/0846 211/94.01
7,152,838 B2 * 12/2006 Taulbee ..... B60P 3/36 248/339
7,228,977 B2 * 6/2007 Perkins ..... A47B 95/008 211/94.01
7,252,274 B1 * 8/2007 Brannen ..... A47J 45/02 248/339
7,753,333 B2 * 7/2010 Kubota ..... A47F 5/0807 52/36.5
7,882,965 B1 * 2/2011 Kao ..... B25H 3/04 248/303
8,002,225 B1 * 8/2011 Malone ..... A47B 81/00 248/339
8,066,130 B2 * 11/2011 Shaha ..... A47B 96/067 211/106.01
8,066,148 B2 * 11/2011 Garahan ..... B60N 3/102 220/737
8,308,116 B2 * 11/2012 Daniels ..... A47G 25/0678 211/106.01
8,662,322 B2 * 3/2014 Magnusson ..... F16M 13/02 248/303
9,060,467 B2 * 6/2015 Nee ..... A47G 7/045
9,657,890 B2 * 5/2017 Botello ..... A47F 5/0846
10,986,942 B2 * 4/2021 Wood ..... A47F 7/022
11,089,885 B2 * 8/2021 Keller ..... A47F 5/0853
11,412,850 B2 * 8/2022 Sisto ..... A47B 95/008
11,602,220 B1 * 3/2023 Sagorski ..... A47B 96/067
12,053,089 B2 * 8/2024 Brown ..... A47F 5/0853
2004/0149669 A1 * 8/2004 Tomonari ..... A47B 96/067 248/222.51
2007/0251904 A1 * 11/2007 Winig ..... A47B 96/06 211/106.01
2008/0128373 A1 * 6/2008 Chang ..... A47G 25/0607 211/106.01
2008/0251682 A1 * 10/2008 Repac ..... F16B 45/008 248/304
2009/0266952 A1 * 10/2009 Phillips, Sr. ..... A47B 96/061 248/206.5
2010/0084531 A1 * 4/2010 Schuchman ..... B60N 3/103 248/311.2
2012/0181244 A1 * 7/2012 Wang ..... A47G 25/0614 211/106.01
2013/0125495 A1 * 5/2013 Thrush ..... F16M 13/022 248/223.41
2014/0138332 A1 * 5/2014 Loree ..... F16B 2/22 403/326
2014/0252820 A1 * 9/2014 Botello ..... A47G 23/0225 248/223.41
2014/0360955 A1 * 12/2014 Presenty ..... A47F 5/0037 211/75

* cited by examiner

OBJECT HANGING SYSTEM AND METHOD

CROSS REFERENCE TO RELATED APPLICATIONS

This application is a continuation of U.S. patent application Ser. No. 17/579,197 filed on Jan. 19, 2022 and published as U.S. Pat. Pub. 2022/0225769, which claims the benefit of U.S. Provisional Patent Application 63/139,577 filed on Jan. 20, 2021 and titled "OBJECT HANGING SYSTEM AND METHOD", the entirety of which is hereby fully incorporated by reference herein.

FIELD OF THE DISCLOSURE

This disclosure relates to hanging objects, such as tools, garden tools, hoses, belts, ties, hats, jewelry, hand bags, scarves, clothing, hand tools, power tools, among countless other objects. More specifically and without limitation, this disclosure relates to an object hanging system and method of use for hanging of objects on a mounting surface.

OVERVIEW OF THE DISCLOSURE

Hanger and organizer systems are used to mount, store, and/or organize tools, garden tools, hoses, belts, ties, hats, jewelry, hand bags, scarves, clothing, among other objects. One problem with some conventional hanging systems is that they require hangers to be mounted a particular location using one or more screws or nails which necessitate the creation of screw or nail holes in the wall or surface on which the object is hung. To rearrange or adapt the system to hang different objects or hang objects at different positions, additional holes must be created.

Frequent rearrangement and/or adaptation can result in numerous unused holes which are unsightly or require significant effort to completely repair. Some hanger and organization systems permit repositioning of objects without creation of new screw or nail holes. However, such systems are generally expensive to manufacture due to the need for more expensive high strength materials (e.g., steel) and/or expensive processes to machine and/or assemble components. Another problem with many hanger and organization systems is that they are considered unsightly for many hanging applications, such as hanging of pictures and décor in the interior of a home.

Therefore, for all the reasons stated above, and the reasons stated below, there is a need in the art for an improved object hanging system for connecting hanging objects to a mounting surface that is less expensive to manufacture.

Thus, it is a primary object of the disclosure to provide an object hanging system that improves upon the state of the art.

Another object of the disclosure is to provide an object hanging system that can be inexpensively manufactured using an extrusion based manufacturing process.

Yet another object of the disclosure is to provide an object hanging system that can be inexpensively manufactured from polymer materials.

Another object of the disclosure is to provide an object hanging system that allows secure mounting of objects to a supporting surface.

Yet another object of the disclosure is to provide an object hanging system that reduces installation time.

Another object of the disclosure is to provide an object hanging system that can hold heavy objects.

Yet another object of the disclosure is to provide an object hanging system that may be used with various types of hangers.

Another object of the disclosure is to provide an object hanging system that can be used on vertical and horizontal mounting surfaces.

Yet another object of the disclosure is to provide an object hanging system that is easy to use.

Another object of the disclosure is to provide an object hanging system that is intuitive to use.

Yet another object of the disclosure is to provide an object hanging system that can be used with practically any hanging object.

Another object of the disclosure is to provide an object hanging system that has an aesthetically pleasing appearance.

Yet another object of the disclosure is to provide an object hanging system that has a long useful life.

Another object of the disclosure is to provide an object hanging system that is strong.

Yet another object of the disclosure is to provide an object hanging system that allows repositioning of objects.

Another object of the disclosure is to provide an object hanging system that allows repositioning of objects to an infinite number of positions.

Yet another object of the disclosure is to provide an object hanging system that allows objects to be repositioned vertically or horizontally.

These and other objects, features, or advantages of the present disclosure will become apparent from the specification, claims and drawings.

SUMMARY OF THE DISCLOSURE

A system for hanging objects from a mounting surface is presented. In one or more arrangements, the system includes a mounting rail and one or more hanging members configured to attach to the mounting rail and facilitate hanging of objects therefrom.

In one or more arrangements, the mounting rail includes a wall attachment member having a front surface and a rear surface extending between an upper end, a lower end, and opposing sides. In one or more arrangements, the mounting rail includes a channel member attached to the upper end of the wall attachment member. In one or more arrangements, the channel member provides a channel having a downward facing open end. The hanging members are configured to be inserted into and held within the channel of the channel member. The hanging members each have a body configured to hang or hold one or more objects.

In one or more arrangements, a hanging member has a head portion configured to be inserted into and held within the channel. The hanging member also has a neck portion. When the head portion is held within the channel, the neck portion extends through the open end of the channel and connects the head portion to the body of the hanging member. In some various arrangements, the body of hanging members may be configured to provide various different types of holding and/or hanging members, for holding or hanging various objects, including but baskets, handle clamps, magnetic landing plates, hose hangers, and/or any other structure for holding and/or hanging of objects.

In one or more arrangements, the body of a hanging member is connected to the neck portion by an interconnect that permits the body to be disconnected from the neck portion. In one or more arrangements, the body of a hanging member is connected to the neck portion by a hinged interconnect that permits the body to be rotated relative to the head portion.

BRIEF DESCRIPTION OF THE DRAWINGS

The figures show the system described, in accordance with one or more embodiments.

DETAILED DESCRIPTION OF THE DISCLOSURE

Figure 1:
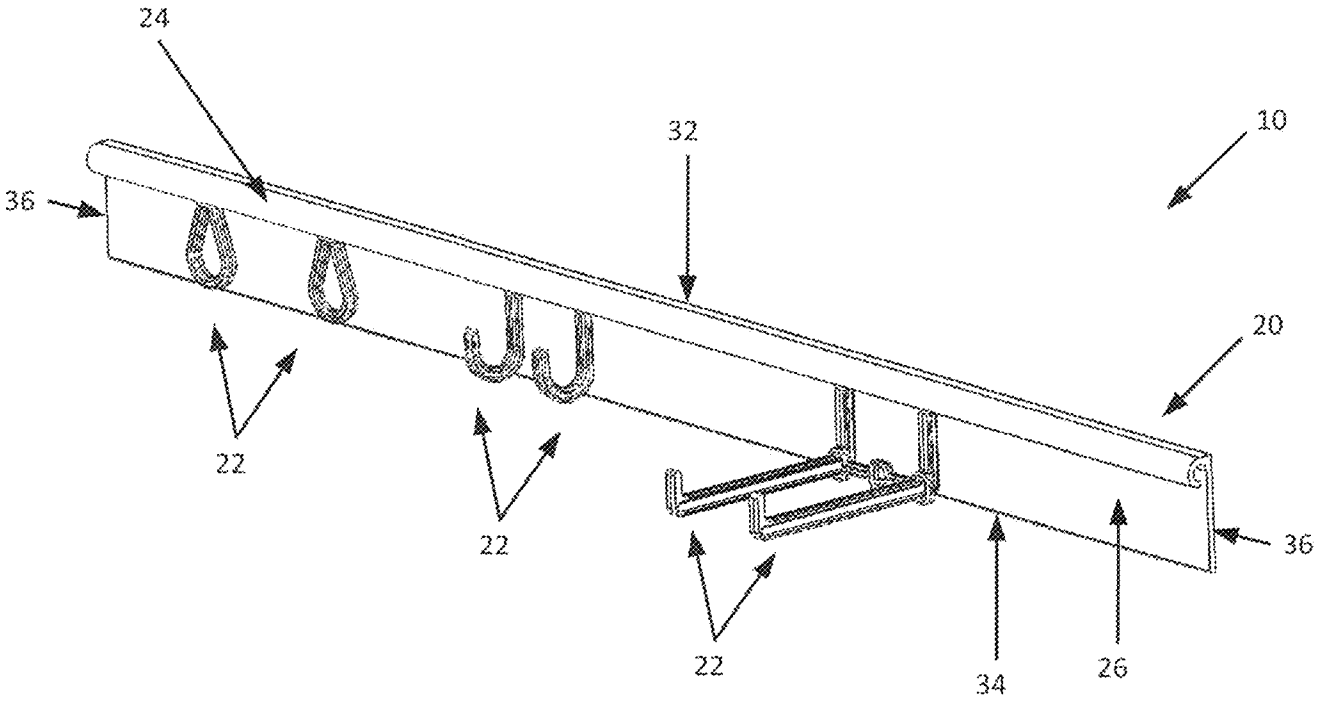
FIG. 1 shows an upper front left perspective view of an object hanging system, in accordance with one or more arrangements.
Figure 2:
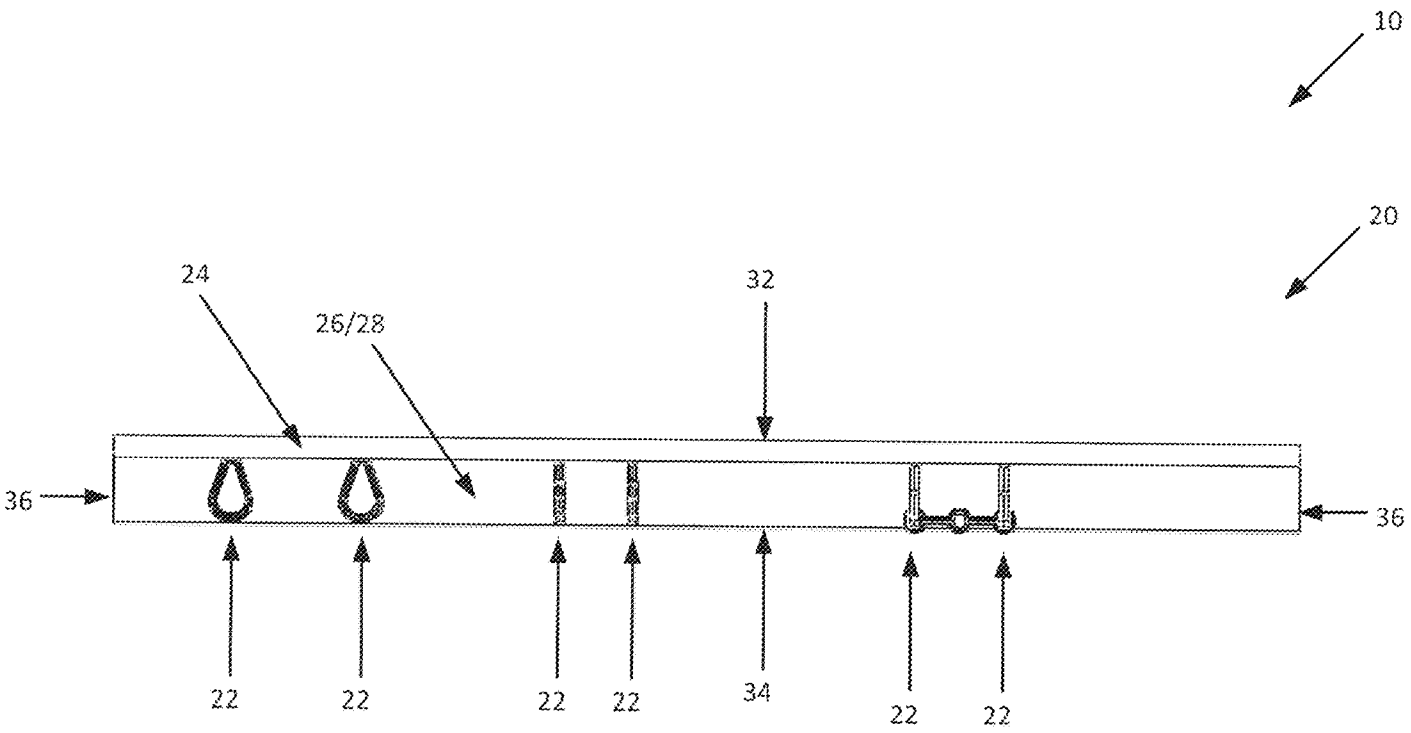
FIG. 2 shows a front view of an object hanging system, in accordance with one or more arrangements.
Figure 3:
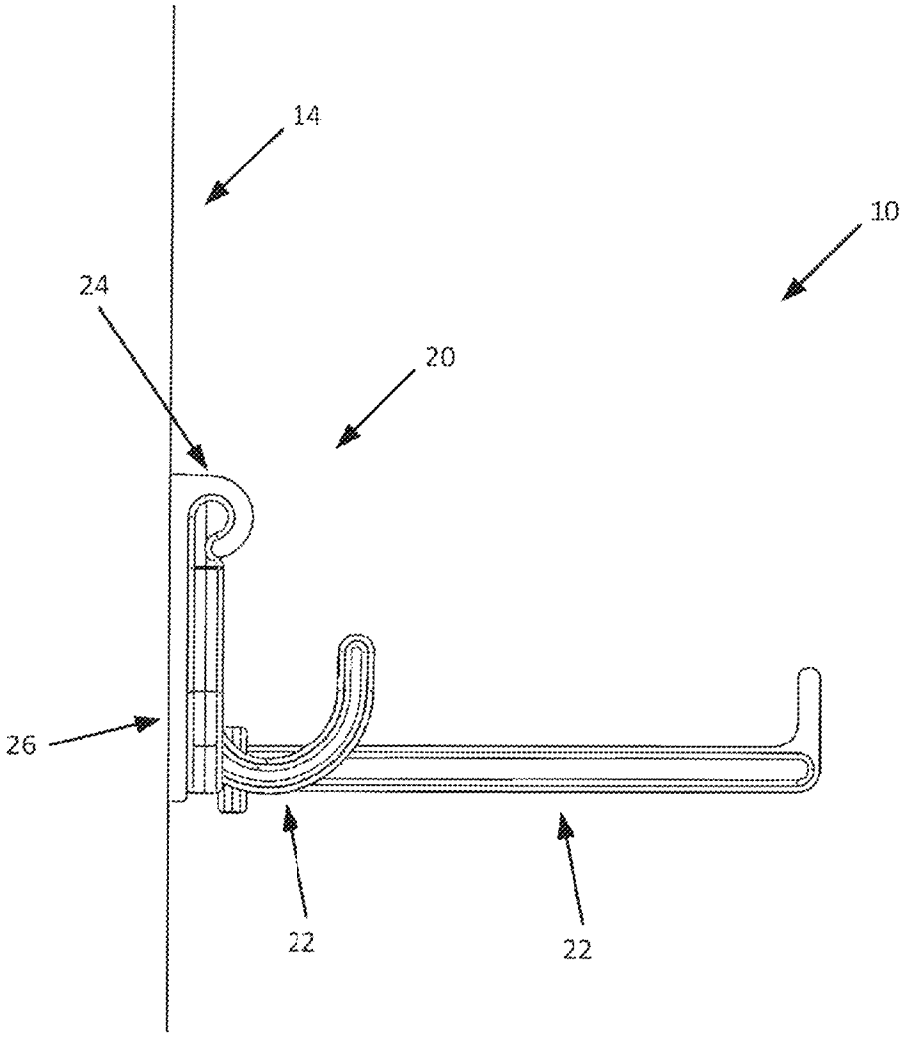
FIG. 3 shows a right side view of an object hanging system, in accordance with one or more arrangements.
Figure 4:
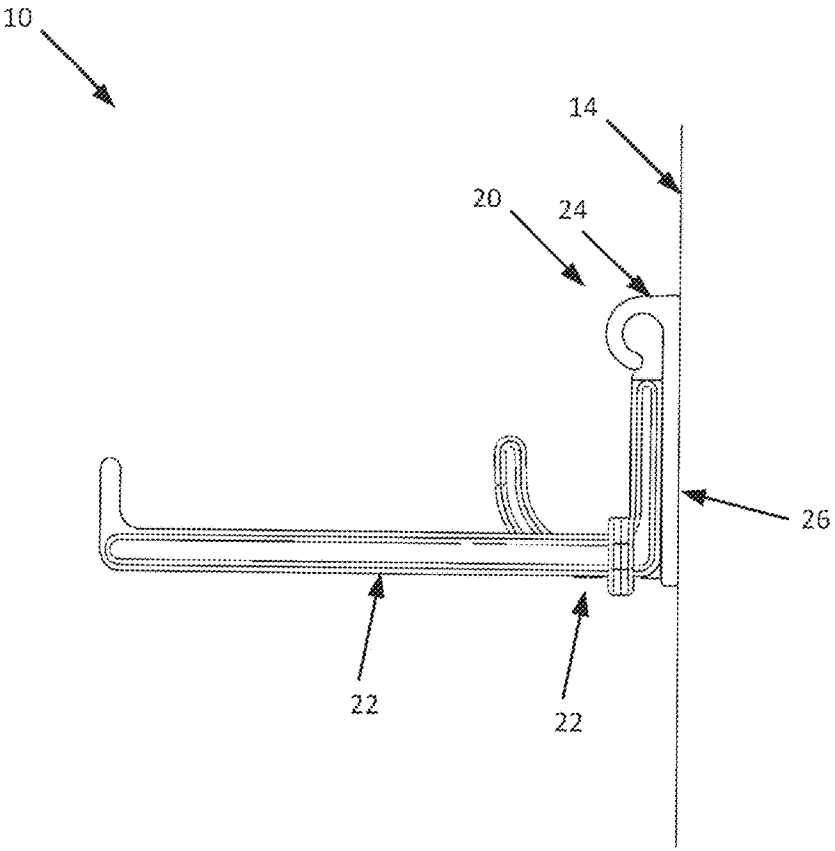
FIG. 4 shows a left side view of an object hanging system, in accordance with one or more arrangements.
Figure 5:
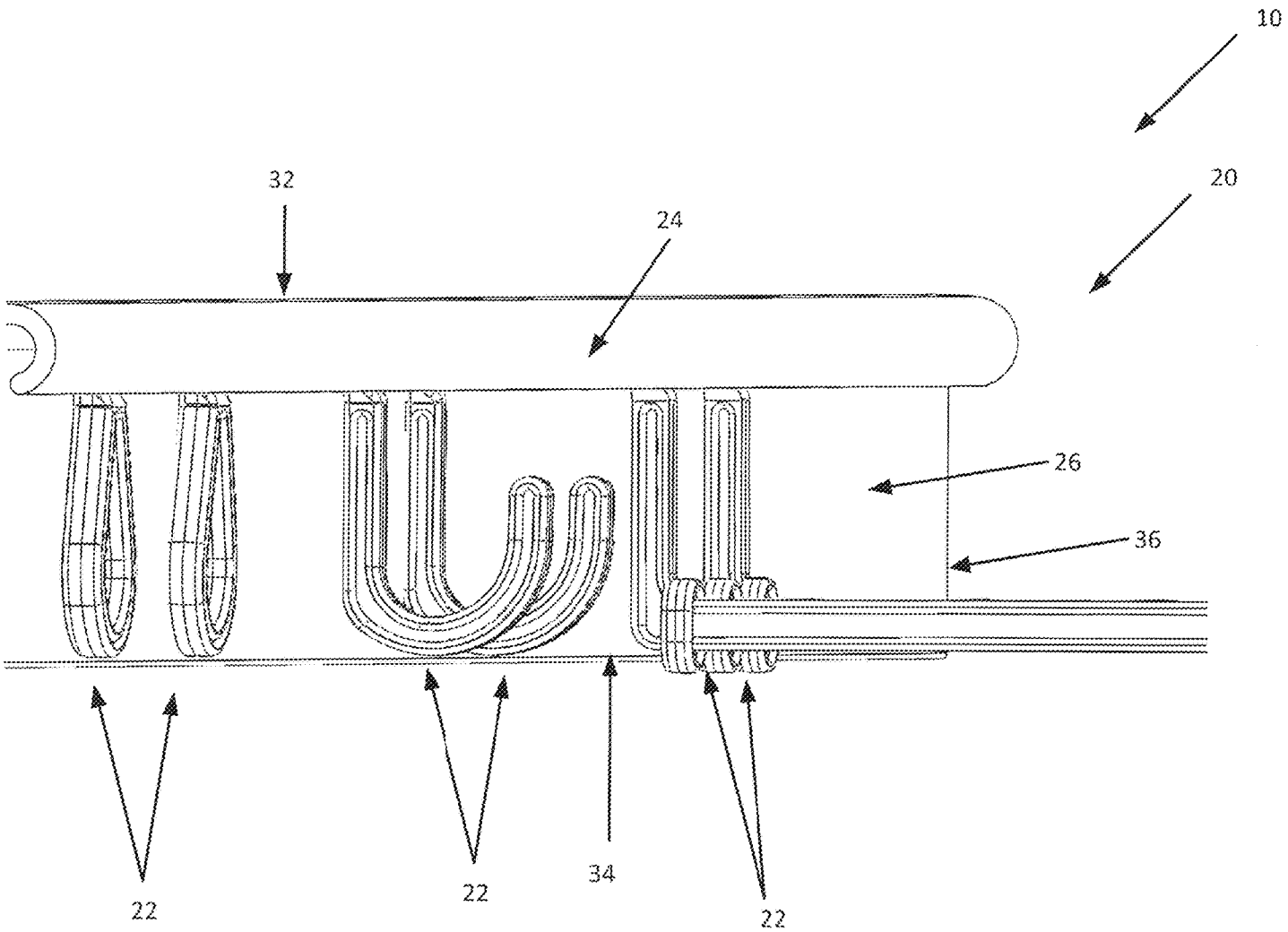
FIG. 5 shows a partial front right perspective view of an object hanging system, in accordance with one or more arrangements.
Figure 6:
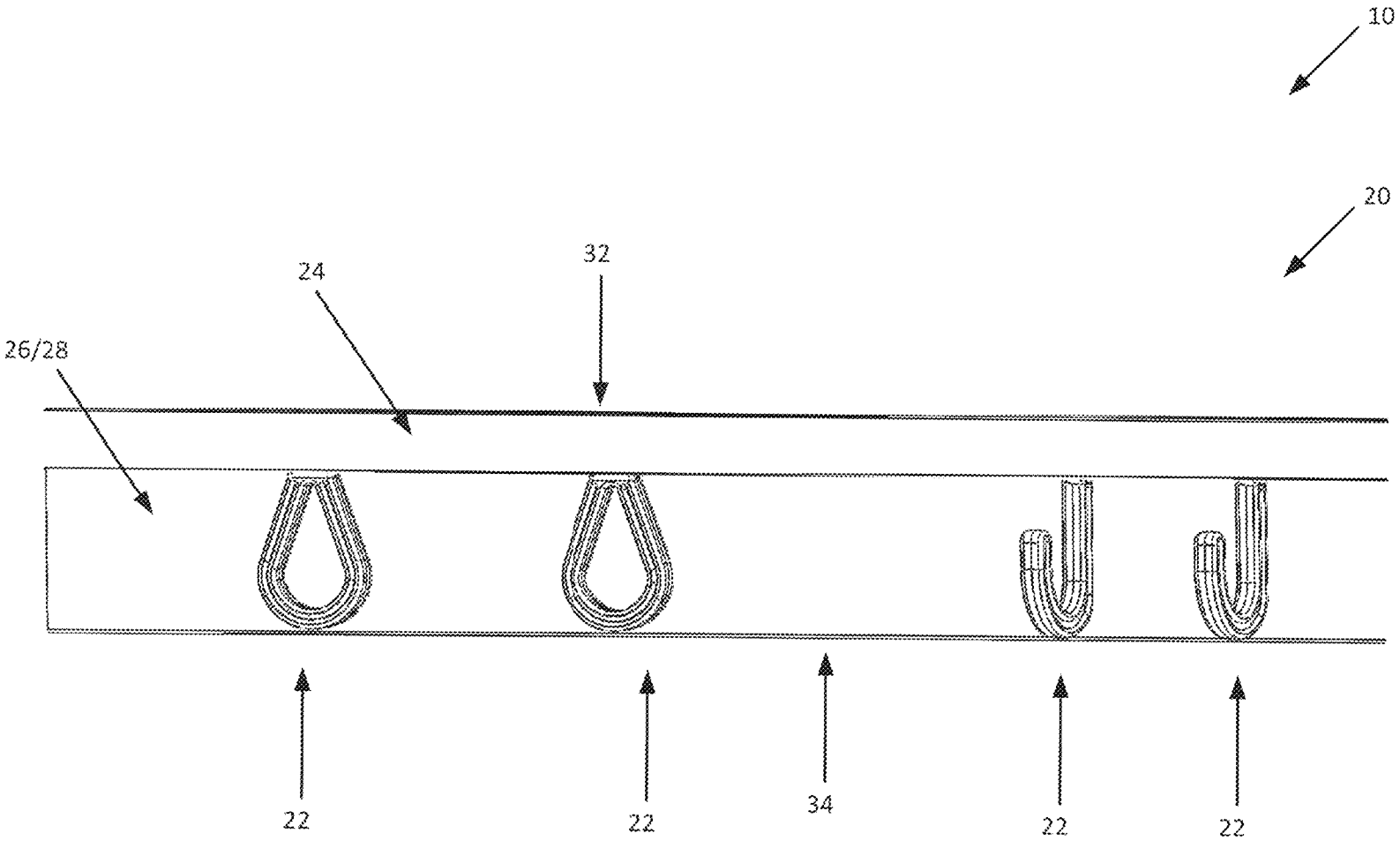
FIG. 6 shows partial front view of an object hanging system, in accordance with one or more arrangements.
Figure 7:
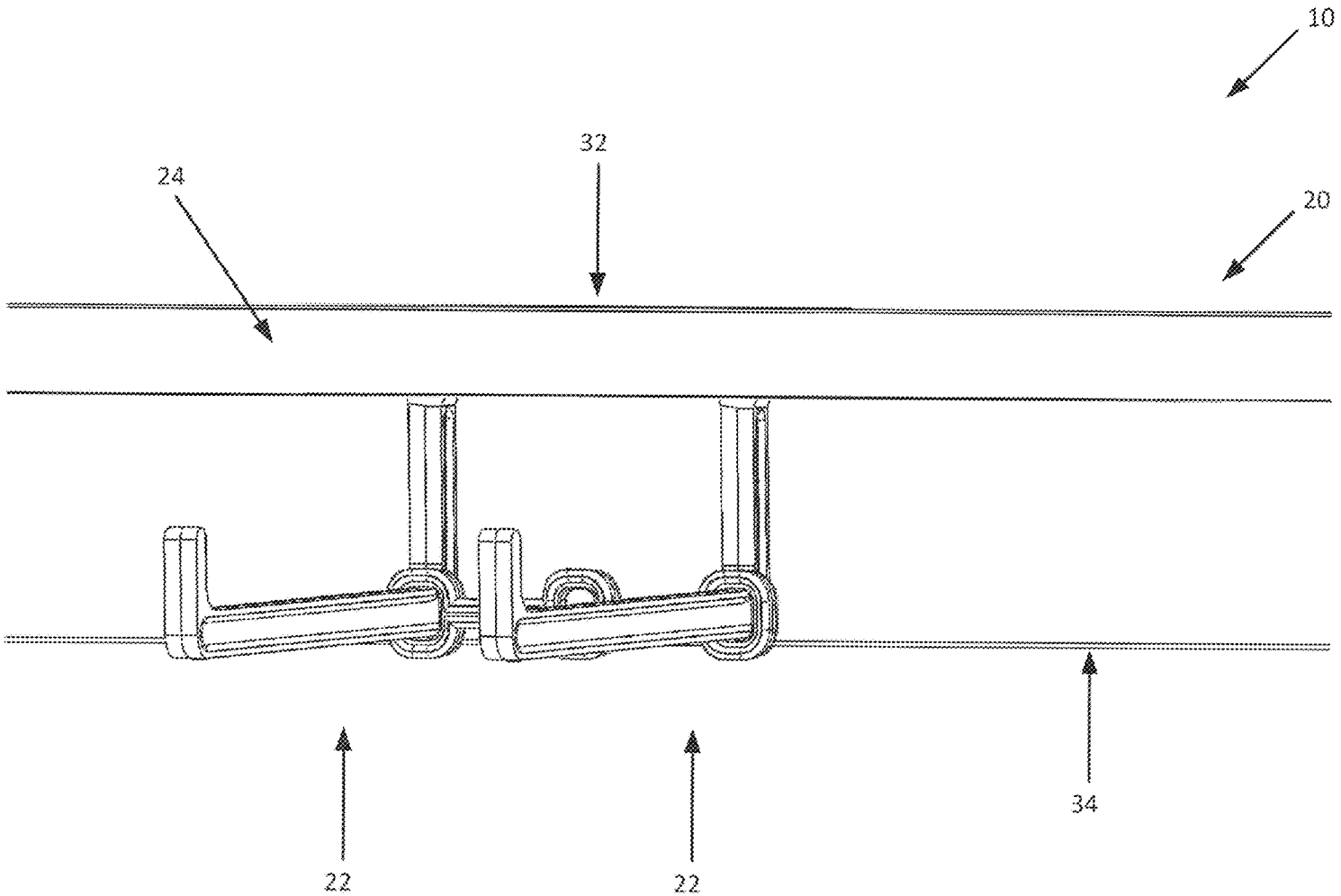
FIG. 7 shows a partial front left perspective view of an object hanging system, in accordance with one or more arrangements.
Figure 8:
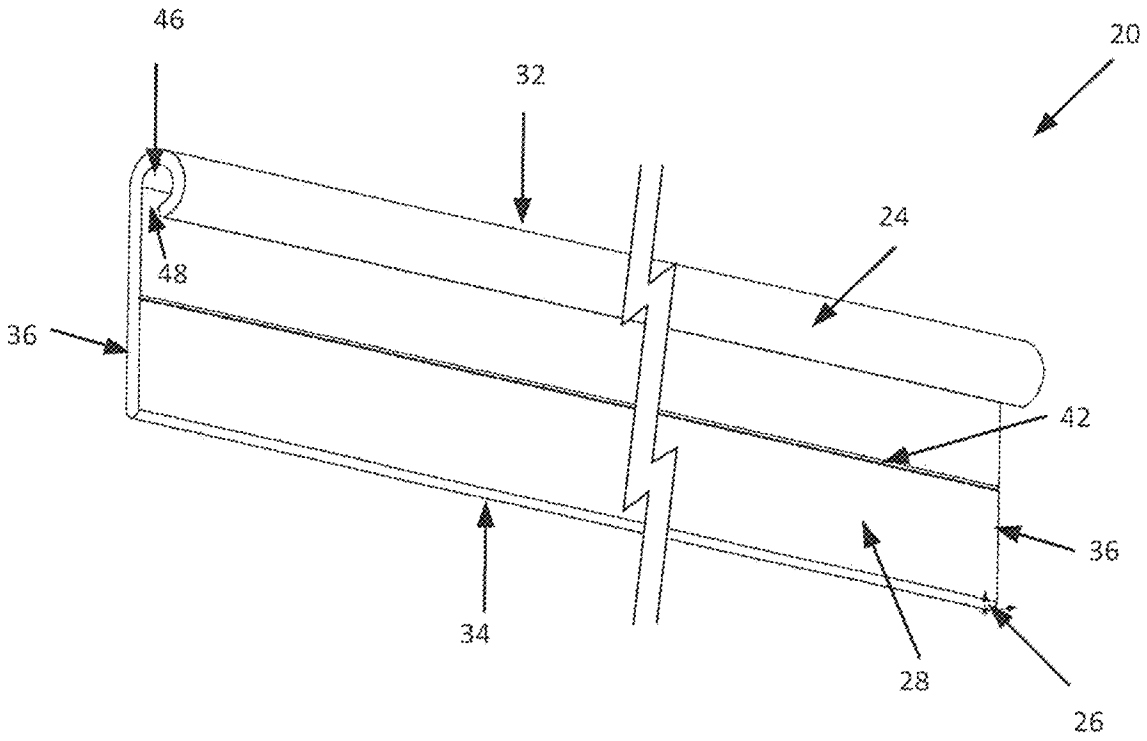
FIG. 8 shows a lower front right perspective view of a mounting rail of an object hanging system, in accordance with one or more arrangements.
Figure 9:
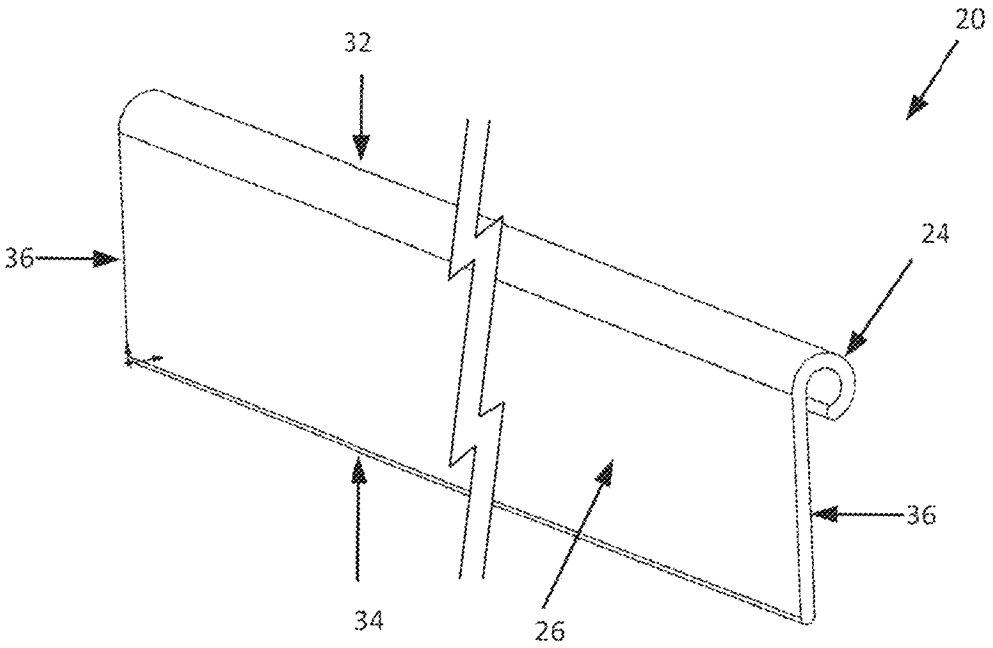
FIG. 9 shows an upper rear front right perspective view of a mounting rail of an object hanging system, in accordance with one or more arrangements.
Figure 10:
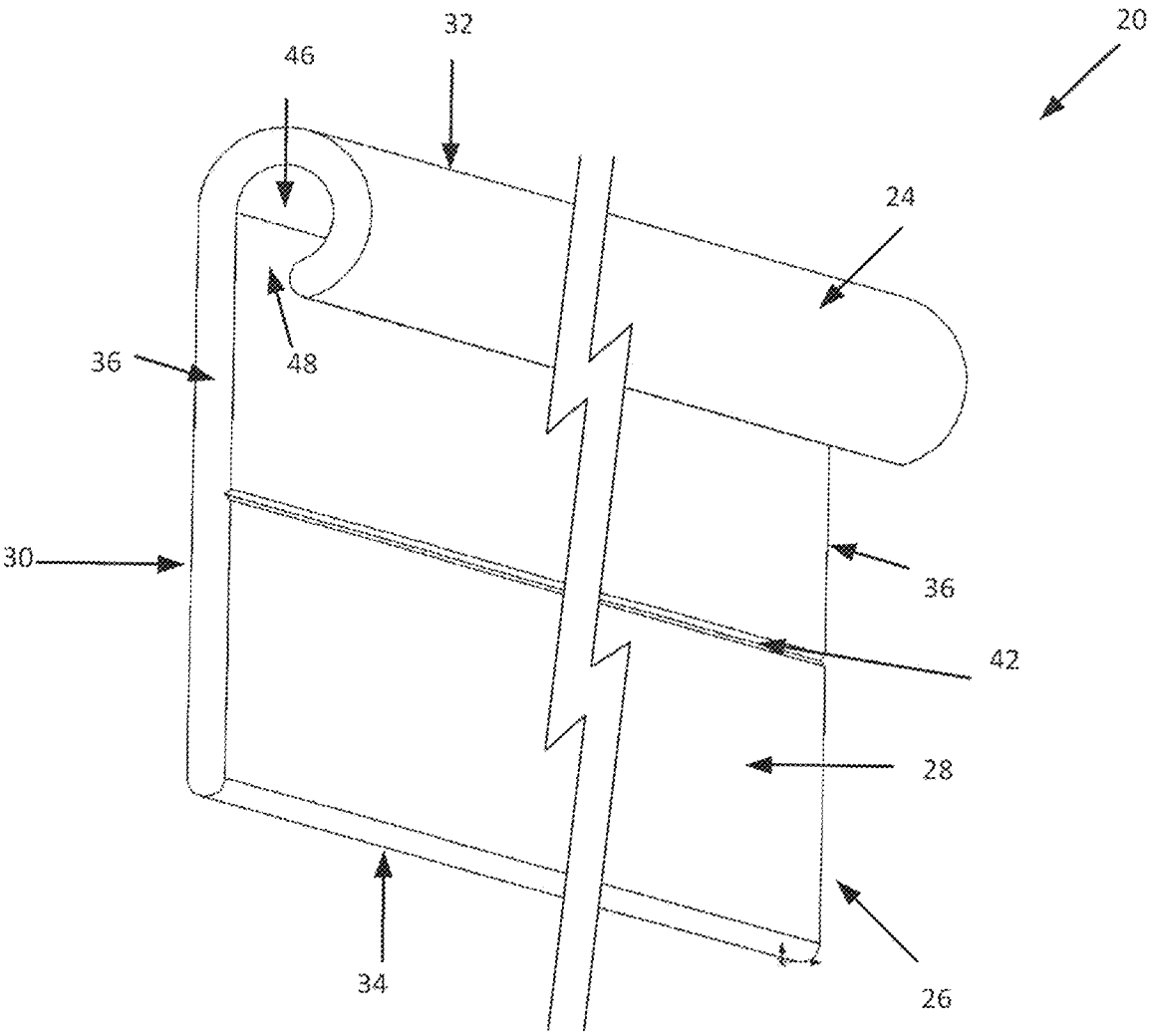
FIG. 10 shows a lower front right perspective view of a mounting rail of an object hanging system, in accordance with one or more arrangements.
Figure 11:
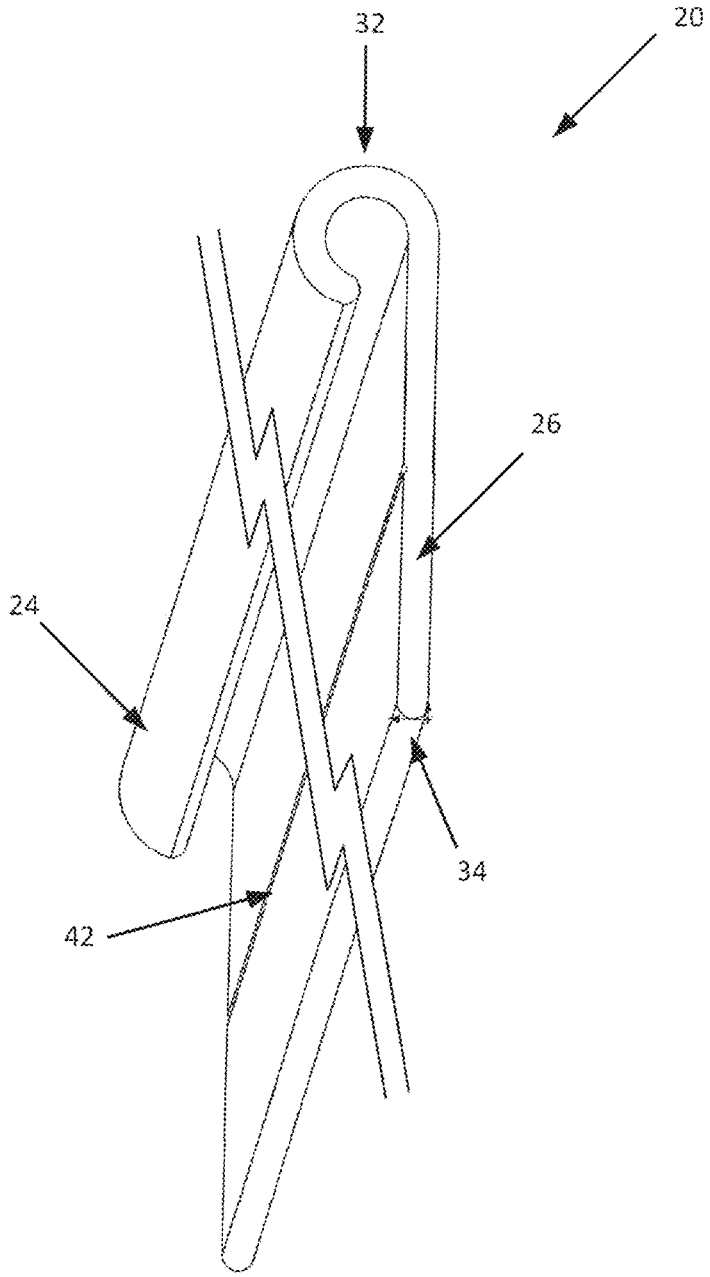
FIG. 11 shows a lower front left perspective view of a mounting rail of an object hanging system, in accordance with one or more arrangements.
Figure 12:
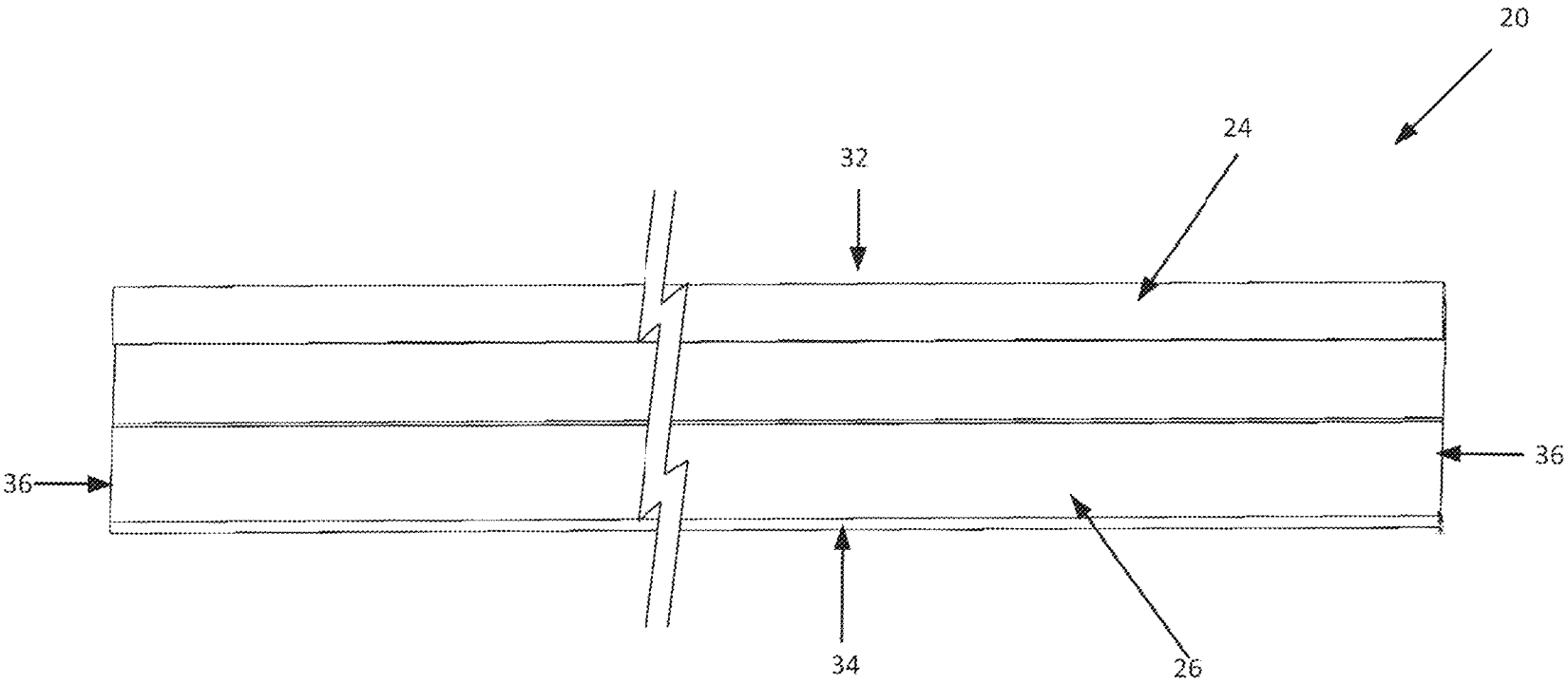
FIG. 12 shows a front view of a mounting rail of an object hanging system, in accordance with one or more arrangements.
Figure 13:
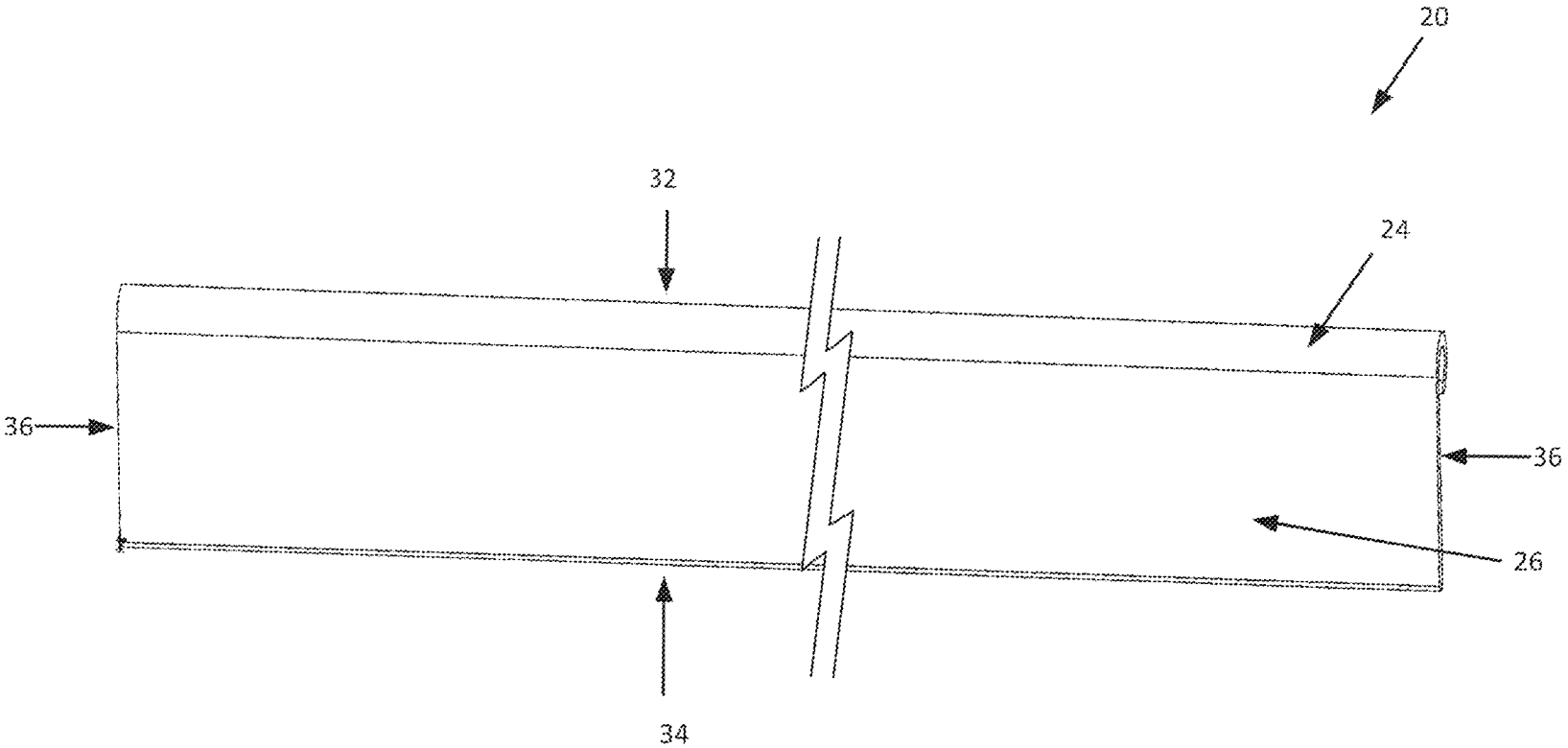
FIG. 13 shows a rear view of a mounting rail of an object hanging system, in accordance with one or more arrangements.
Figure 14:
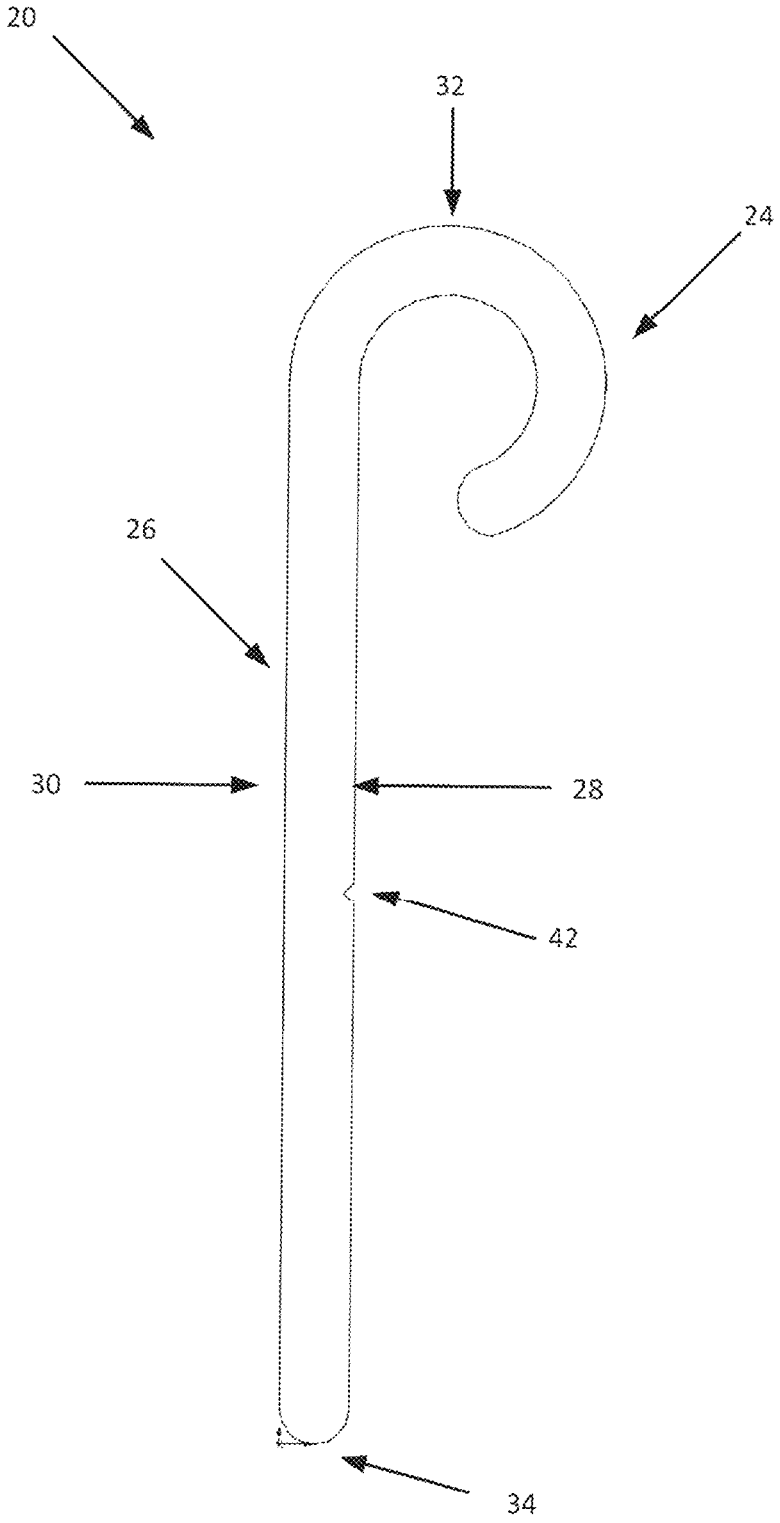
FIG. 14 shows a right side view of a mounting rail of an object hanging system, in accordance with one or more arrangements.
Figure 15:
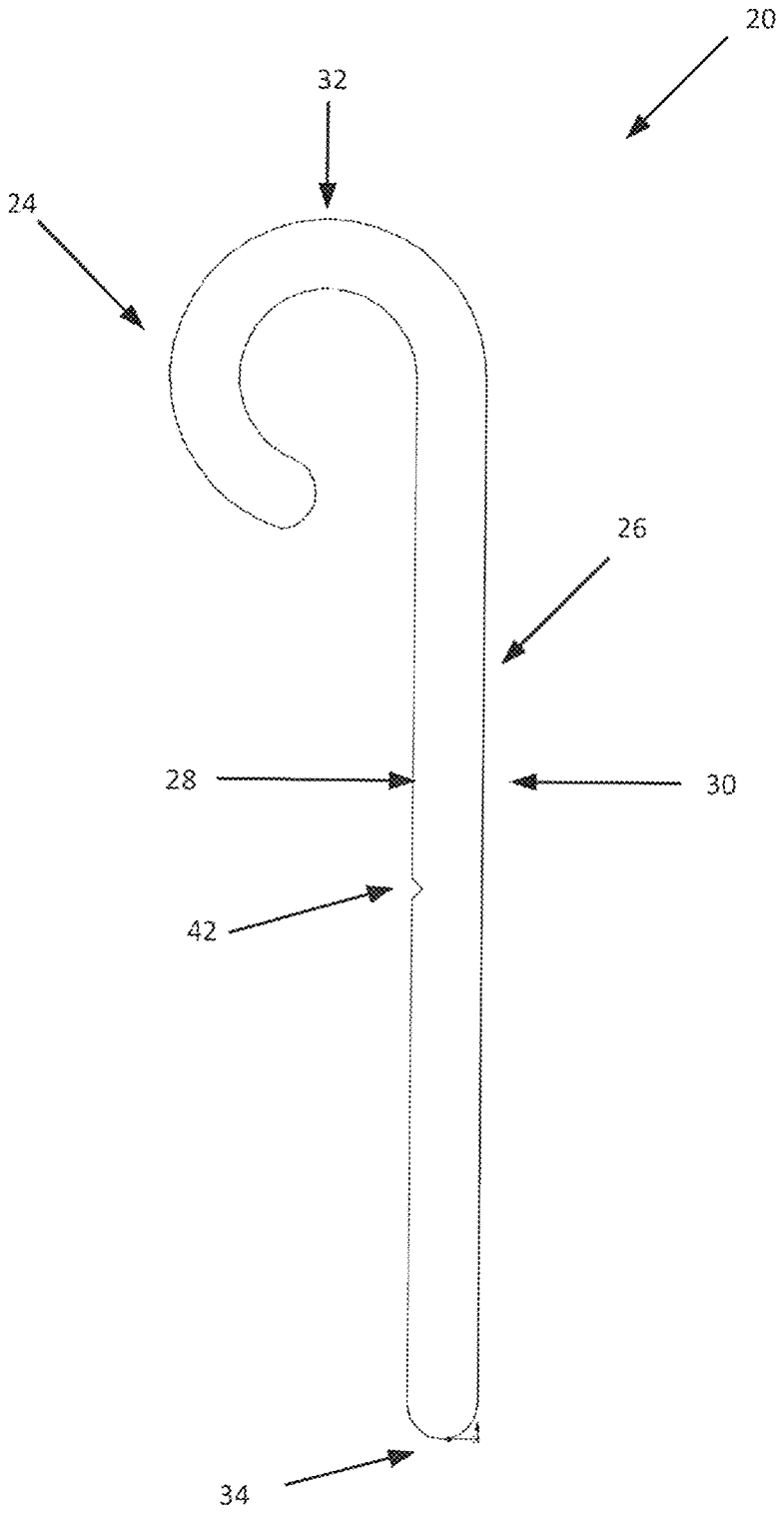
FIG. 15 shows a right side view of a mounting rail of an object hanging system, in accordance with one or more arrangements.
Figure 16:
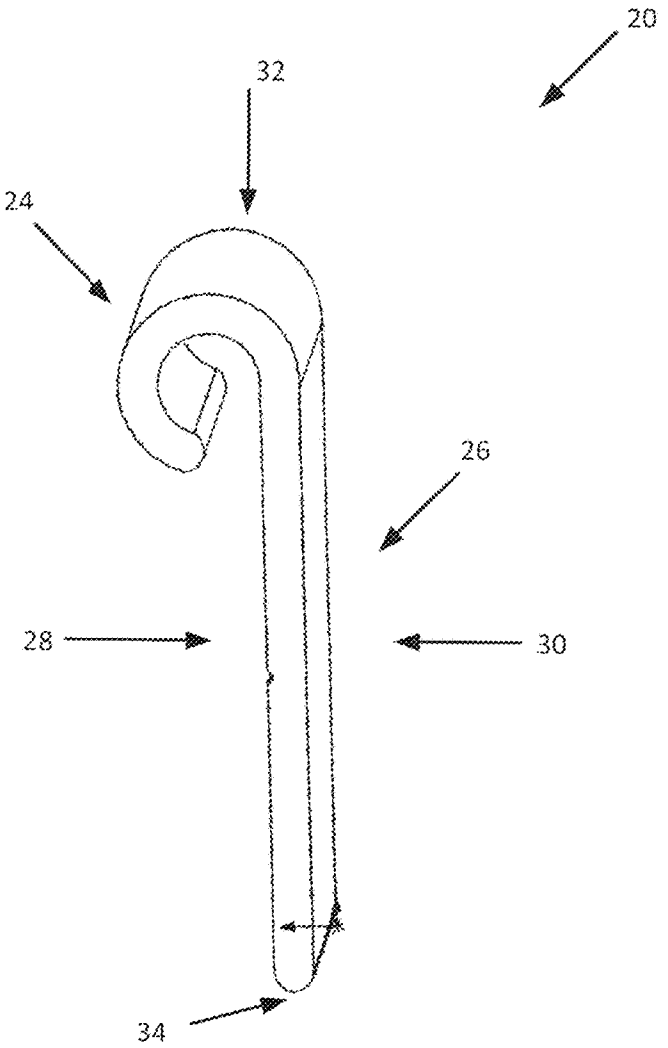
FIG. 16 shows a slightly rear left side view of a mounting rail of an object hanging system, in accordance with one or more arrangements.
Figure 17:
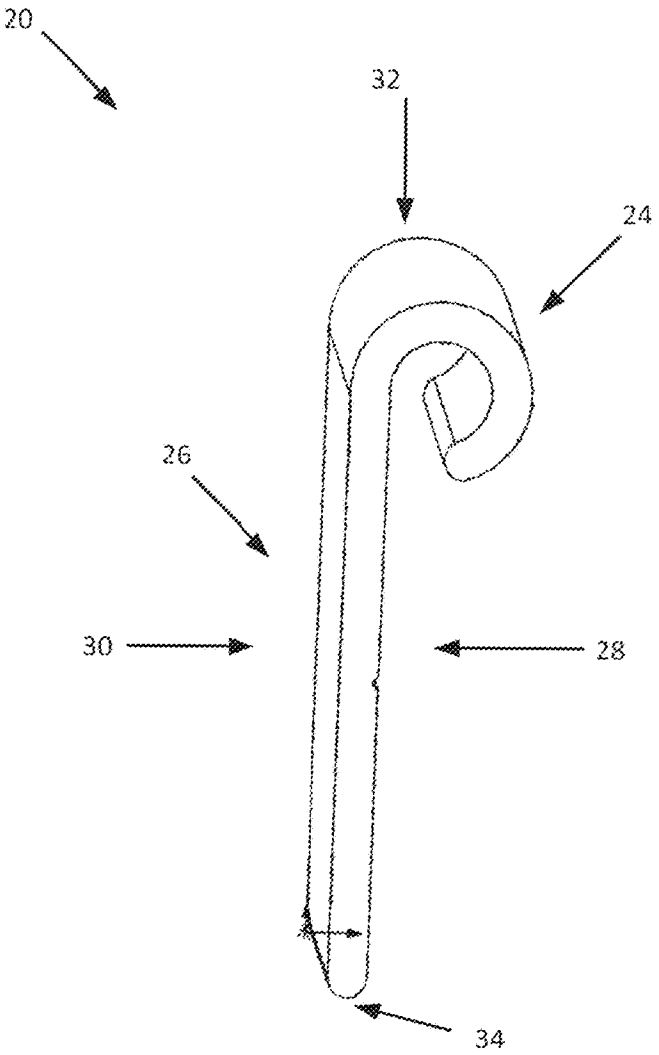
FIG. 17 shows a slightly rear right side view of a mounting rail of an object hanging system, in accordance with one or more arrangements.
Figure 18:
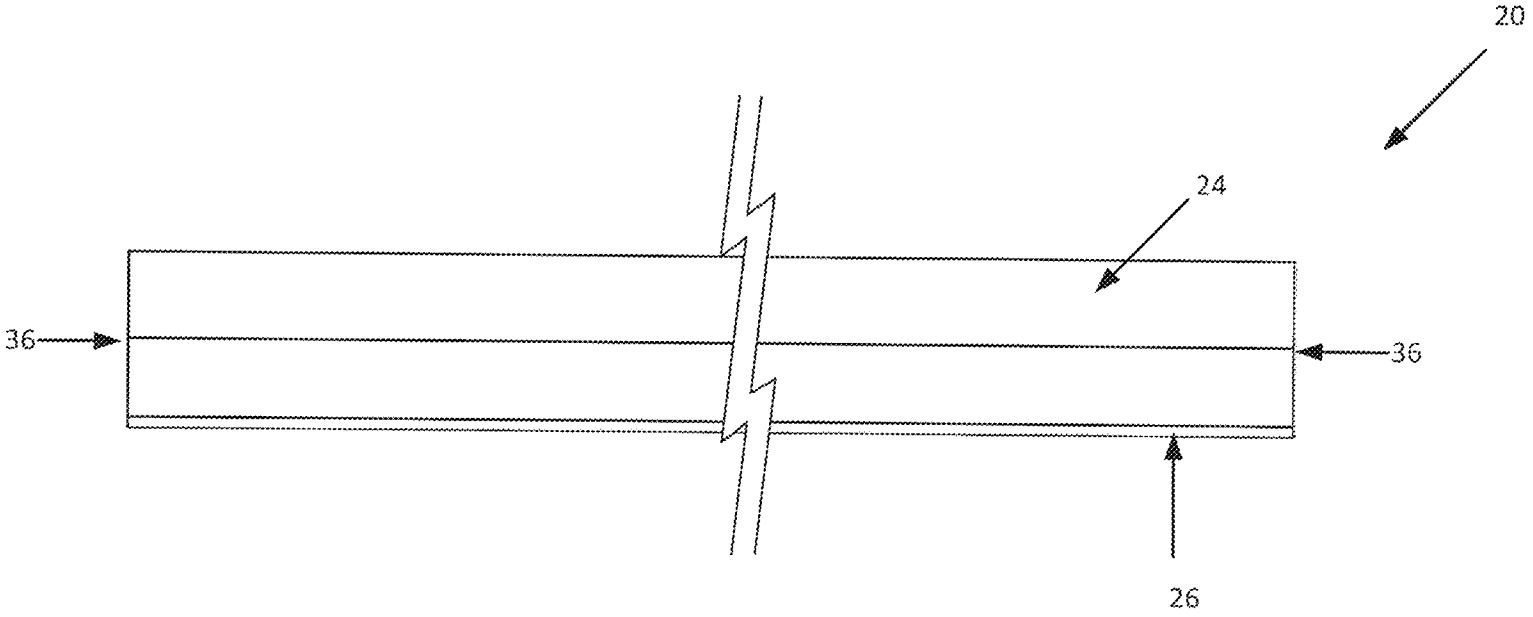
FIG. 18 shows a top view of a mounting rail of an object hanging system, in accordance with one or more arrangements.
Figure 19:
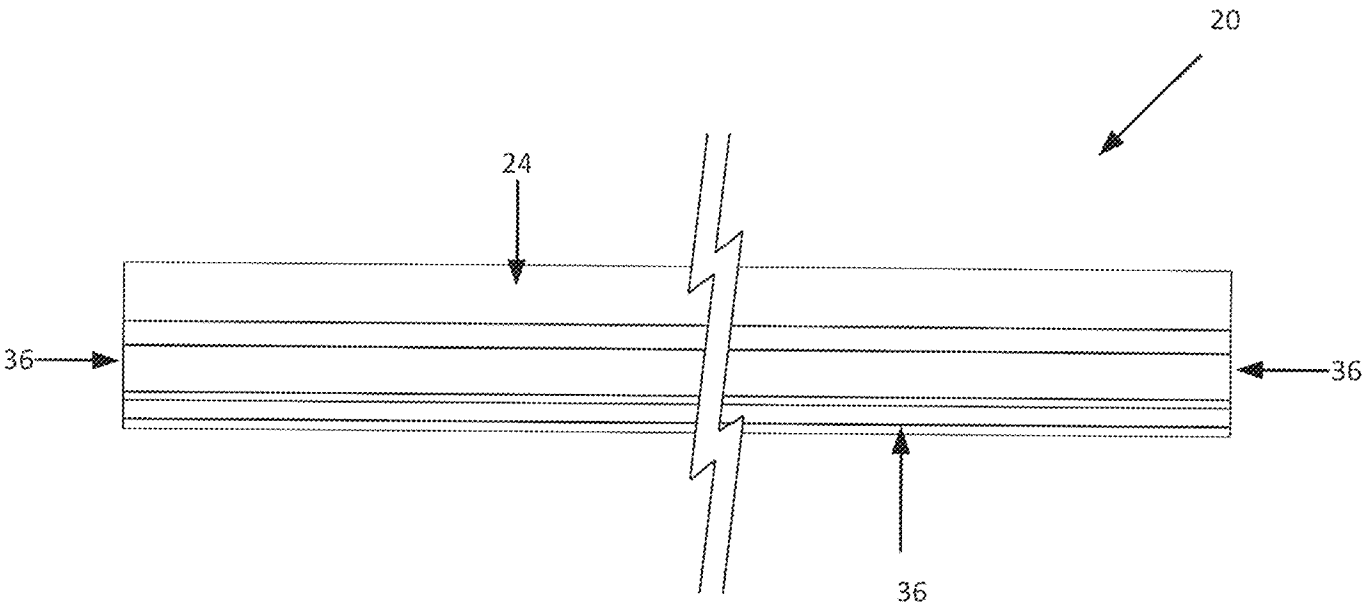
FIG. 19 shows a bottom view of a mounting rail of an object hanging system, in accordance with one or more arrangements.
Figure 20:
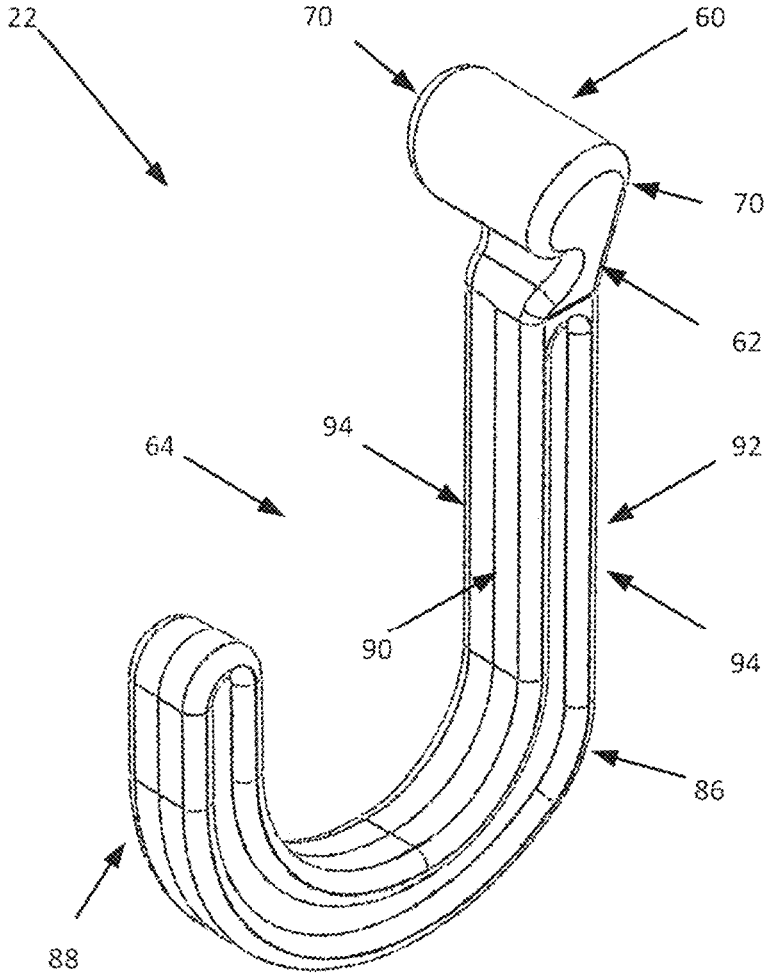
FIG. 20 shows an upper front left perspective view of a hook type hanging member for an object hanging system, in accordance with one or more arrangements.
Figure 21:
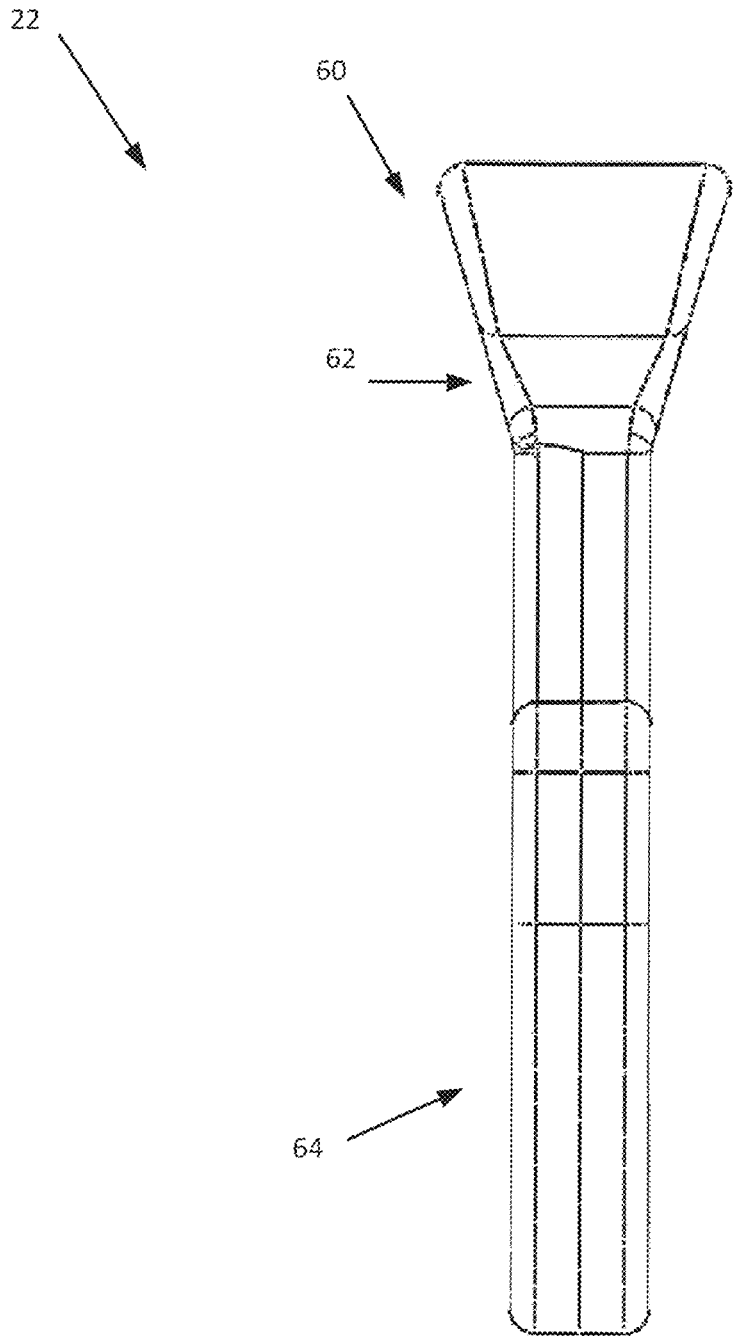
FIG. 21 shows a front view of a hook type hanging member for an object hanging system, in accordance with one or more arrangements.
Figure 22:
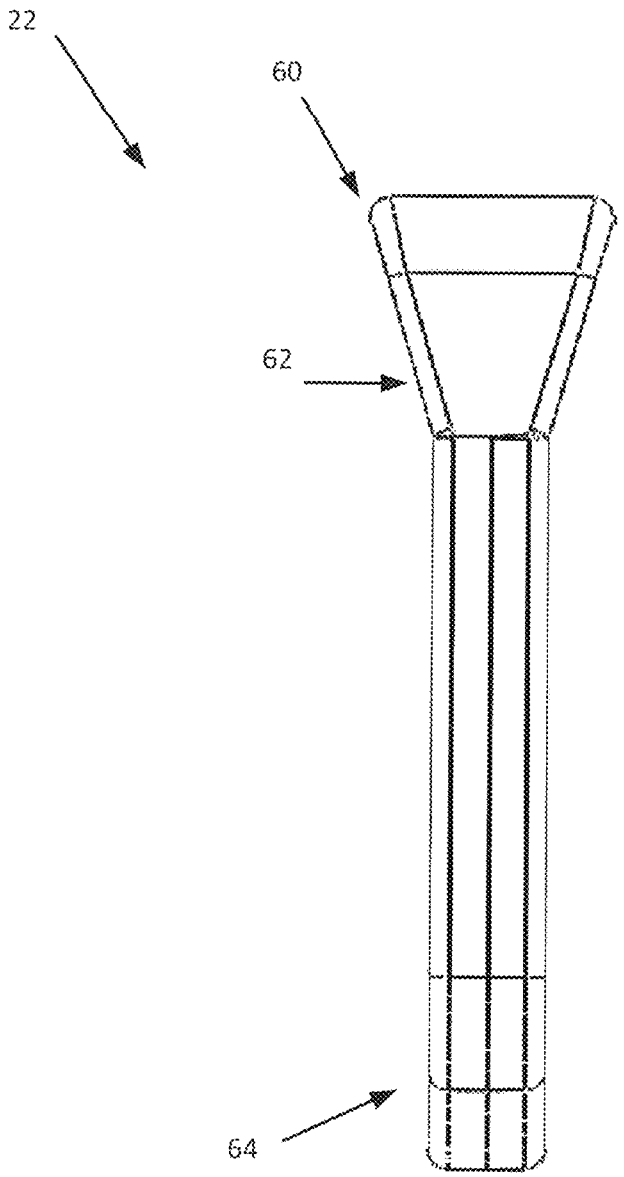
FIG. 22 shows a rear view of a hook type hanging member for an object hanging system, in accordance with one or more arrangements.
Figure 23:
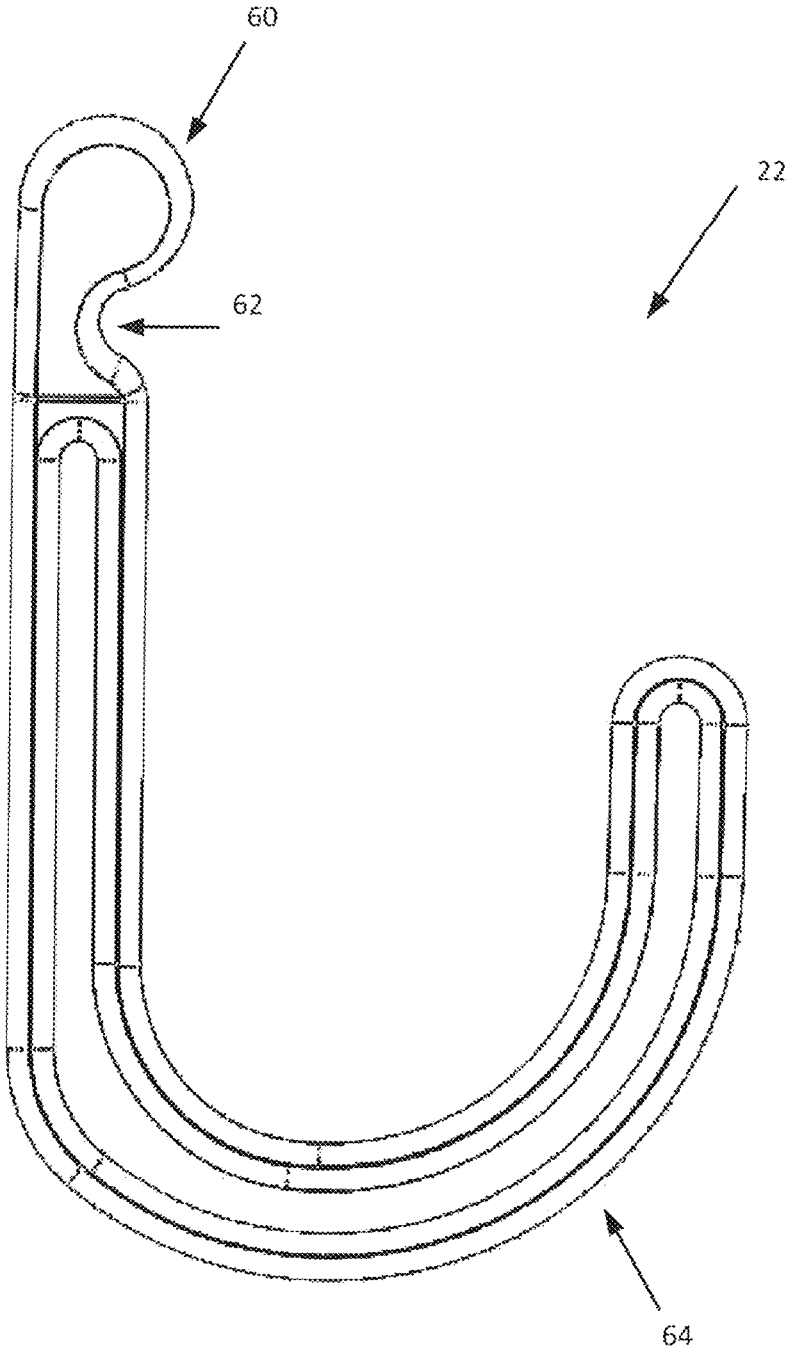
FIG. 23 shows a right side view of a hook type hanging member for an object hanging system, in accordance with one or more arrangements.
Figure 24:
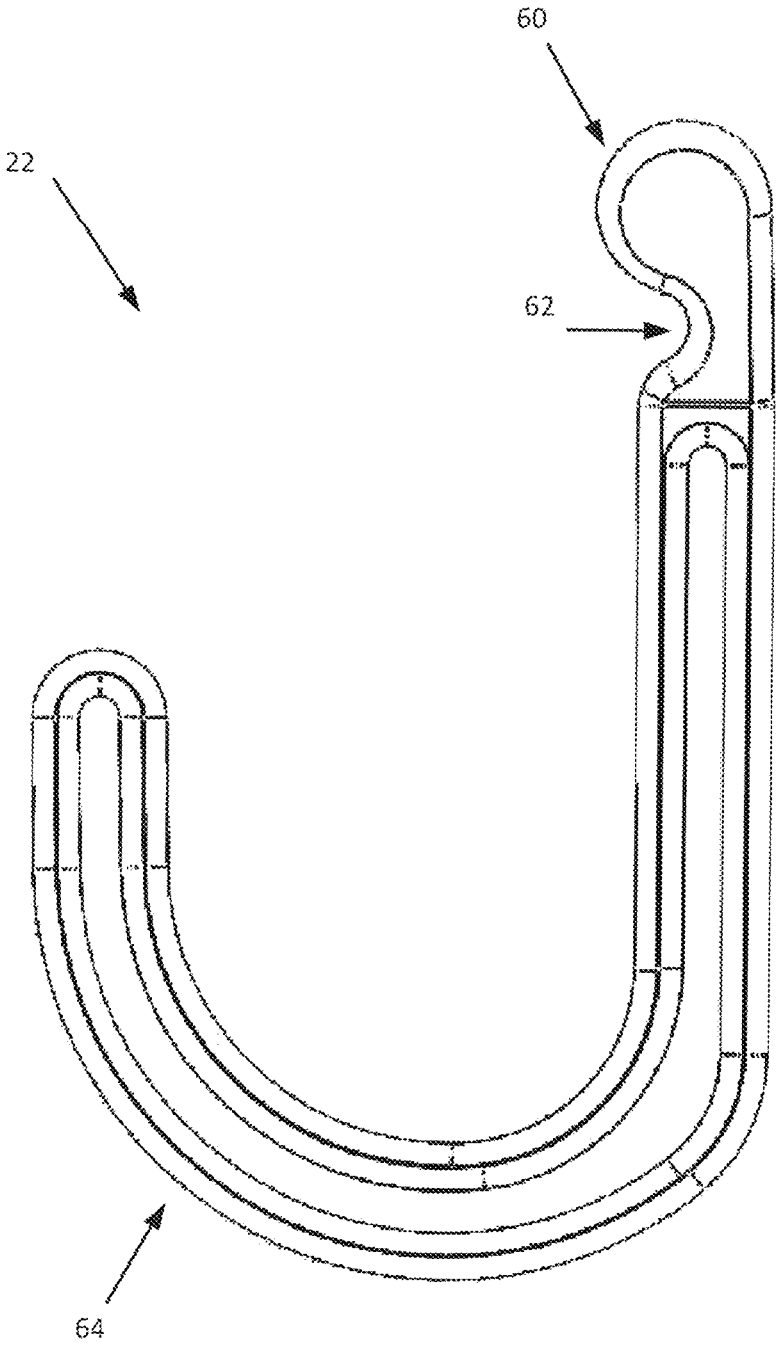
FIG. 24 shows a left side view of a hook type hanging member for an object hanging system, in accordance with one or more arrangements.
Figure 25:
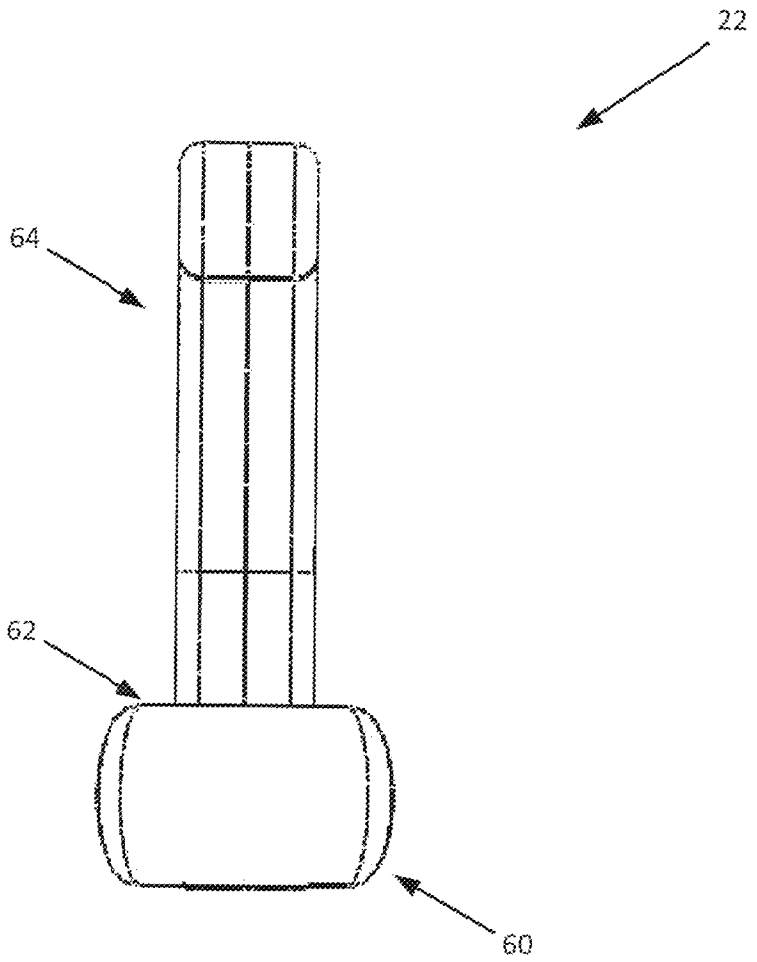
FIG. 25 shows a top view of a hook type hanging member for an object hanging system, in accordance with one or more arrangements.
Figure 26:
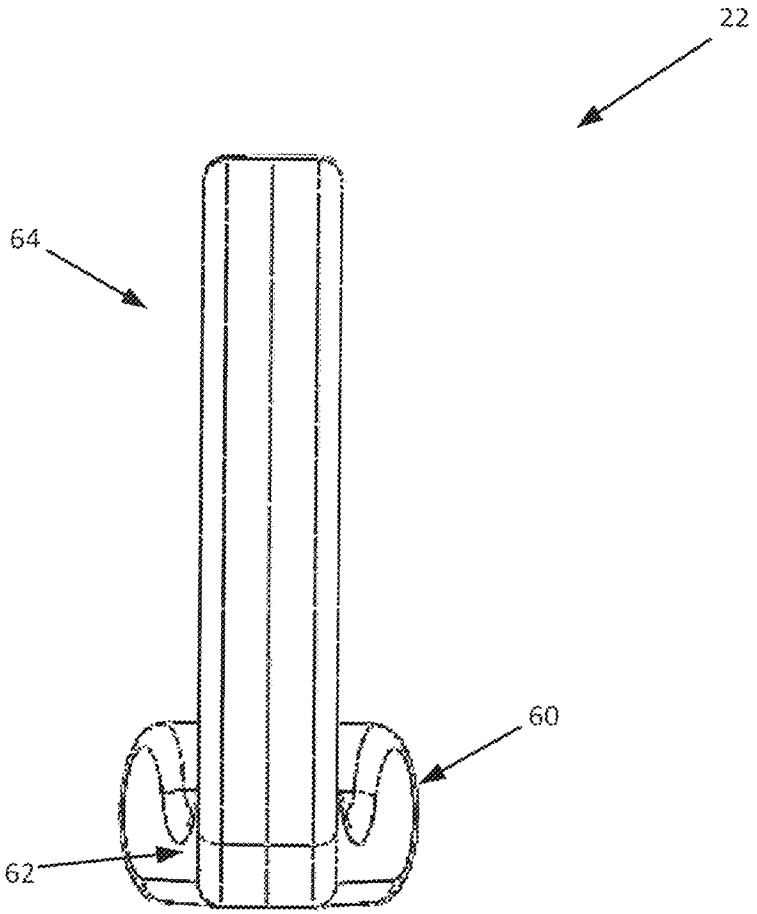
FIG. 26 shows a bottom view of a hook type hanging member for an object hanging system, in accordance with one or more arrangements.
Figure 27:
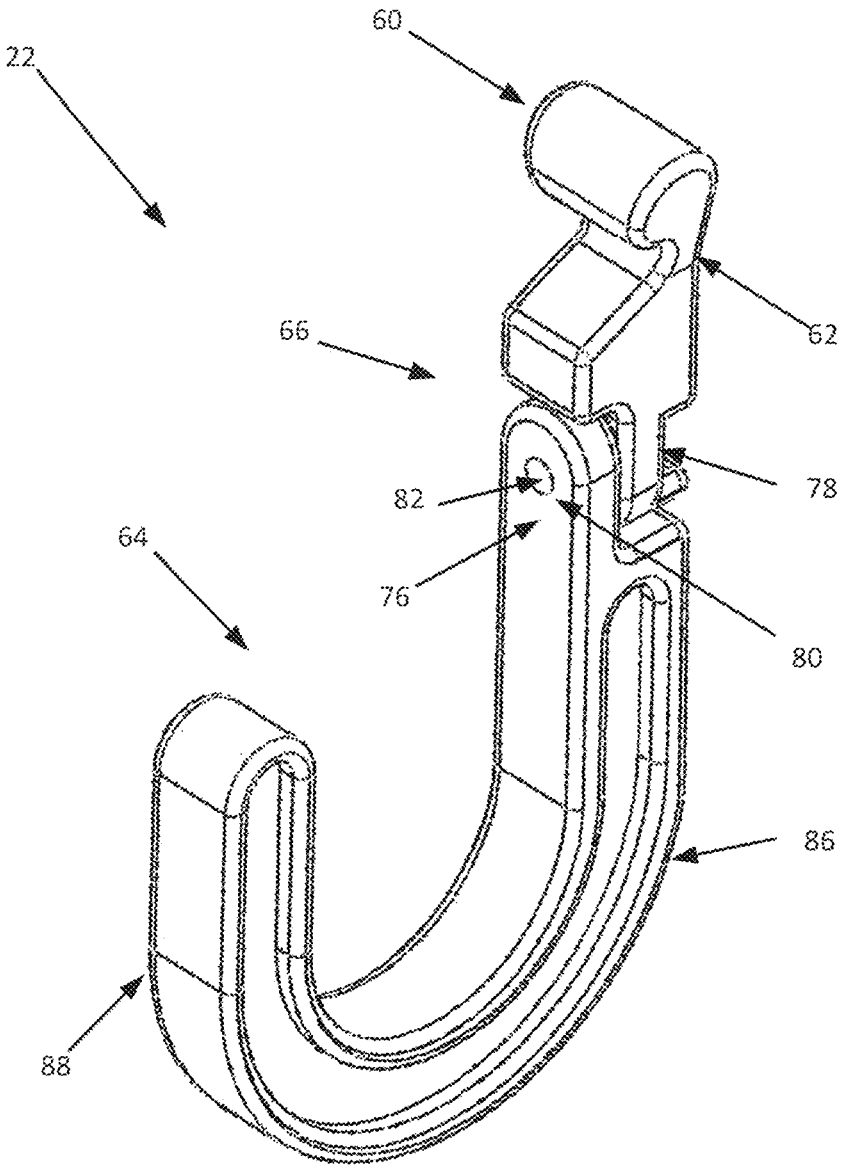
FIG. 27 shows an upper front left perspective view of a hook type hanging member for an object hanging system, in accordance with one or more arrangements; the view showing the hanging member having an interconnect providing a pivoting connection between a head and a body of the hanging member.
Figure 28:
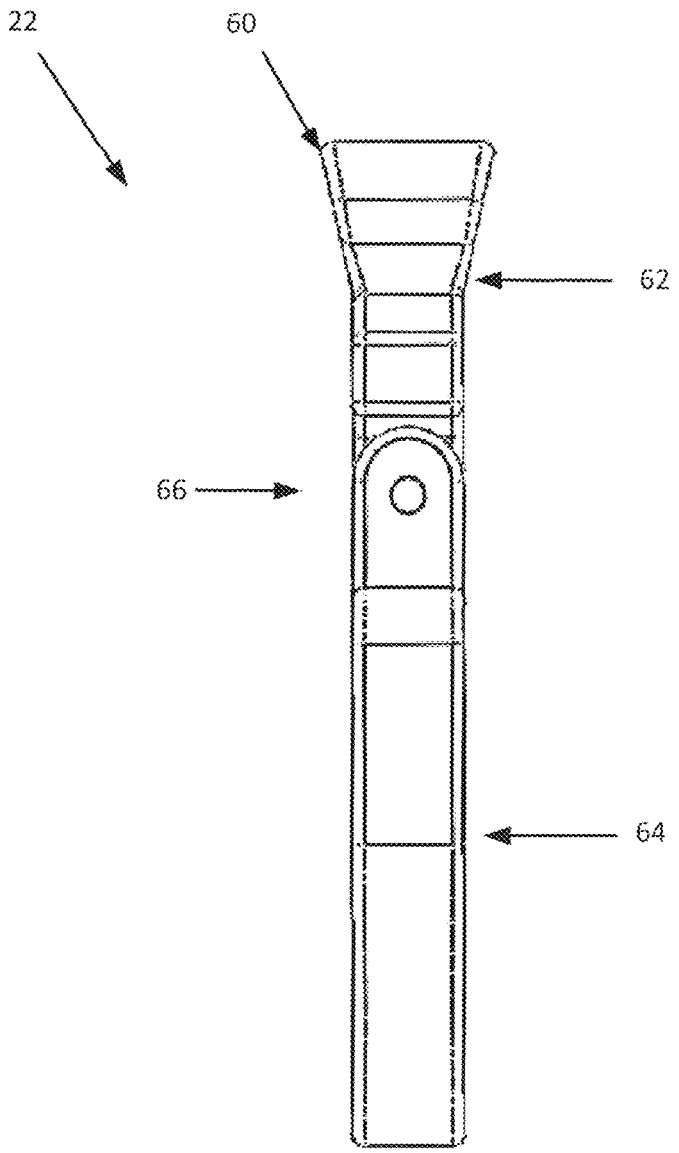
FIG. 28 shows a front view of a hook type hanging member for an object hanging system, in accordance with one or more arrangements; the view showing the hanging member having an interconnect providing a pivoting connection between a head and a body of the hanging member.
Figure 29:
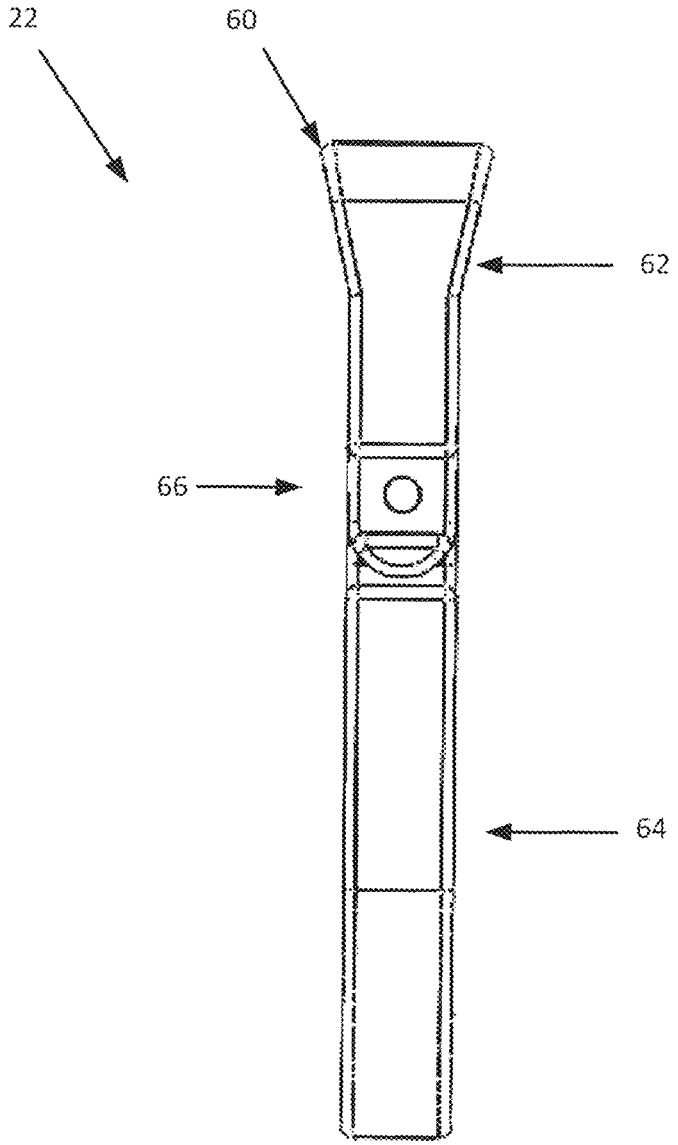
FIG. 29 shows a rear view of a hook type hanging member for an object hanging system, in accordance with one or more arrangements; the view showing the hanging member having an interconnect providing a pivoting connection between a head and a body of the hanging member.
Figure 30:
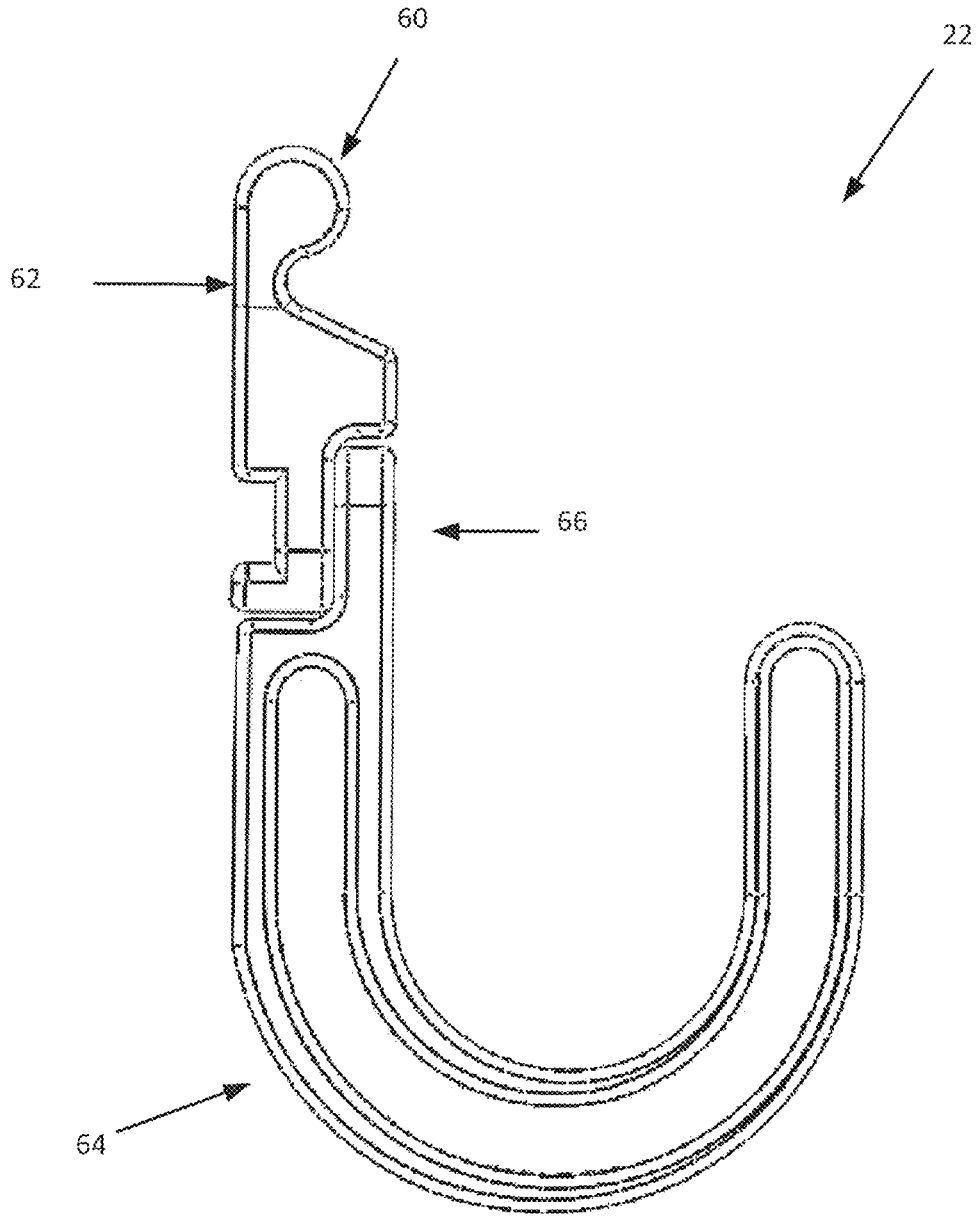
FIG. 30 shows a right side view of a hook type hanging member for an object hanging system, in accordance with one or more arrangements; the view showing the hanging member having an interconnect providing a pivoting connection between a head and a body of the hanging member.
Figure 31:
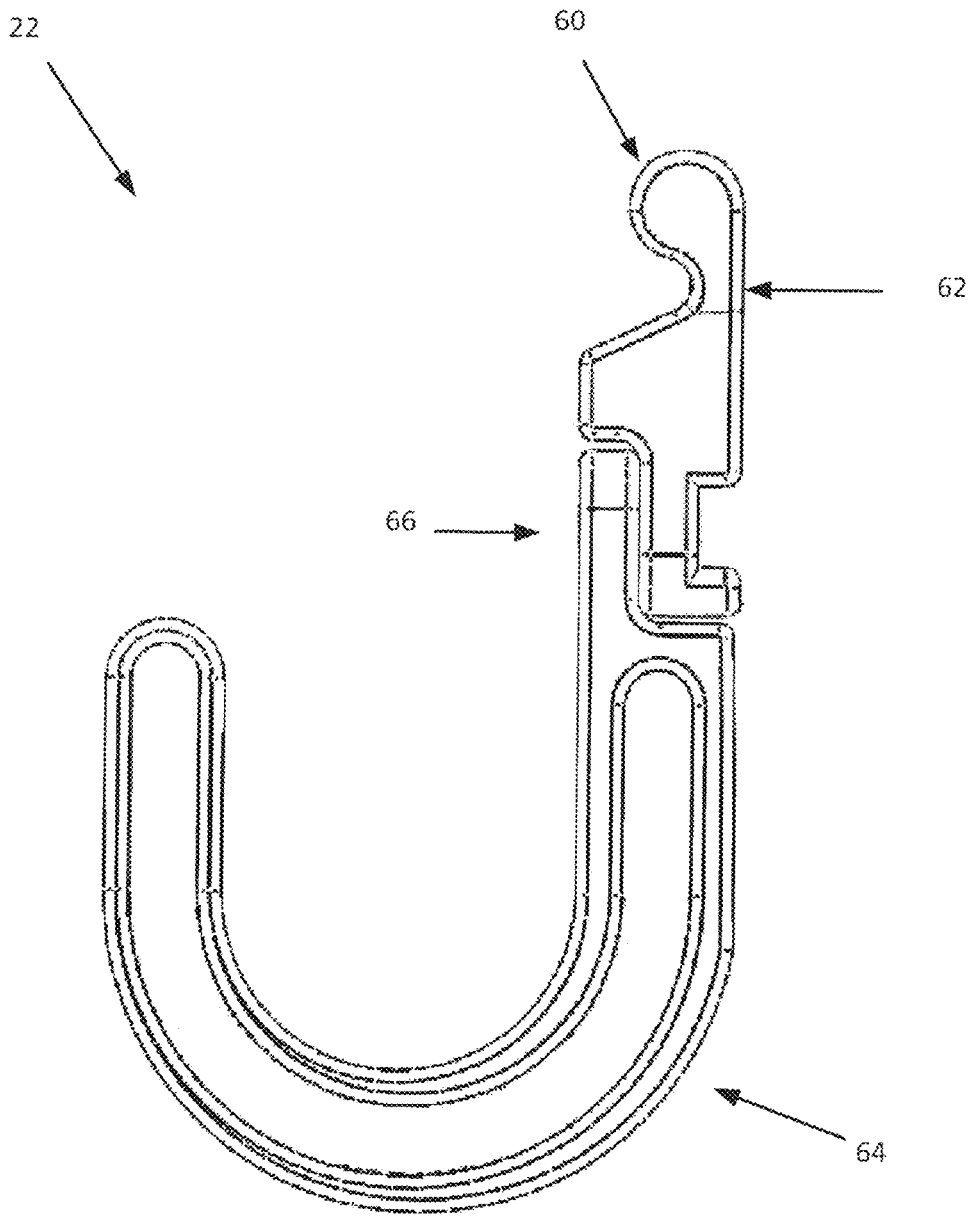
FIG. 31 shows a left side view of a hook type hanging member for an object hanging system, in accordance with one or more arrangements; the view showing the hanging member having an interconnect providing a pivoting connection between a head and a body of the hanging member.
Figure 32:
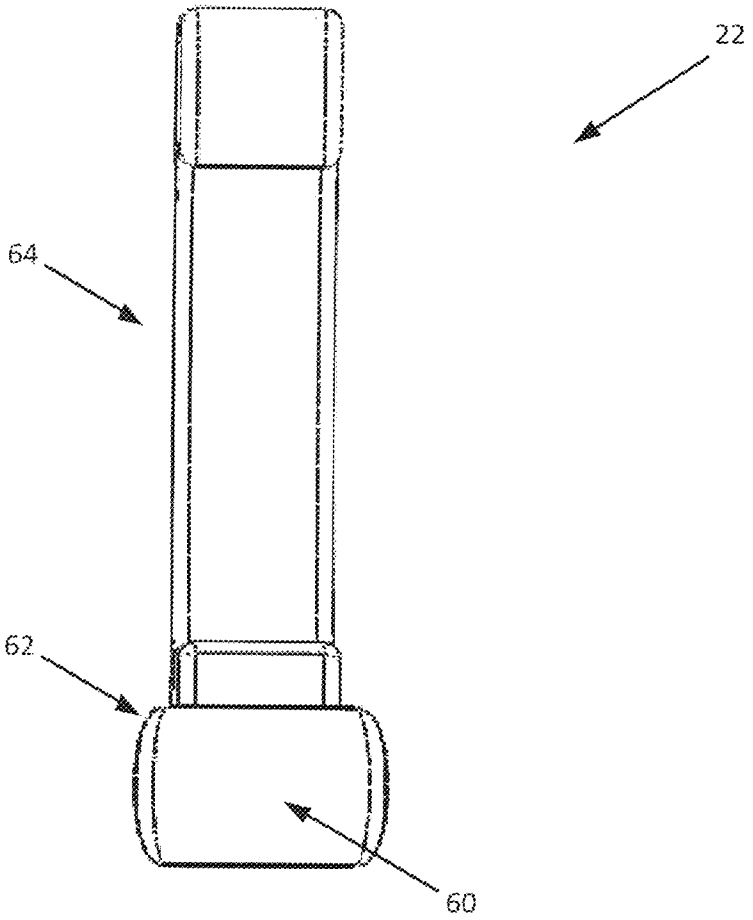
FIG. 32 shows a top view of a hook type hanging member for an object hanging system, in accordance with one or more arrangements; the view showing the hanging member having an interconnect providing a pivoting connection between a head and a body of the hanging member.
Figure 33:
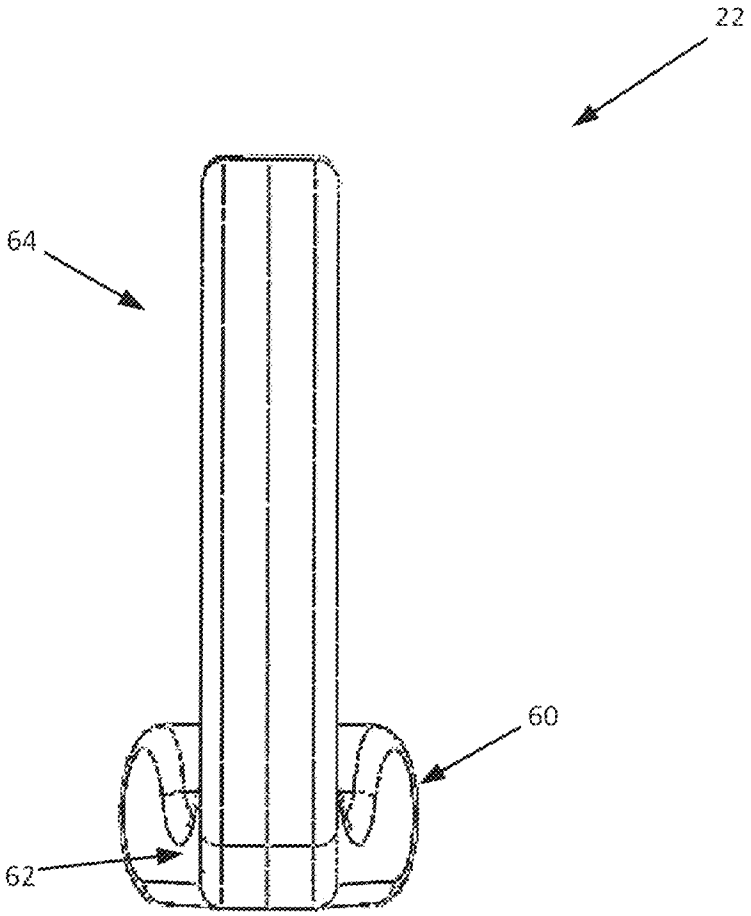
FIG. 33 shows a bottom view of a hook type hanging member for an object hanging system, in accordance with one or more arrangements; the view showing the hanging member having an interconnect providing a pivoting connection between a head and a body of the hanging member.
Figure 34:
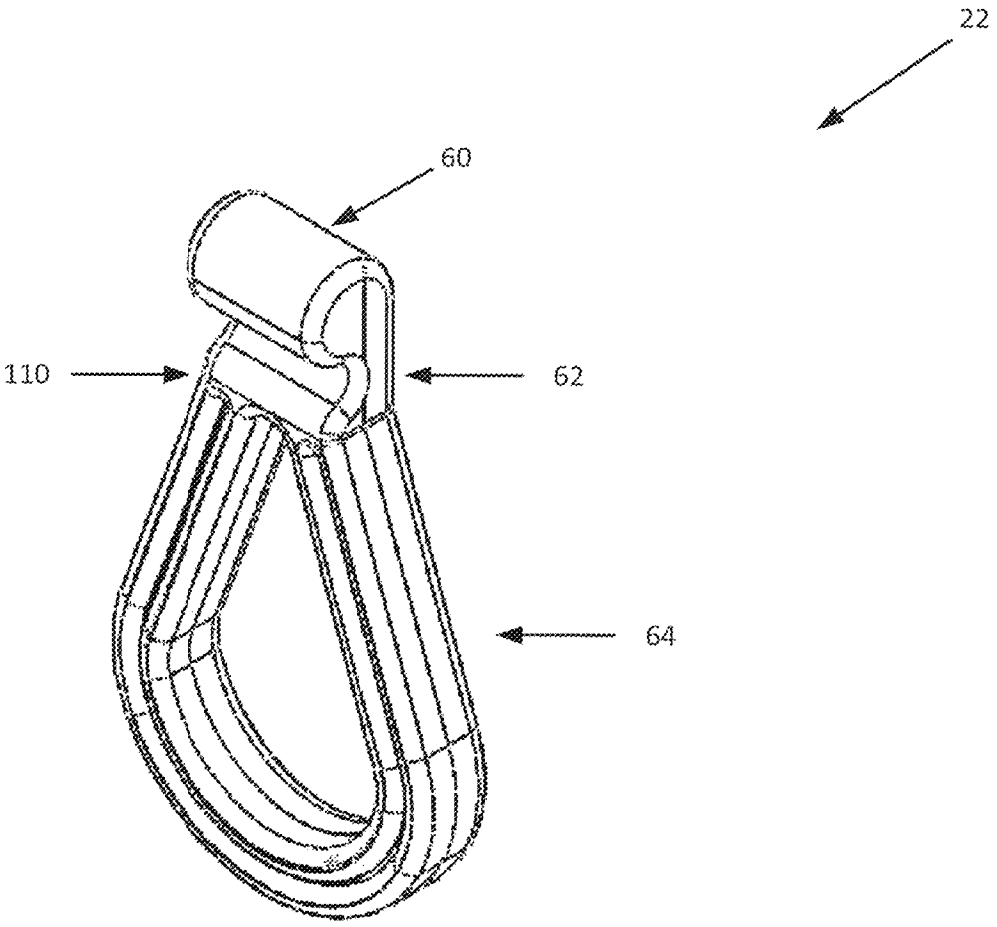
FIG. 34 shows an upper front left perspective view of a loop strap type hanging member for an object hanging system, in accordance with one or more arrangements.
Figure 35:
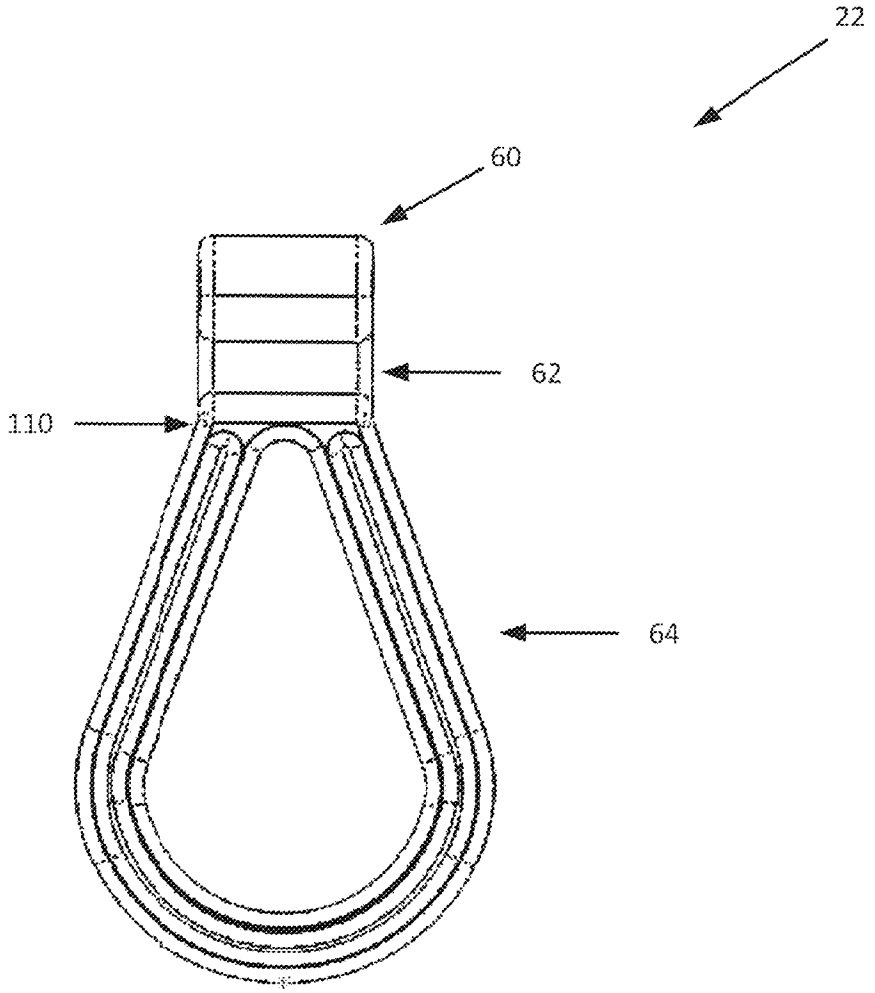
FIG. 35 shows a front view of a loop strap type hanging member for an object hanging system, in accordance with one or more arrangements.
Figure 36:
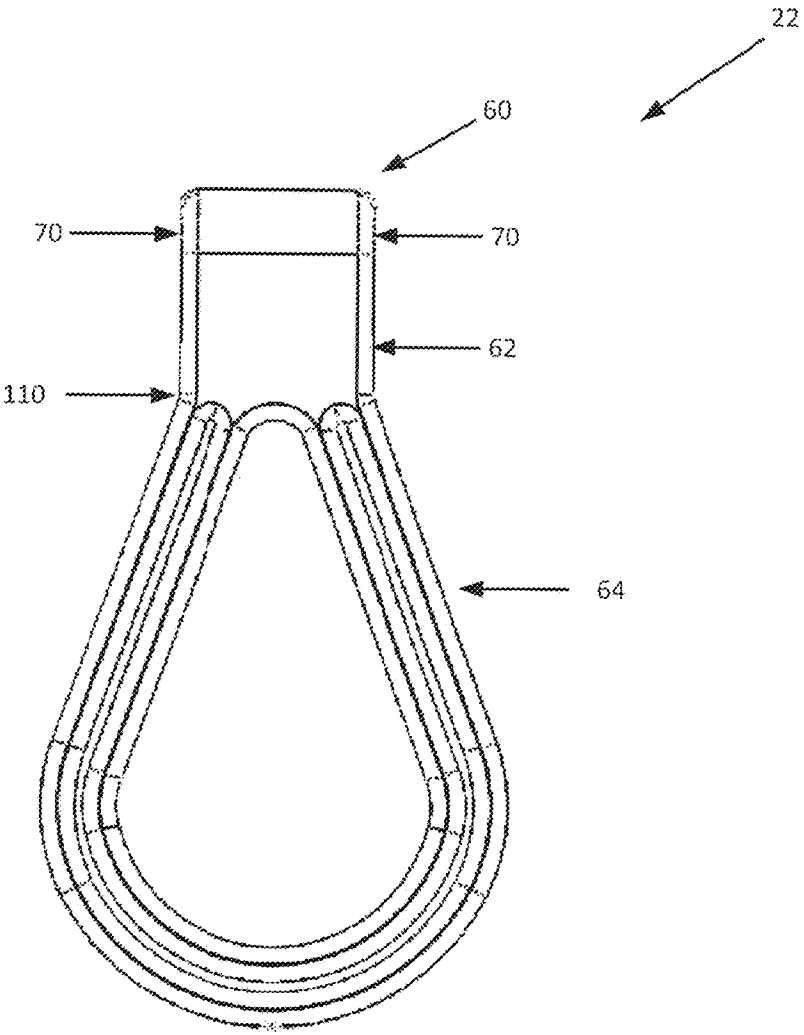
FIG. 36 shows a rear view of a loop strap type hanging member for an object hanging system, in accordance with one or more arrangements.
Figure 37:
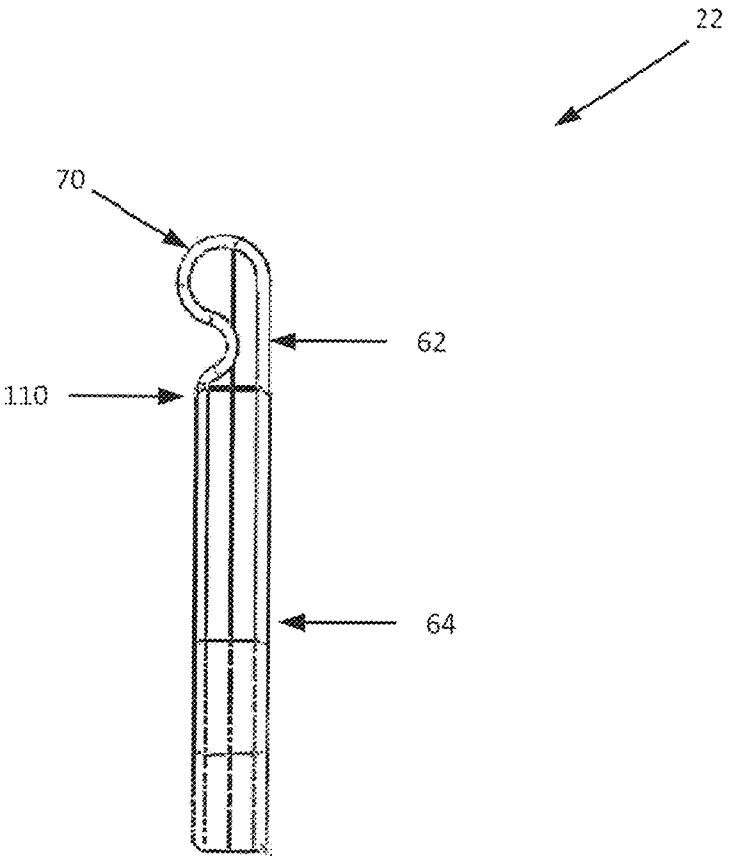
FIG. 37 shows a right side view of a loop strap type hanging member for an object hanging system, in accordance with one or more arrangements.
Figure 38:
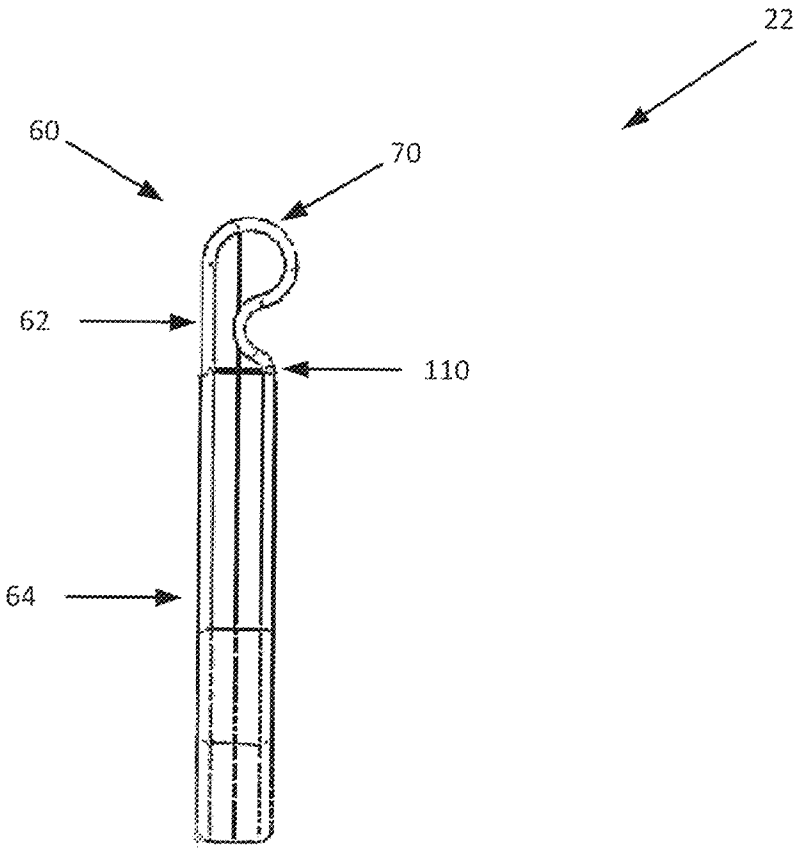
FIG. 38 shows a left side view of a loop strap type hanging member for an object hanging system, in accordance with one or more arrangements.
Figure 39:
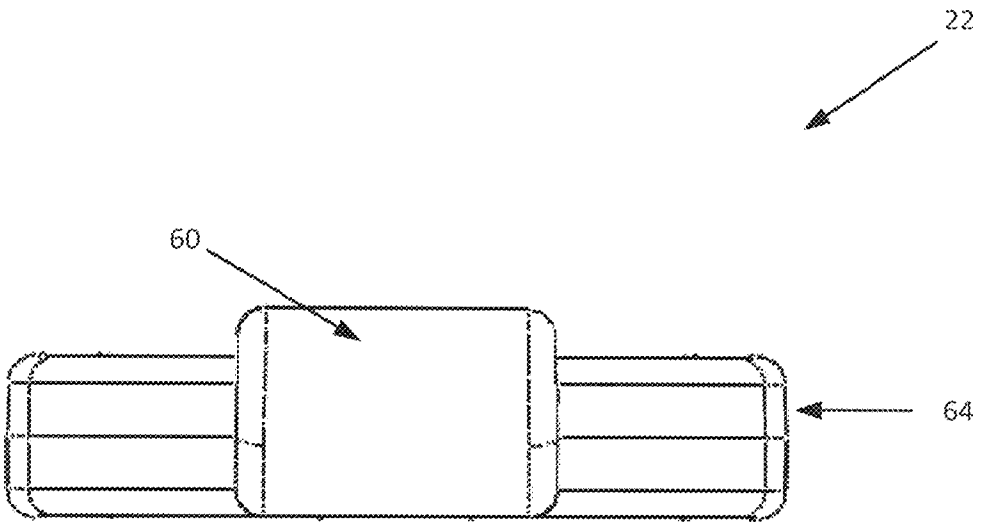
FIG. 39 shows a top view of a loop strap type hanging member for an object hanging system, in accordance with one or more arrangements.
Figure 40:
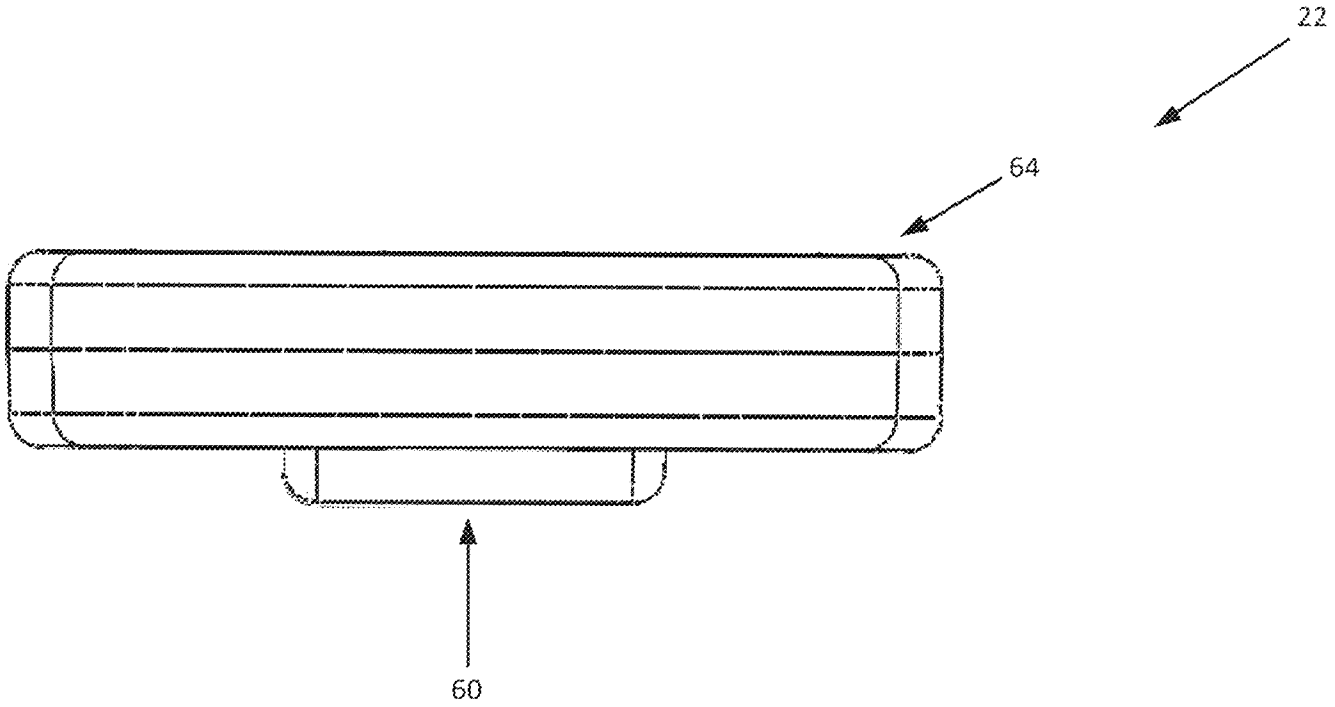
FIG. 40 shows a bottom view of a loop strap type hanging member for an object hanging system, in accordance with one or more arrangements.
Figure 41:
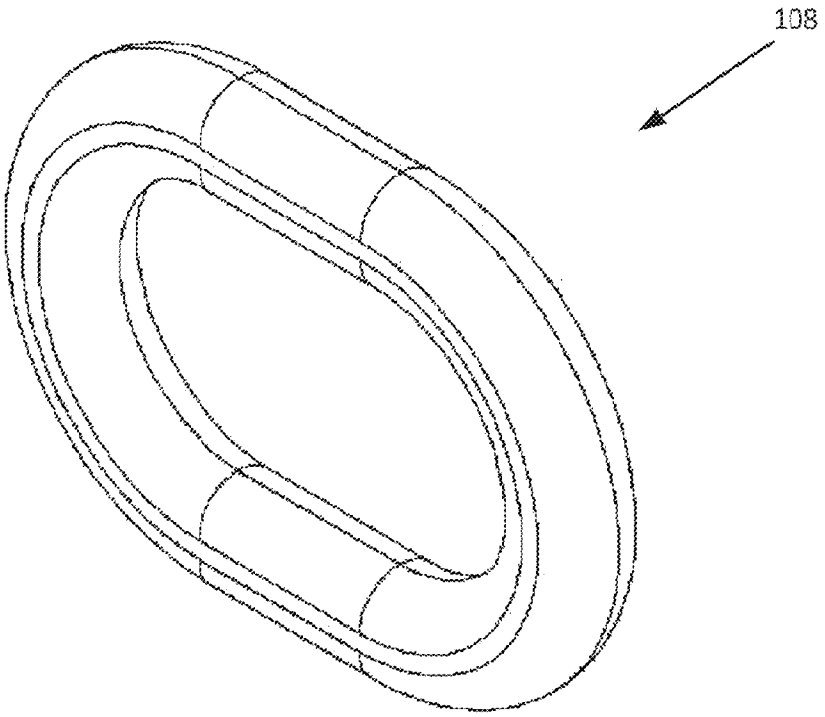
FIG. 41 shows a lower front left perspective view of a ring fitting for a loop strap type hanging member for an object hanging system, in accordance with one or more arrangements.
Figure 42:
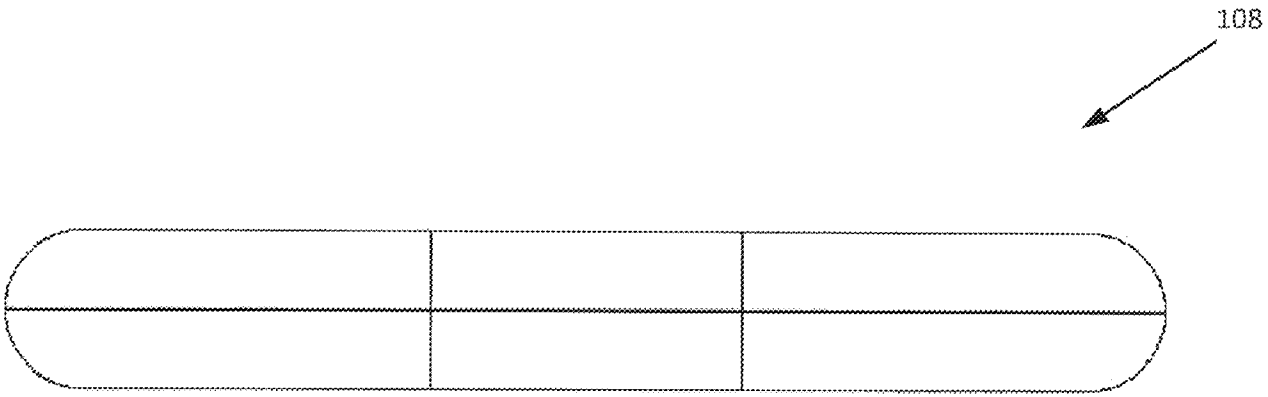
FIG. 42 shows a front view of a ring fitting for a loop strap type hanging member for an object hanging system, in accordance with one or more arrangements.
Figure 43:
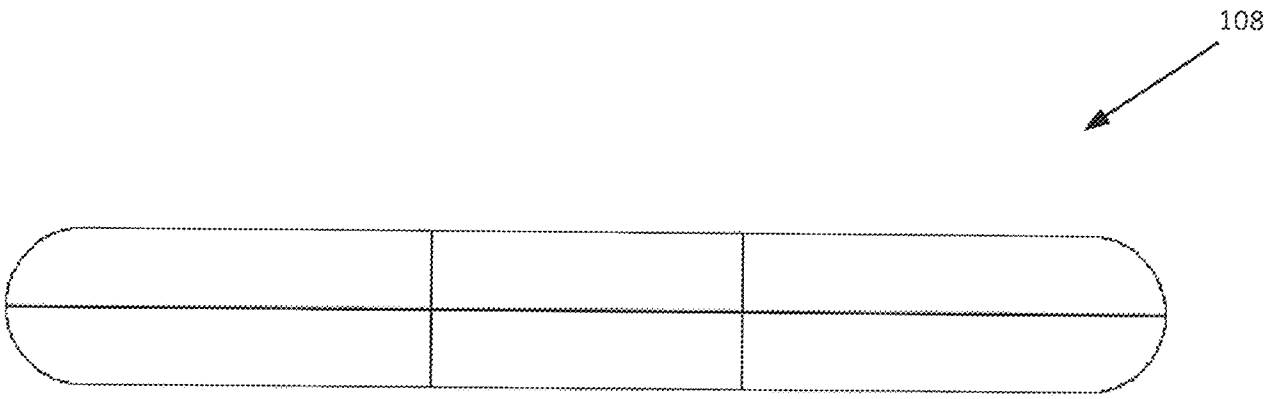
FIG. 43 shows a rear view of a ring fitting for a loop strap type hanging member for an object hanging system, in accordance with one or more arrangements.
Figure 44:
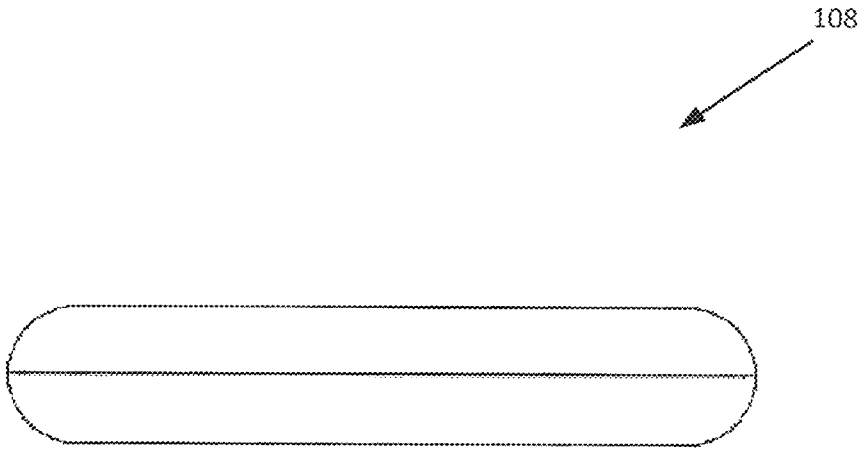
FIG. 44 shows a right side view of a ring fitting for a loop strap type hanging member for an object hanging system, in accordance with one or more arrangements.
Figure 45:
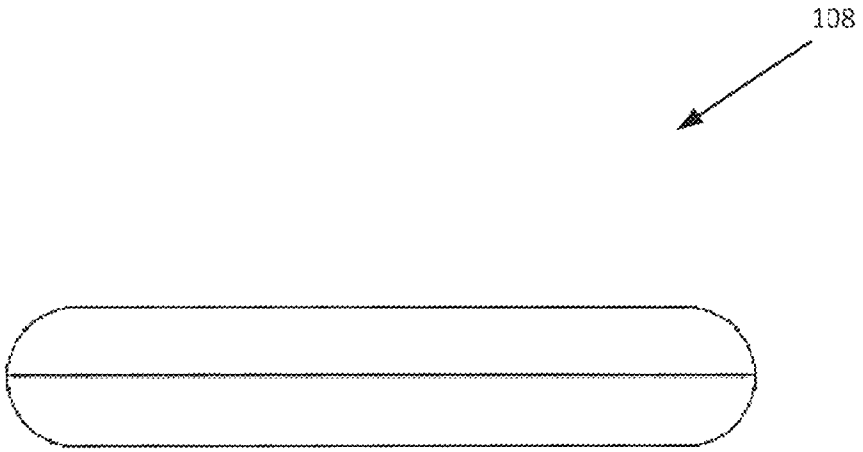
FIG. 45 shows a left side view of a ring fitting for a loop strap type hanging member for an object hanging system, in accordance with one or more arrangements.
Figure 46:
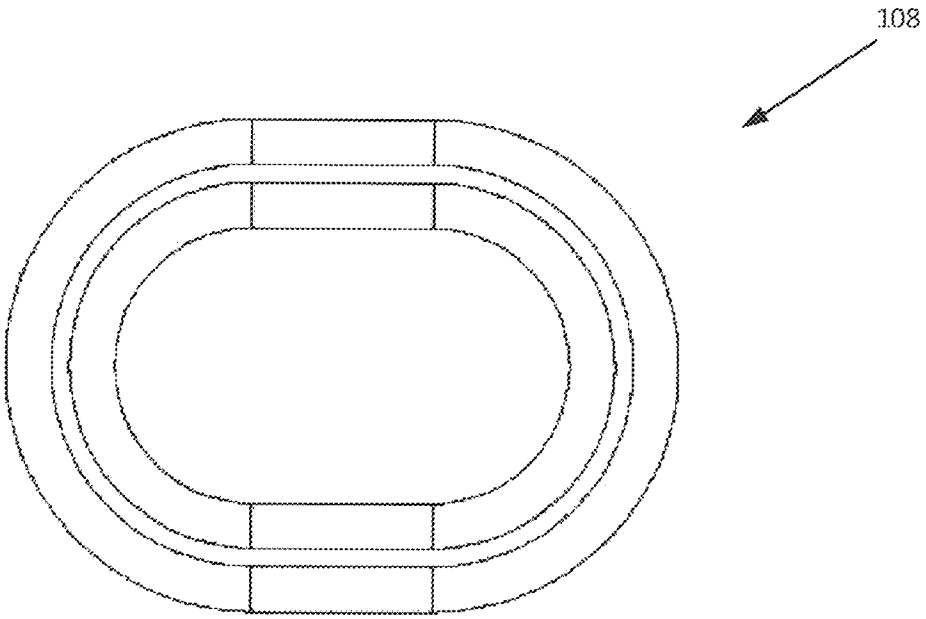
FIG. 46 shows a top view of a ring fitting for a loop strap type hanging member for an object hanging system, in accordance with one or more arrangements.
Figure 47:
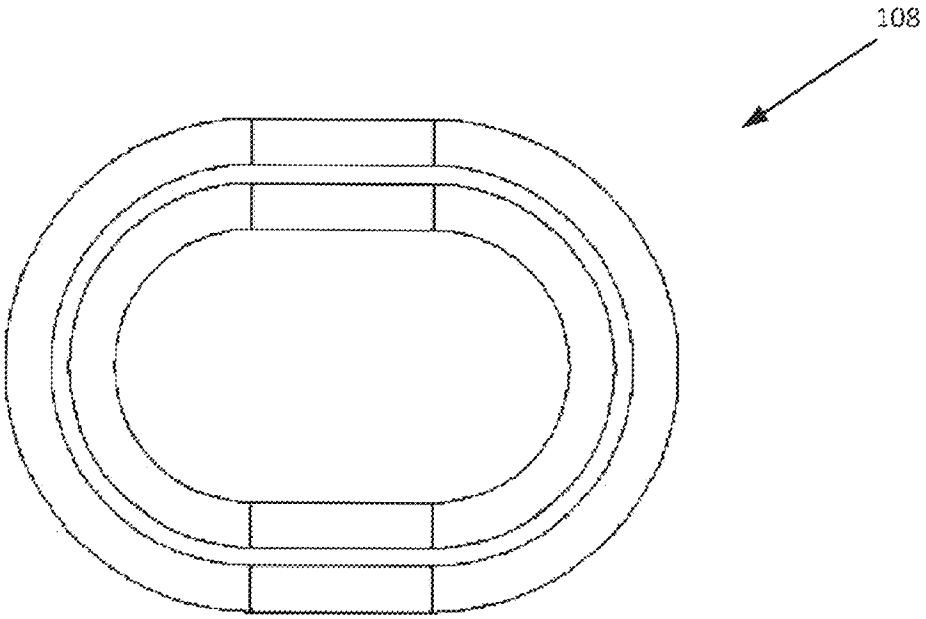
FIG. 47 shows a bottom view of a ring fitting for a loop strap type hanging member for an object hanging system, in accordance with one or more arrangements.
Figure 48:
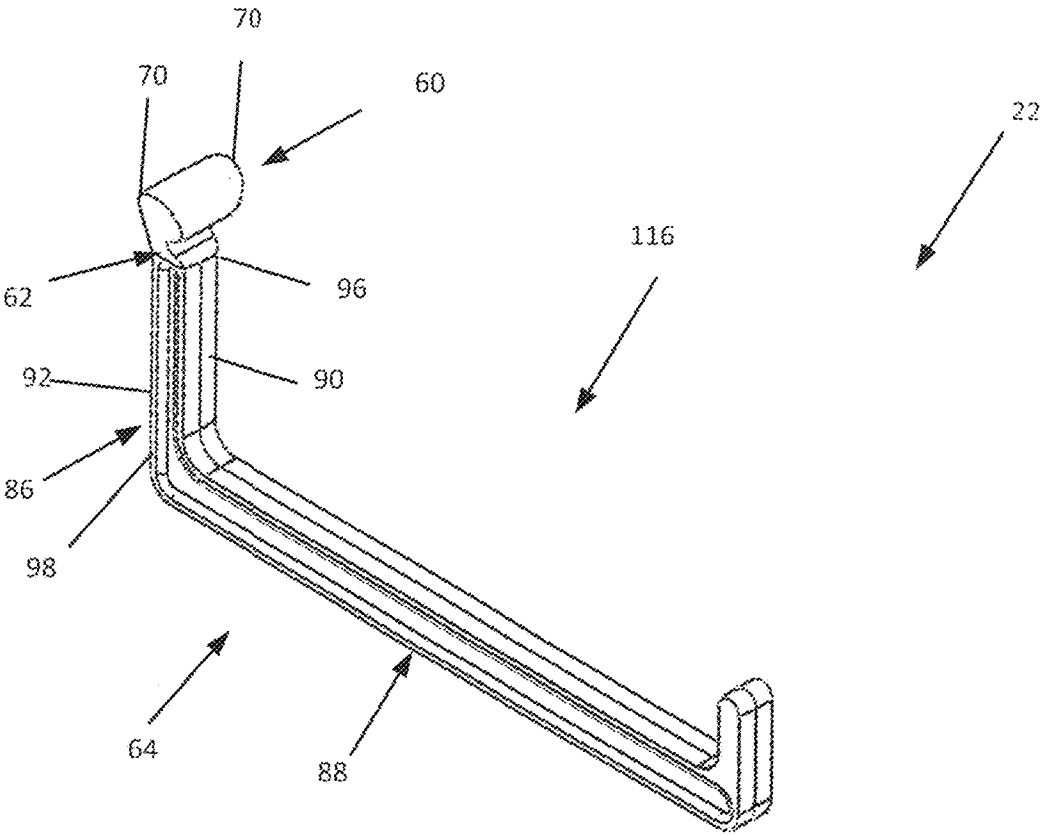
FIG. 48 shows an upper front right perspective view of a mop hook type hanging member for an object hanging system, in accordance with one or more arrangements.
Figure 49:
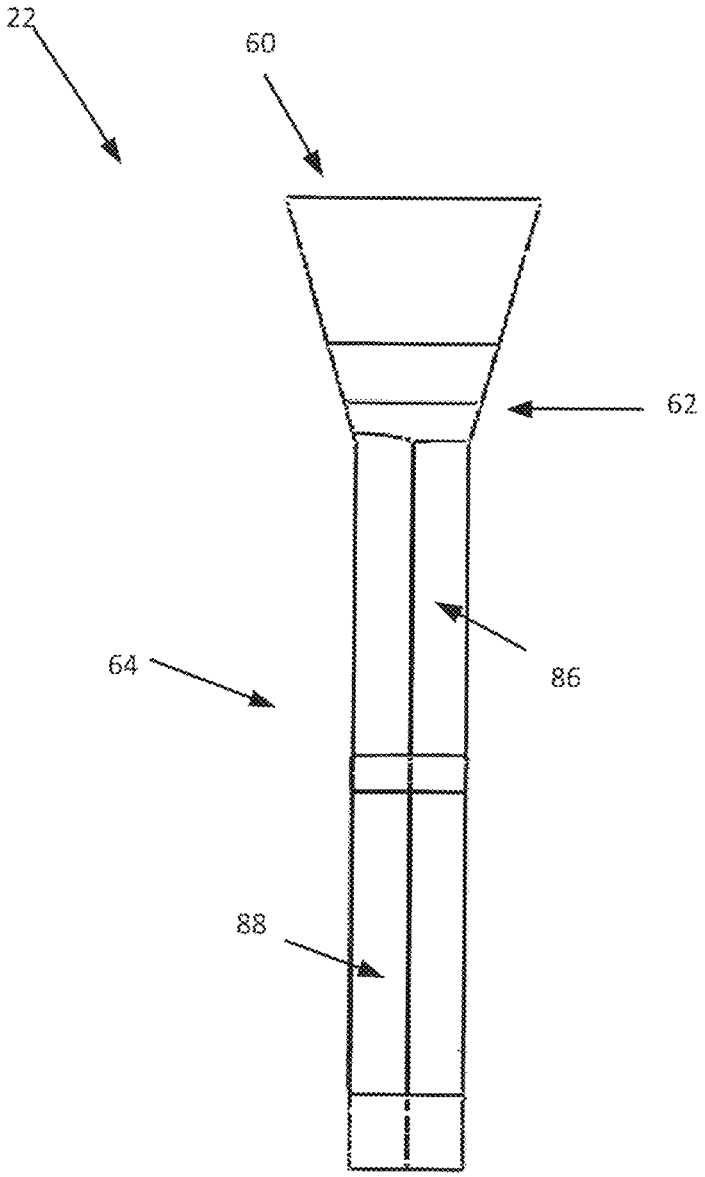
FIG. 49 shows a front view of a mop hook type hanging member for an object hanging system, in accordance with one or more arrangements.
Figure 50:
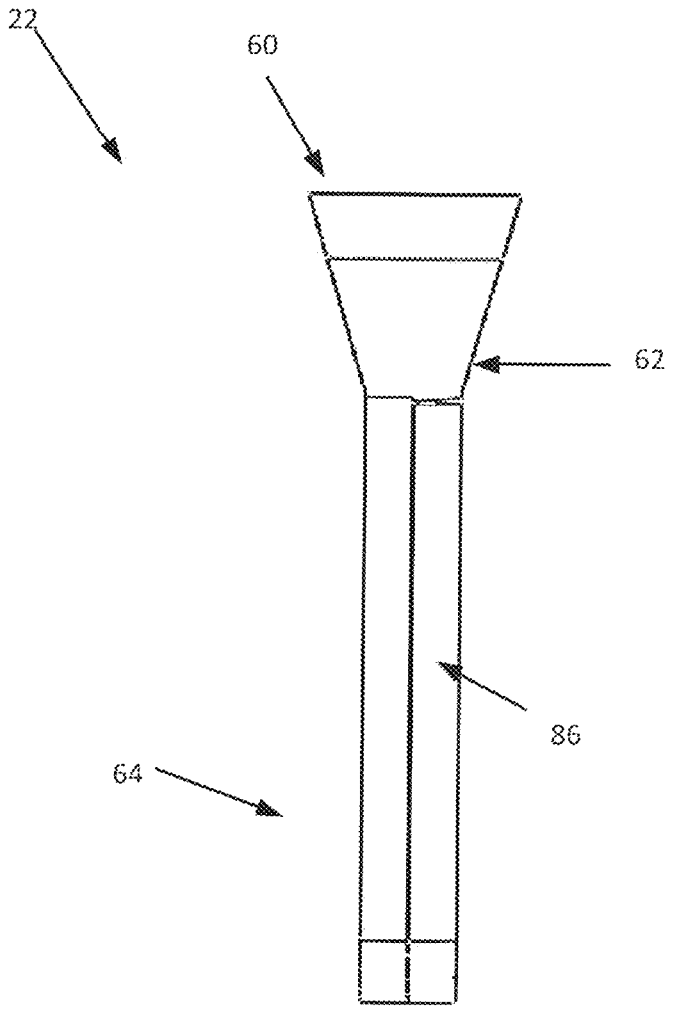
FIG. 50 shows a rear view of a mop hook hanging member for an object hanging system, in accordance with one or more arrangements.
Figure 51:
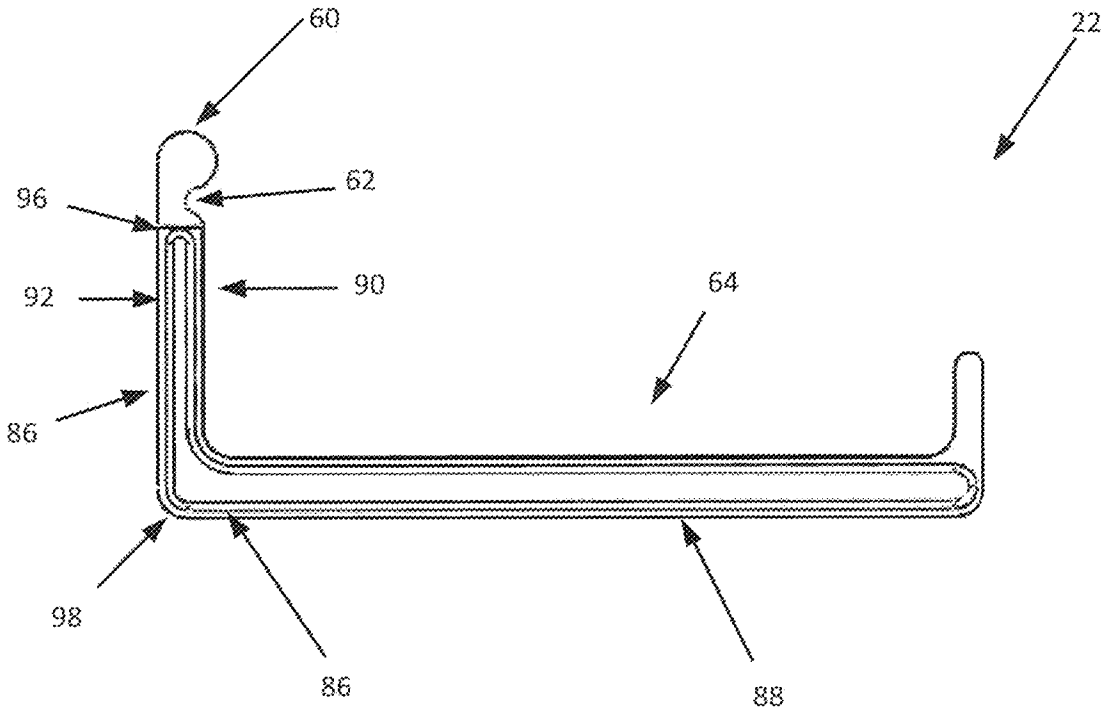
FIG. 51 shows a right side view of a mop hook type hanging member for an object hanging system, in accordance with one or more arrangements.
Figure 52:
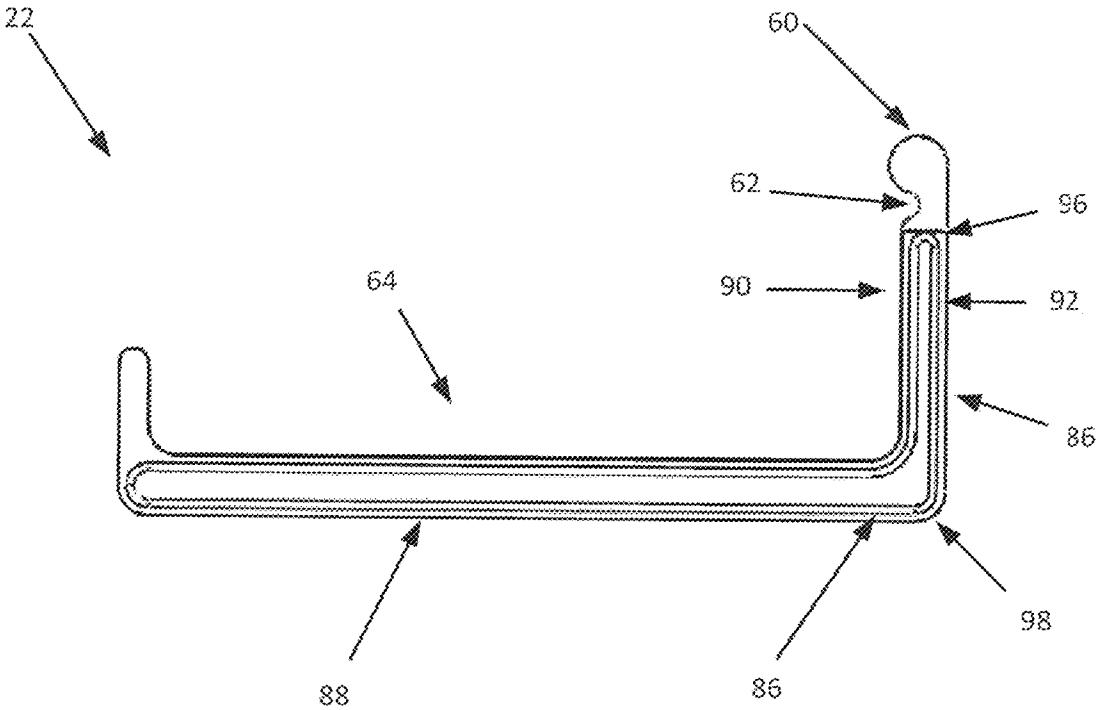
FIG. 52 shows a left side view of a mop hook type hanging member for an object hanging system, in accordance with one or more arrangements.
Figure 53:
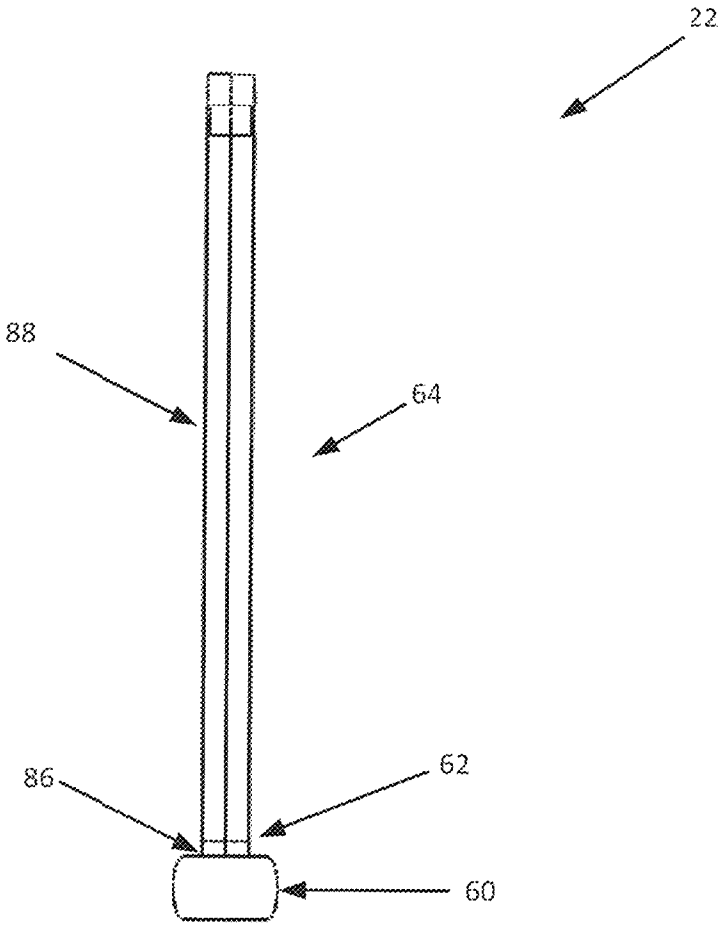
FIG. 53 shows a top view of a mop hook type hanging member for an object hanging system, in accordance with one or more arrangements.
Figure 54:
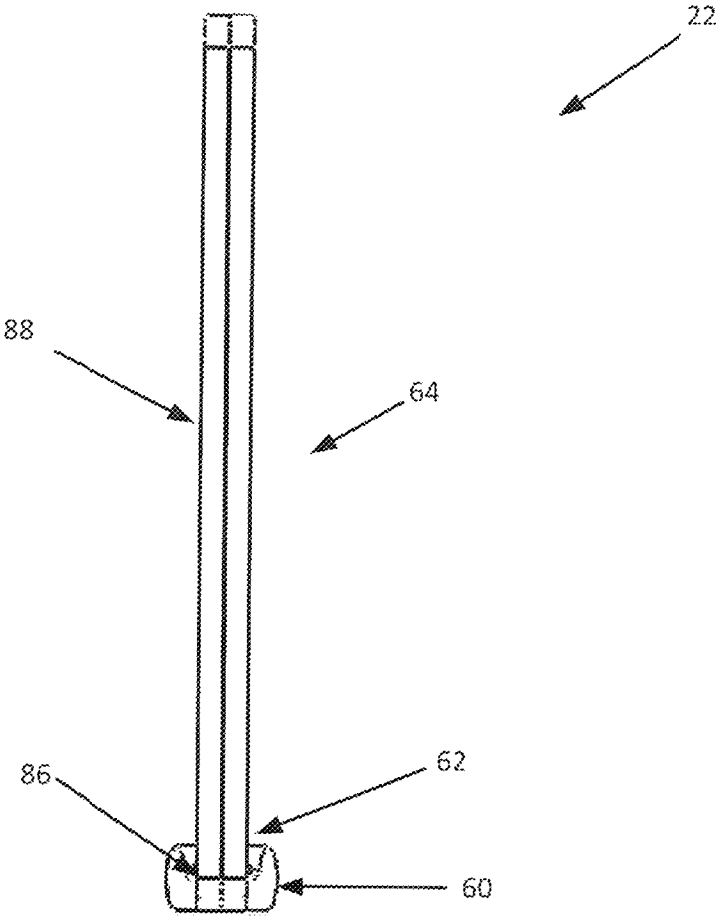
FIG. 54 shows a bottom view of a mop hook type hanging member for an object hanging system, in accordance with one or more arrangements.
Figure 55:
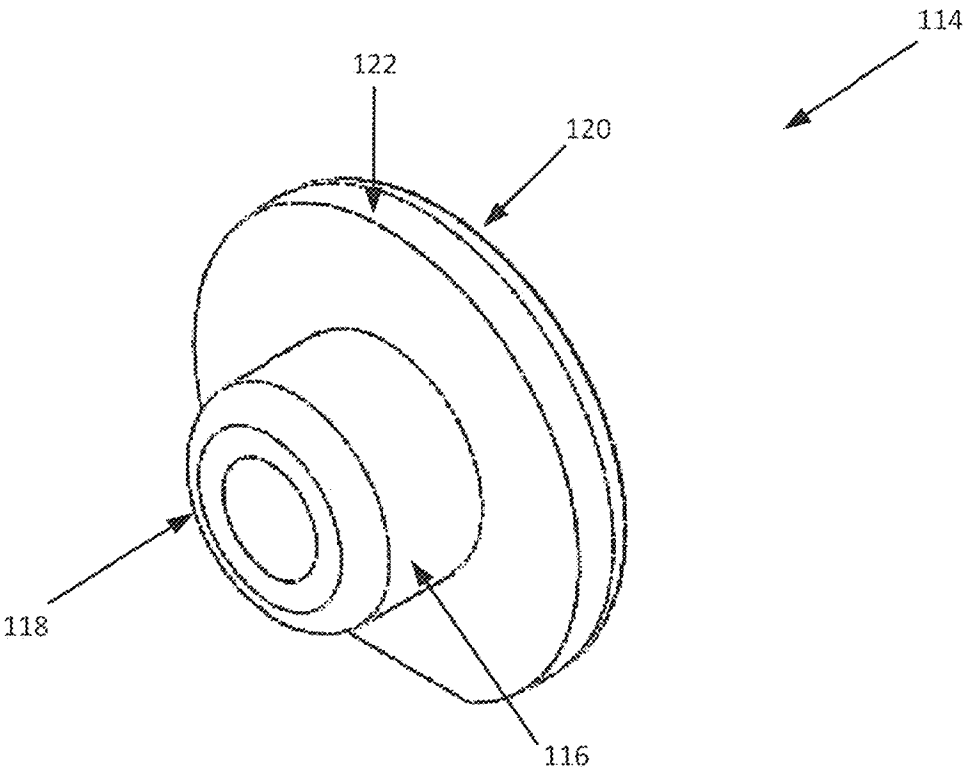
FIG. 55 shows a rotated lower front right left perspective view of an endcap for an object hanging system, in accordance with one or more arrangements.
Figure 56:
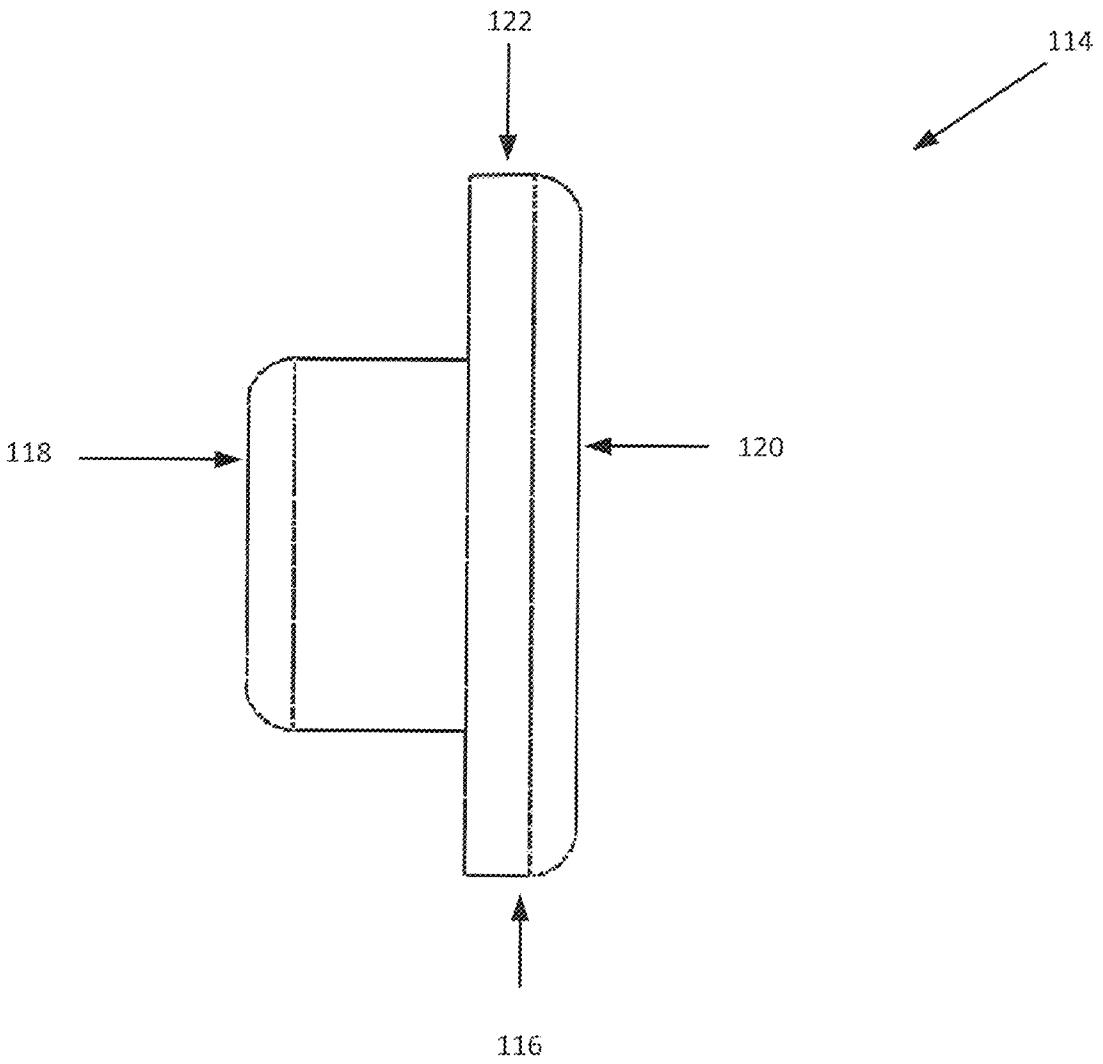
FIG. 56 shows a front view of an endcap for an object hanging system, in accordance with one or more arrangements.
Figure 57:
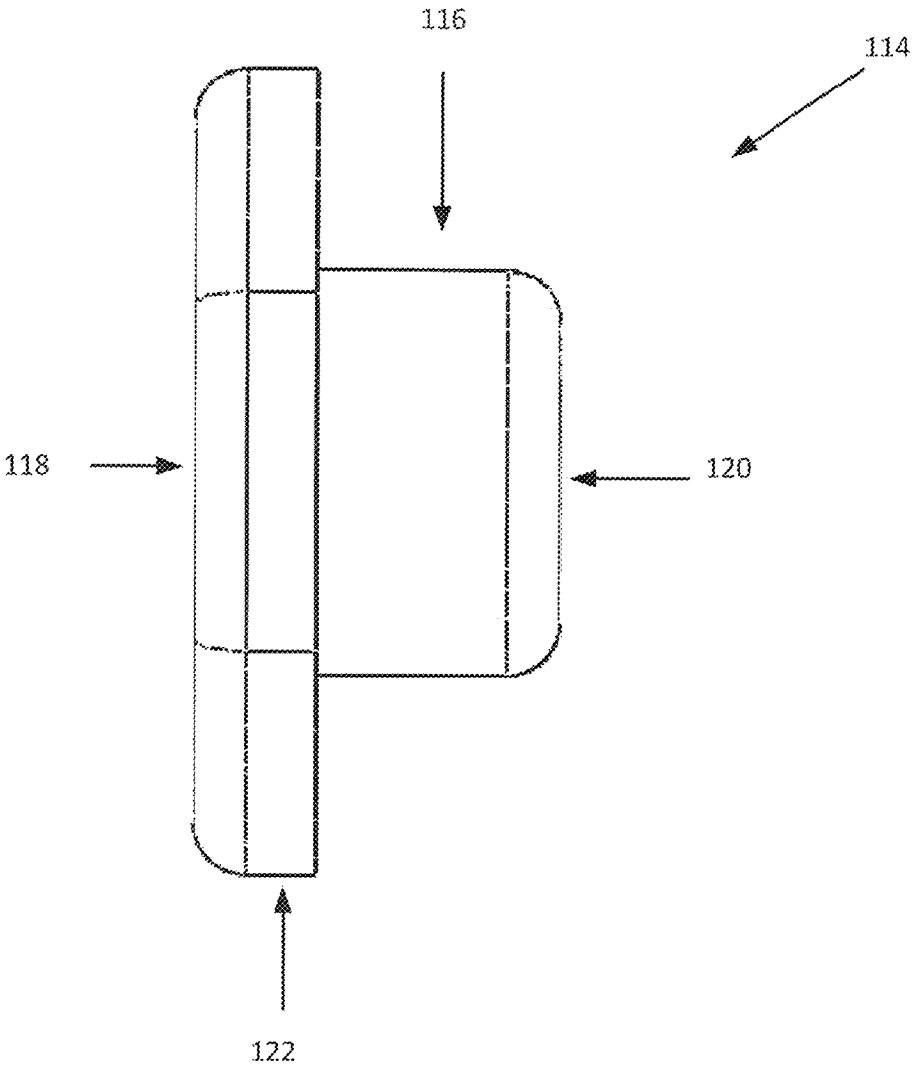
FIG. 57 shows a rear view of an endcap for an object hanging system, in accordance with one or more arrangements.
Figure 58:
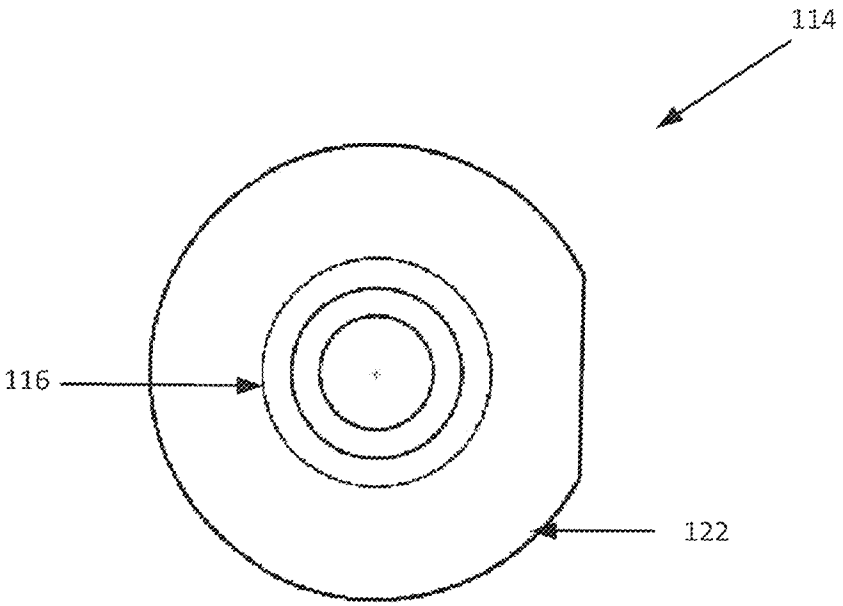
FIG. 58 shows a right side view of an endcap for an object hanging system, in accordance with one or more arrangements.
Figure 59:
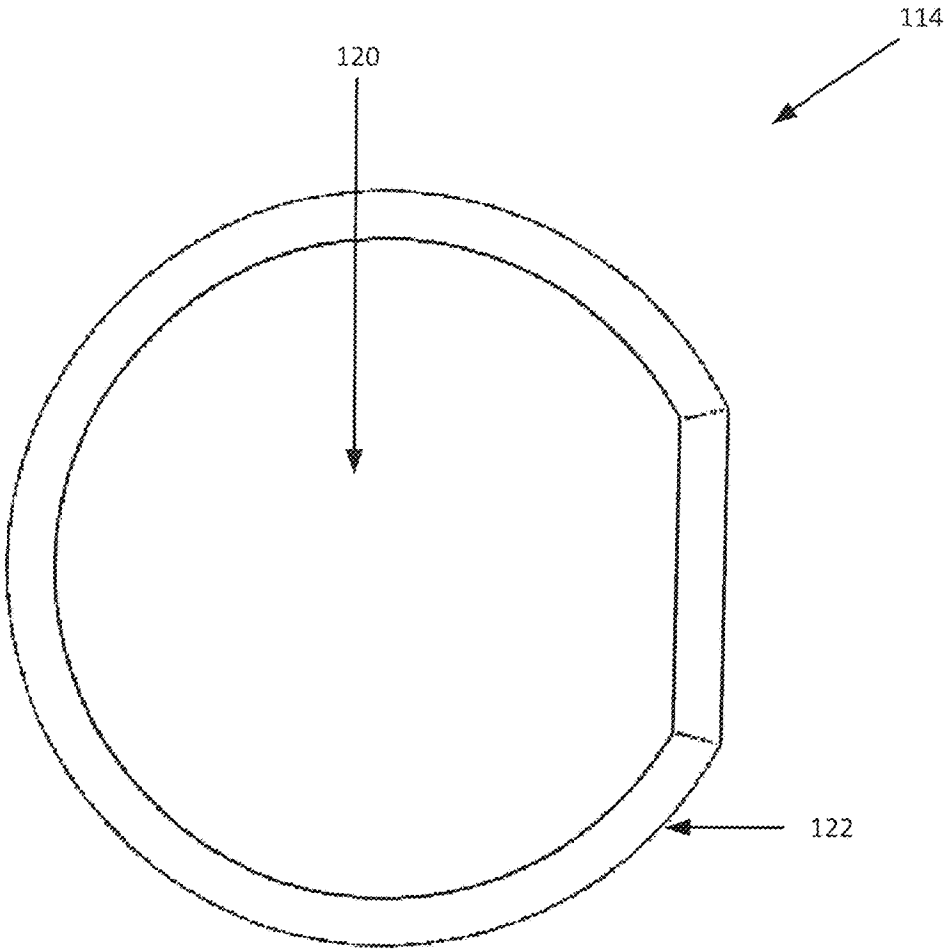
FIG. 59 shows a left side view of an endcap for an object hanging system, in accordance with one or more arrangements.
Figure 60:
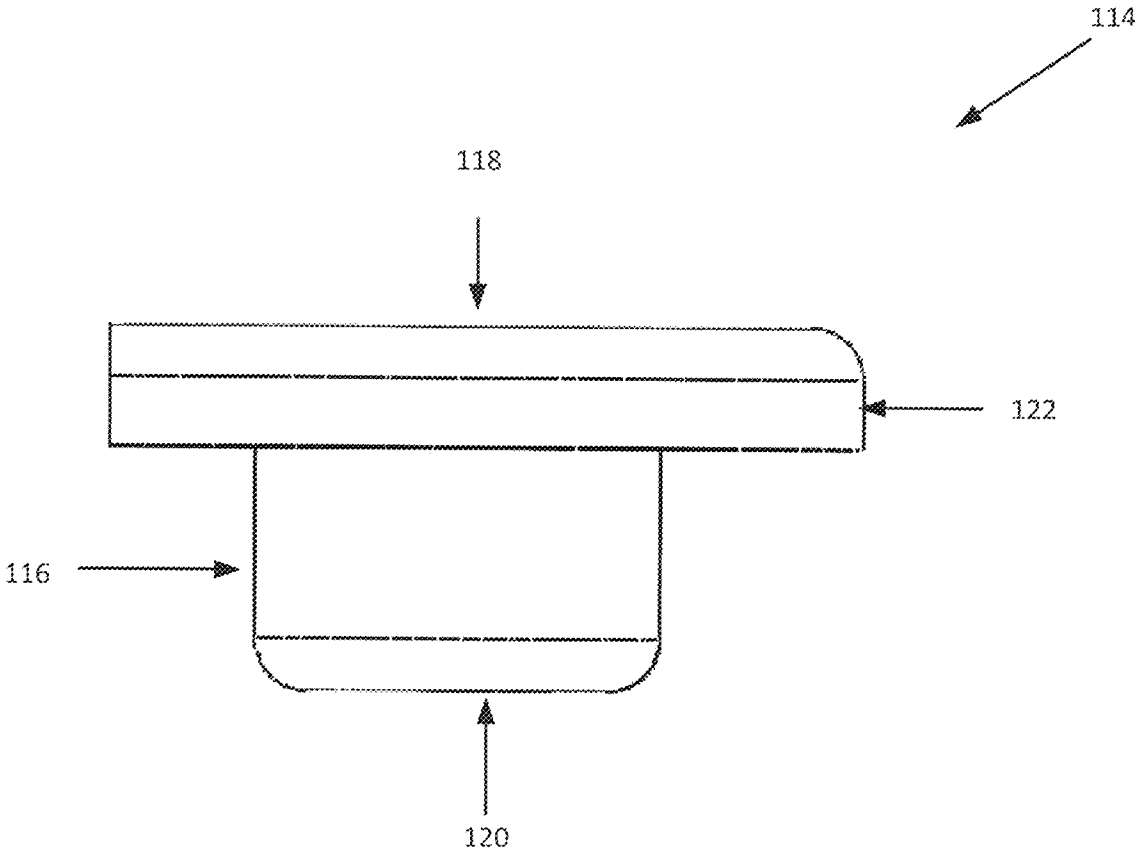
FIG. 60 shows a top view of an endcap for an object hanging system, in accordance with one or more arrangements.
Figure 61:
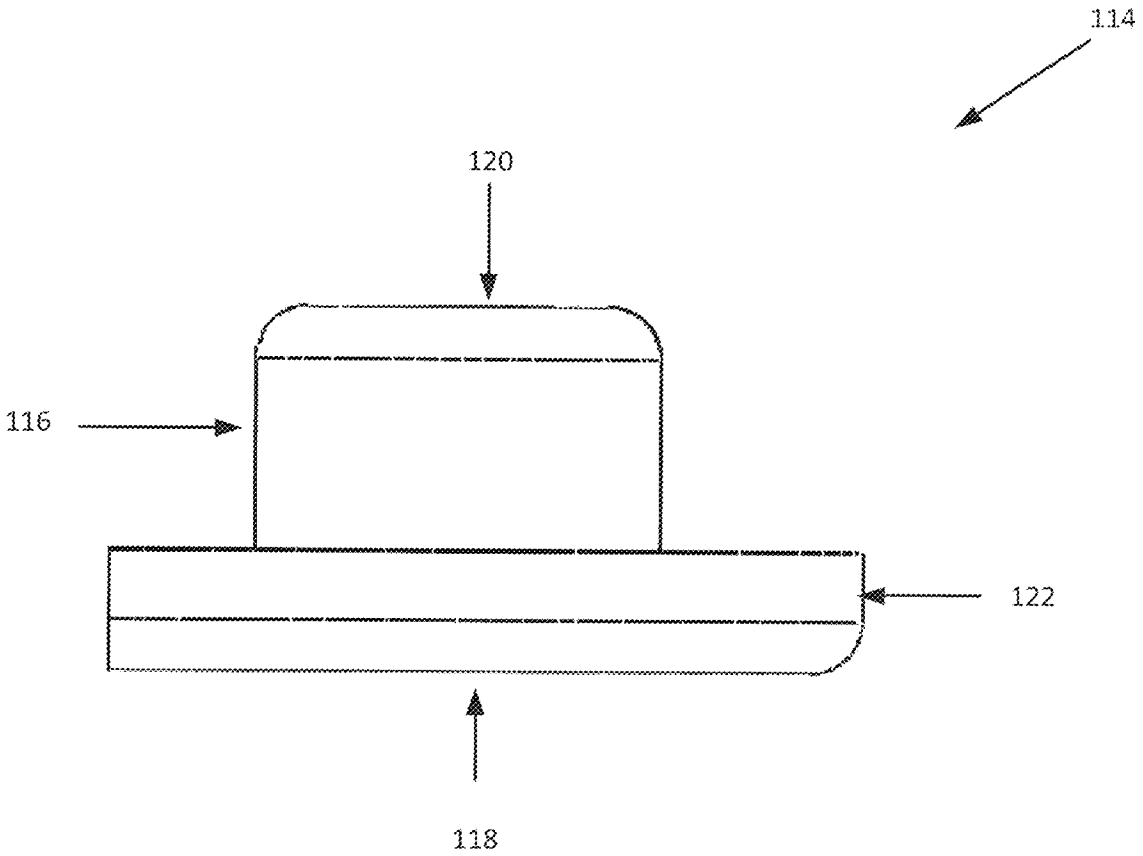
FIG. 61 shows a bottom view of an endcap for an object hanging system, in accordance with one or more arrangements.
Figure 62:
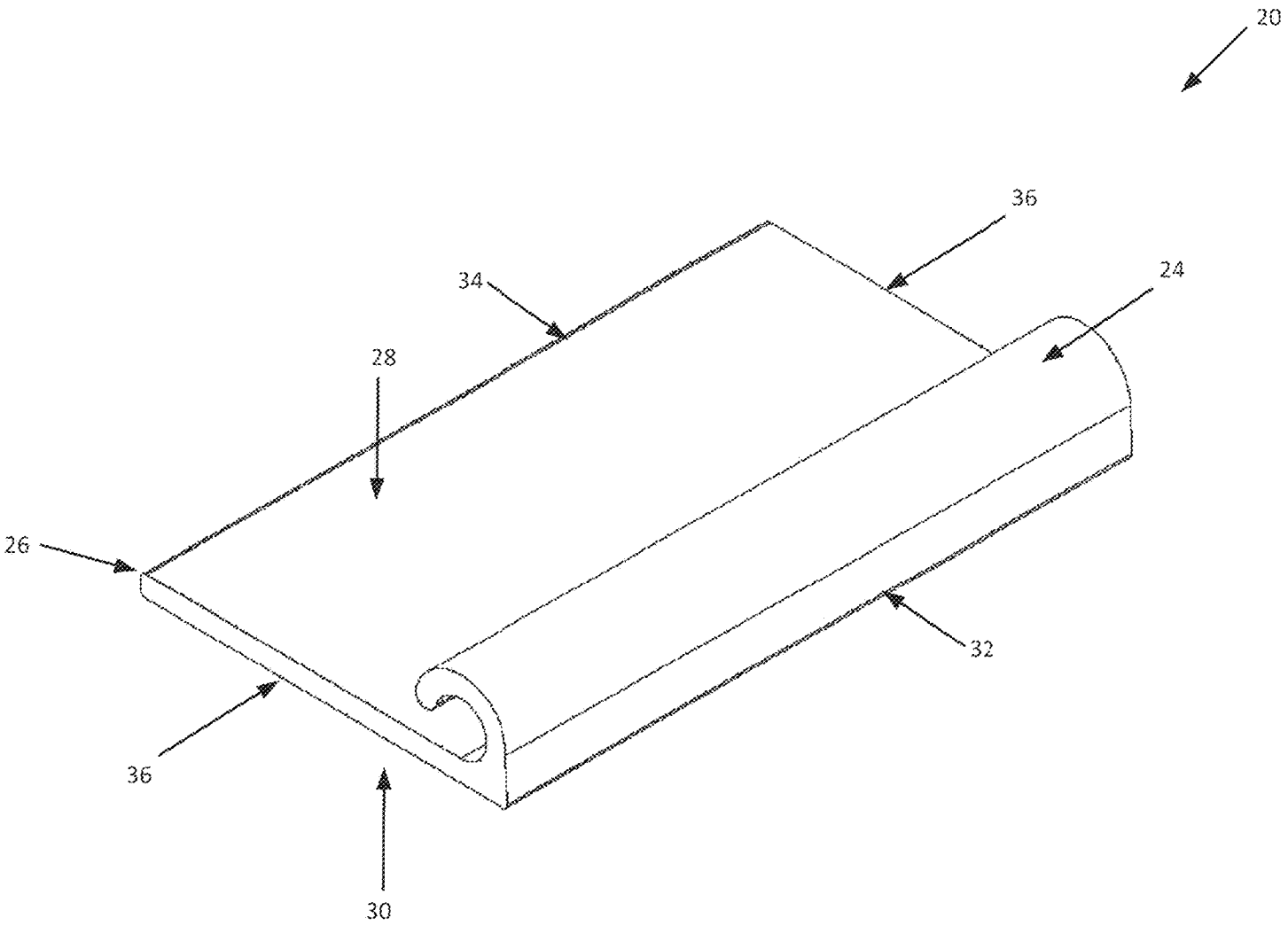
FIG. 62 shows a rotated upper front left perspective view of a mounting rail of an object hanging system, in accordance with one or more arrangements.
Figure 63:
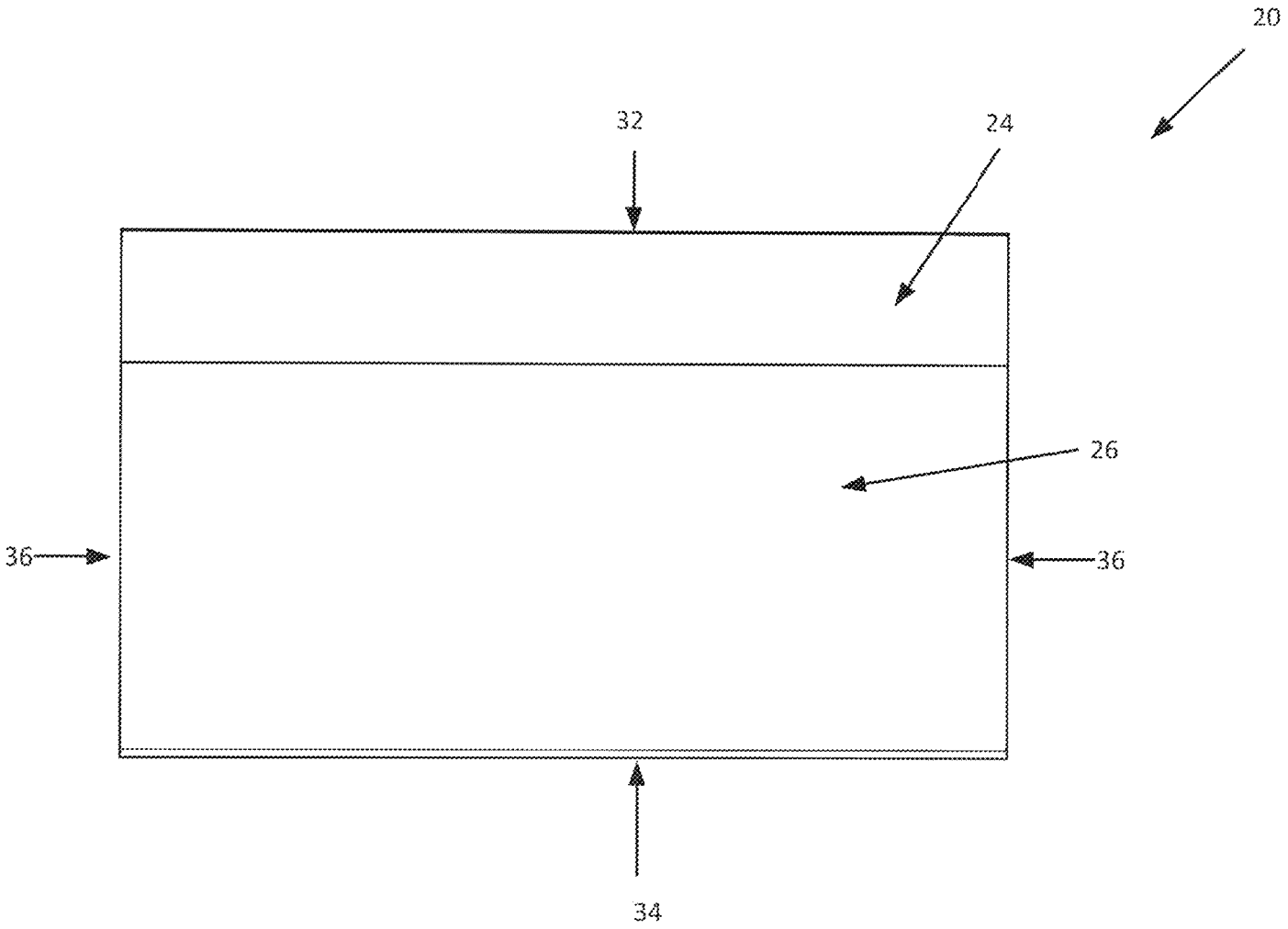
FIG. 63 shows a front view of a mounting rail of an object hanging system, in accordance with one or more arrangements.
Figure 64:
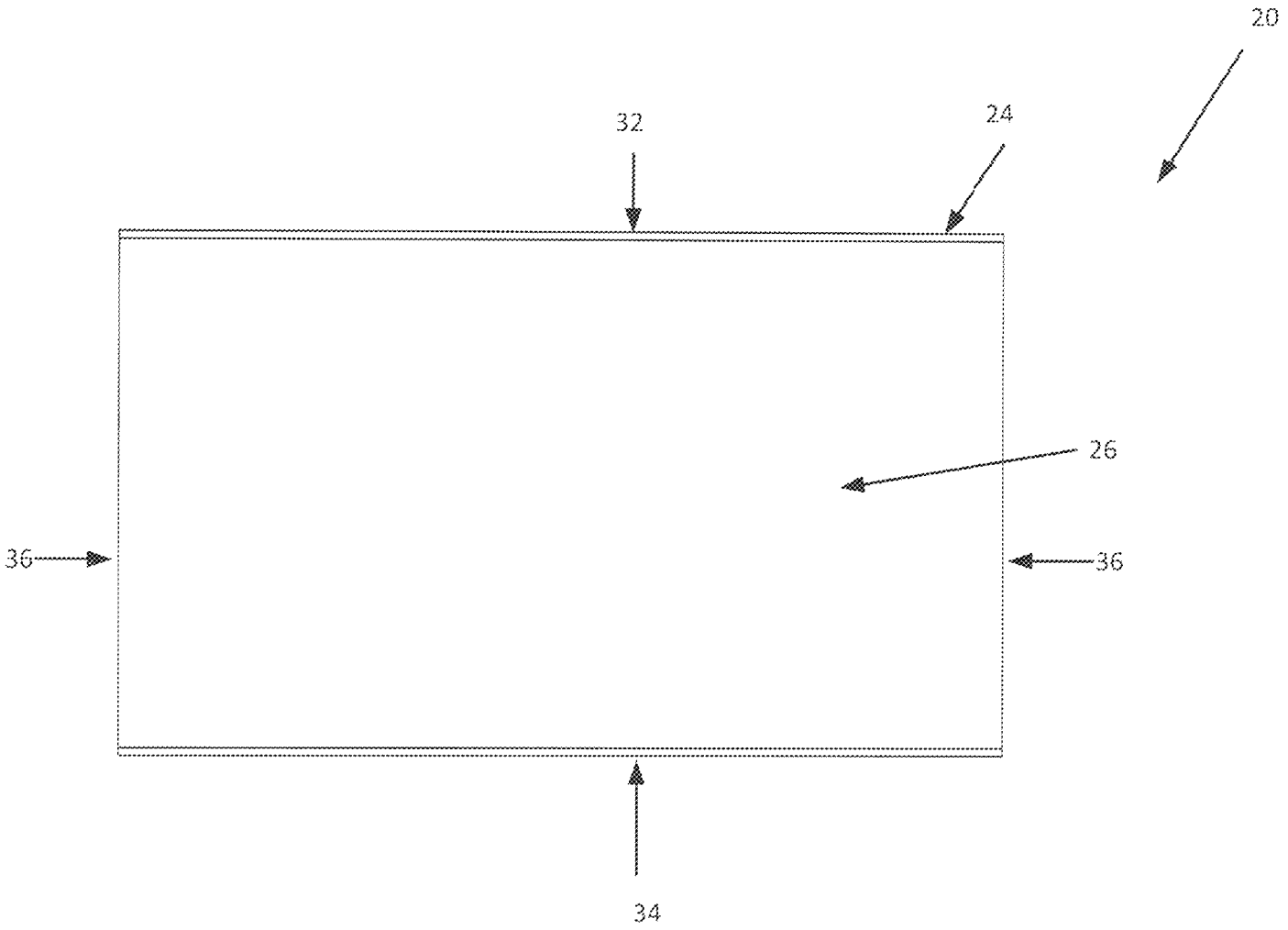
FIG. 64 shows a rear view of a mounting rail of an object hanging system, in accordance with one or more arrangements.
Figure 65:
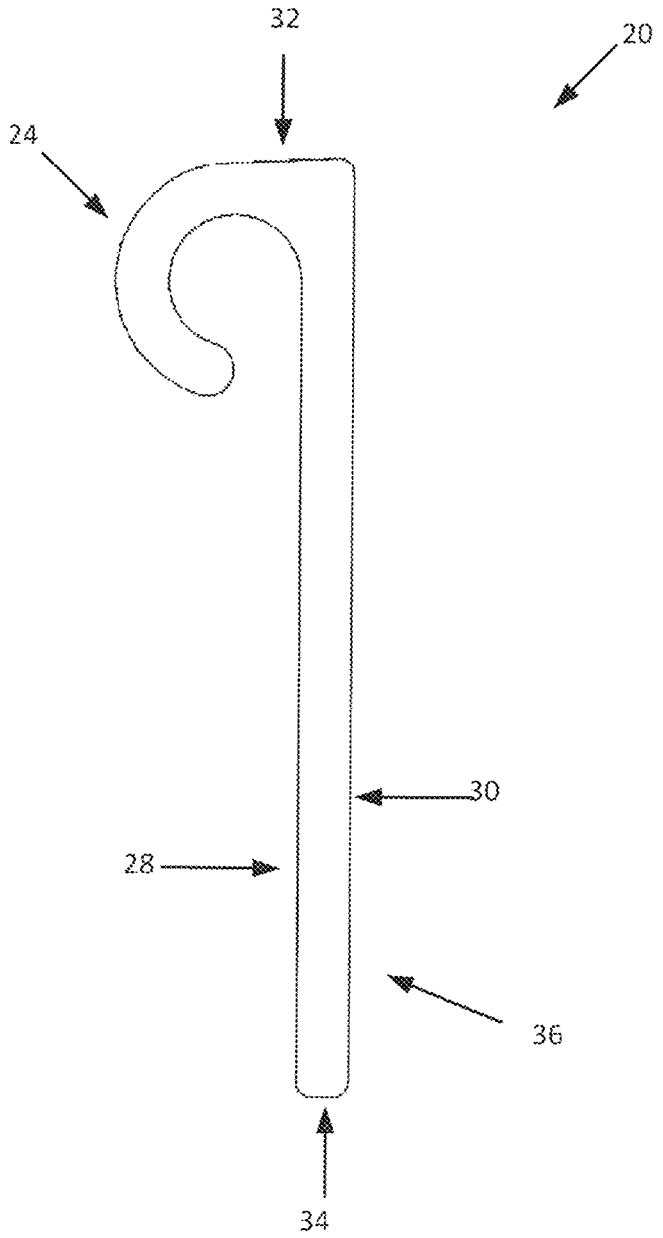
FIG. 65 shows a right side view of a mounting rail of an object hanging system, in accordance with one or more arrangements.
Figure 66:
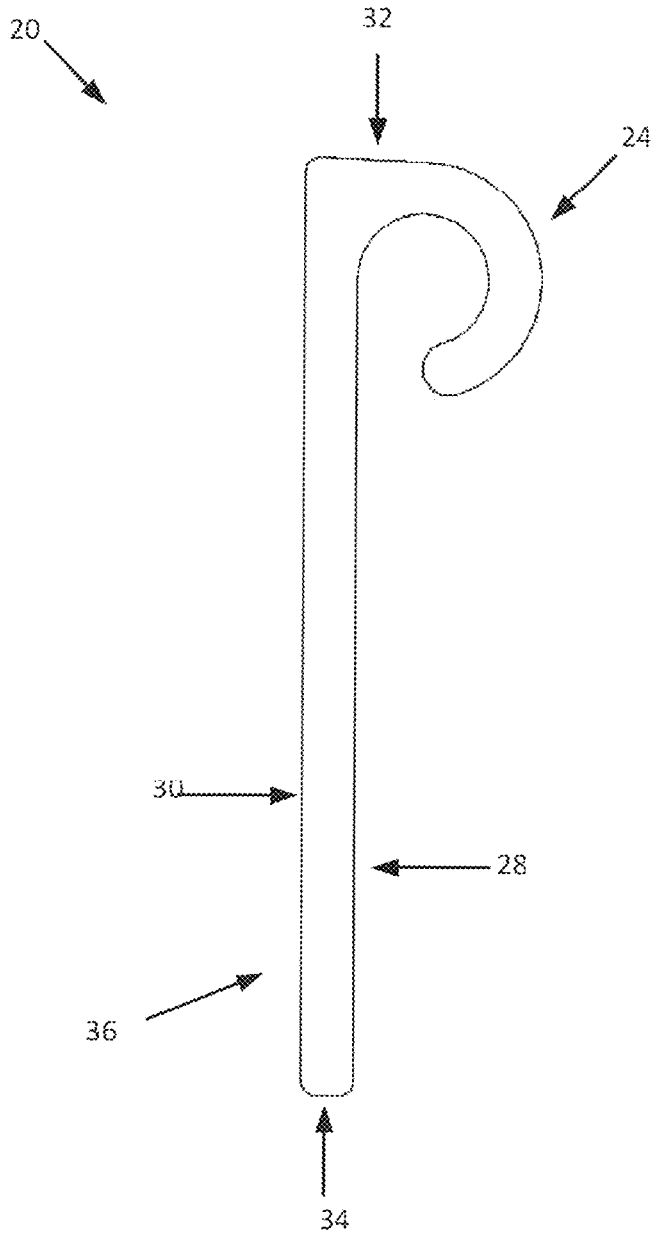
FIG. 66 shows a right side view of a mounting rail of an object hanging system, in accordance with one or more arrangements.
Figure 67:
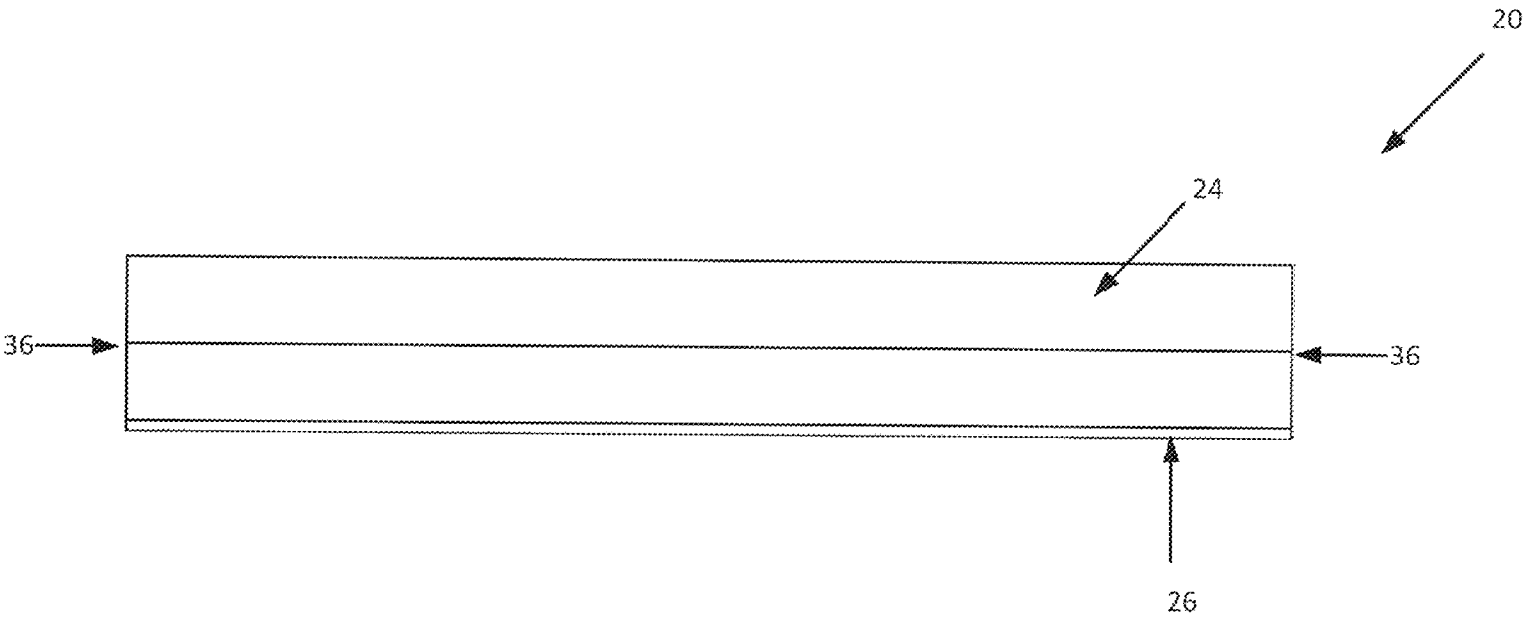
FIG. 67 shows a top view of a mounting rail of an object hanging system, in accordance with one or more arrangements.
Figure 68:
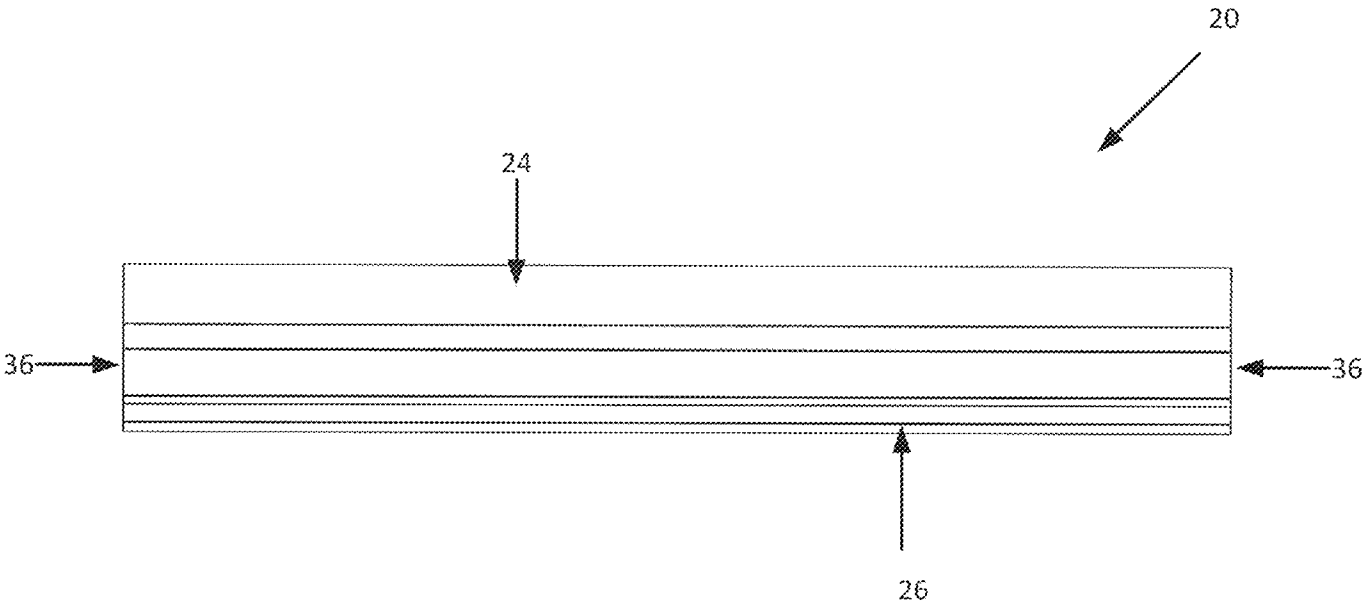
FIG. 68 shows a bottom view of a mounting rail of an object hanging system, in accordance with one or more arrangements.
Figure 69:
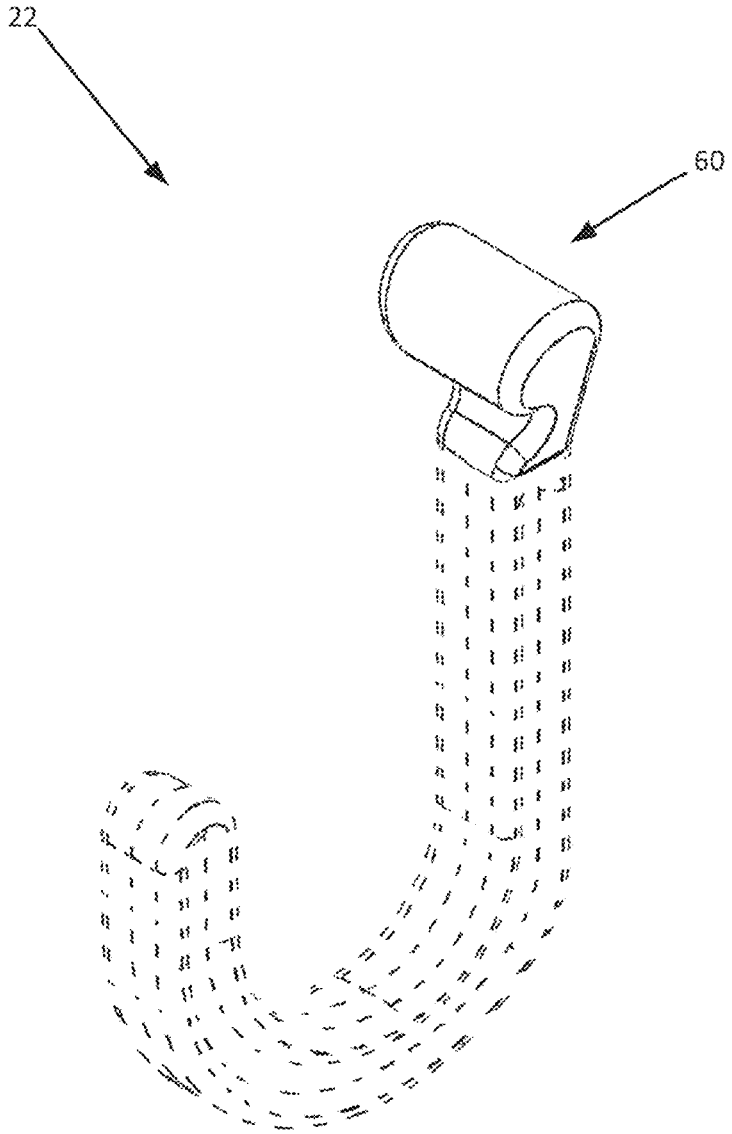
FIG. 69 shows an upper front left perspective view of a hook type hanging member for an object hanging system, in accordance with one or more arrangements.
Figure 70:
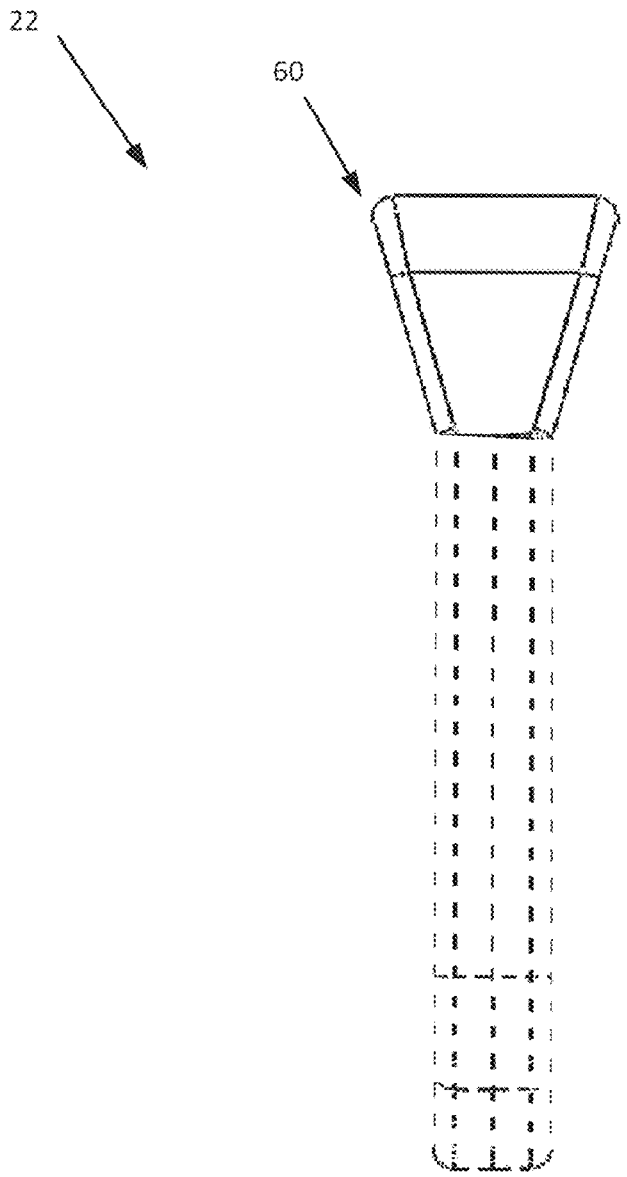
FIG. 70 shows a front view of a hook type hanging member for an object hanging system, in accordance with one or more arrangements.
Figure 71:
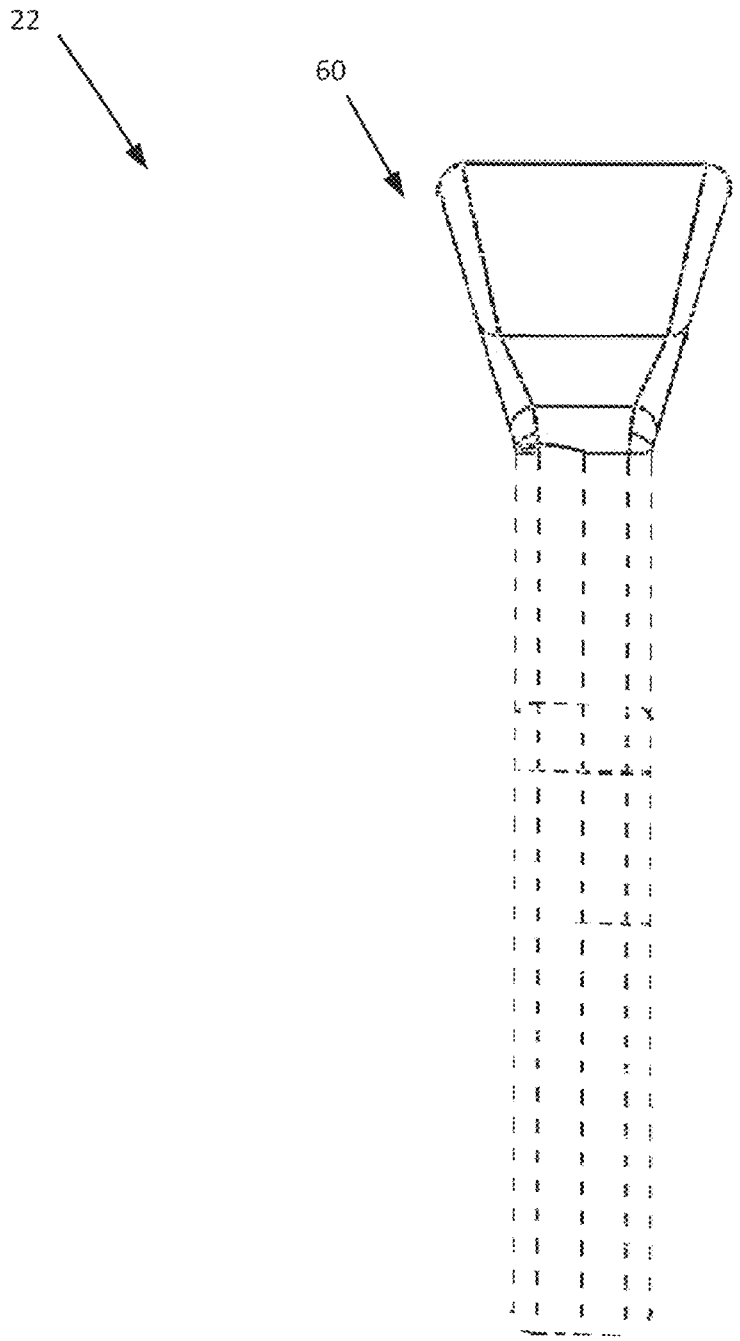
FIG. 71 shows a rear view of a hook type hanging member for an object hanging system, in accordance with one or more arrangements.
Figure 72:
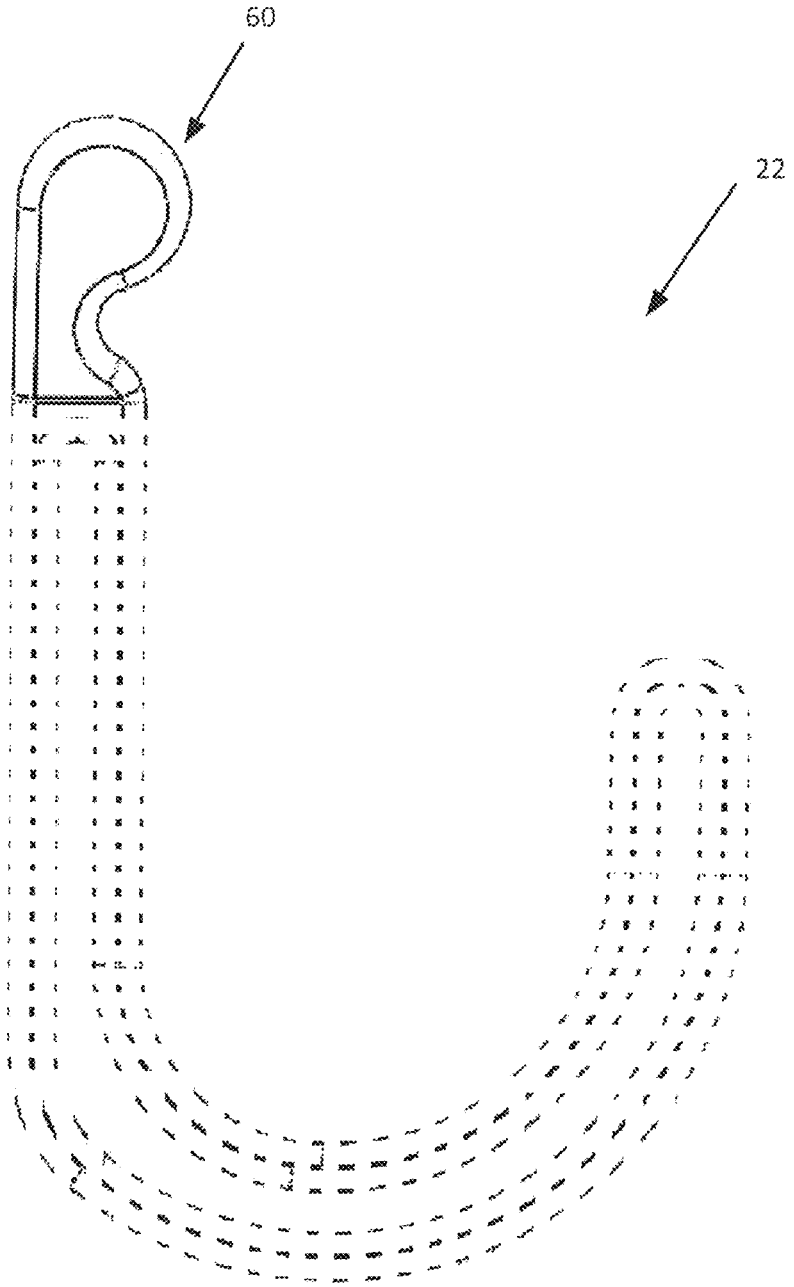
FIG. 72 shows a right side view of a hook type hanging member for an object hanging system, in accordance with one or more arrangements.
Figure 73:
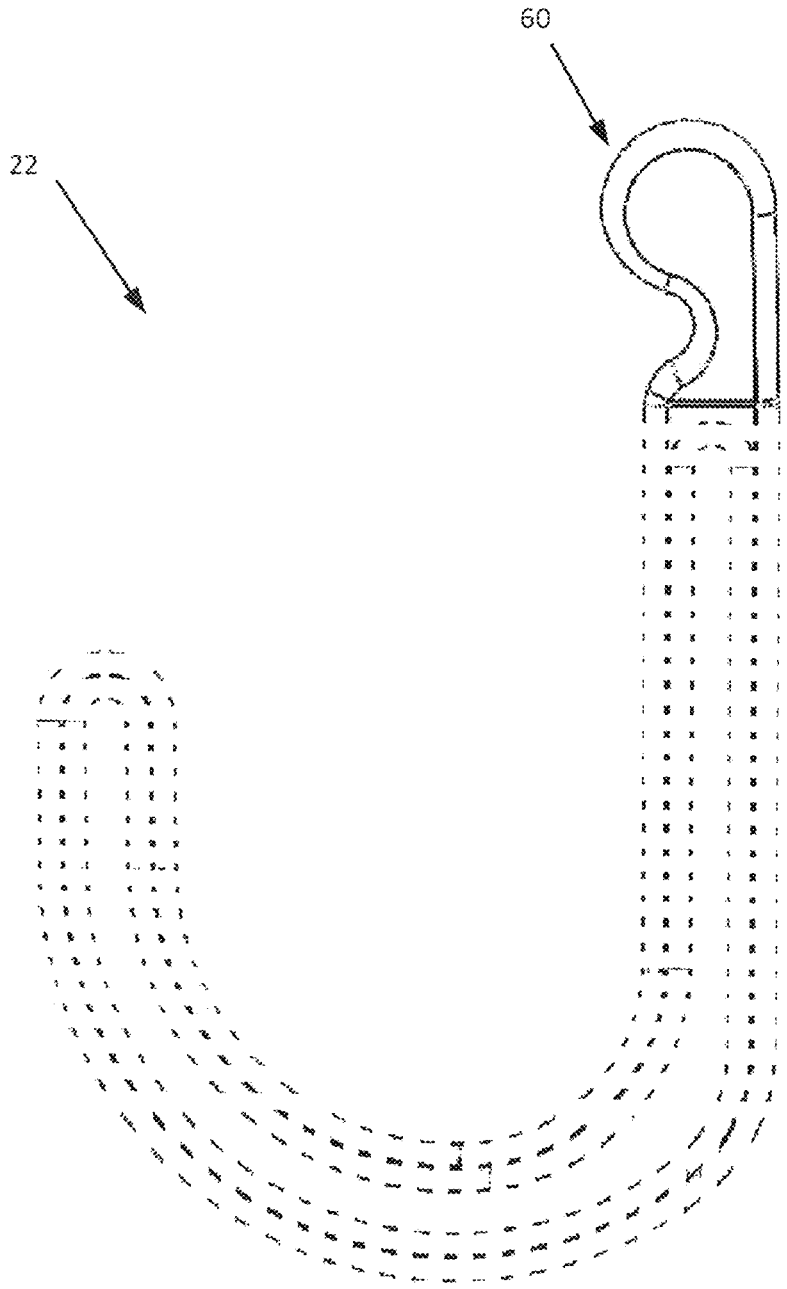
FIG. 73 shows a left side view of a hook type hanging member for an object hanging system, in accordance with one or more arrangements.
Figure 74:
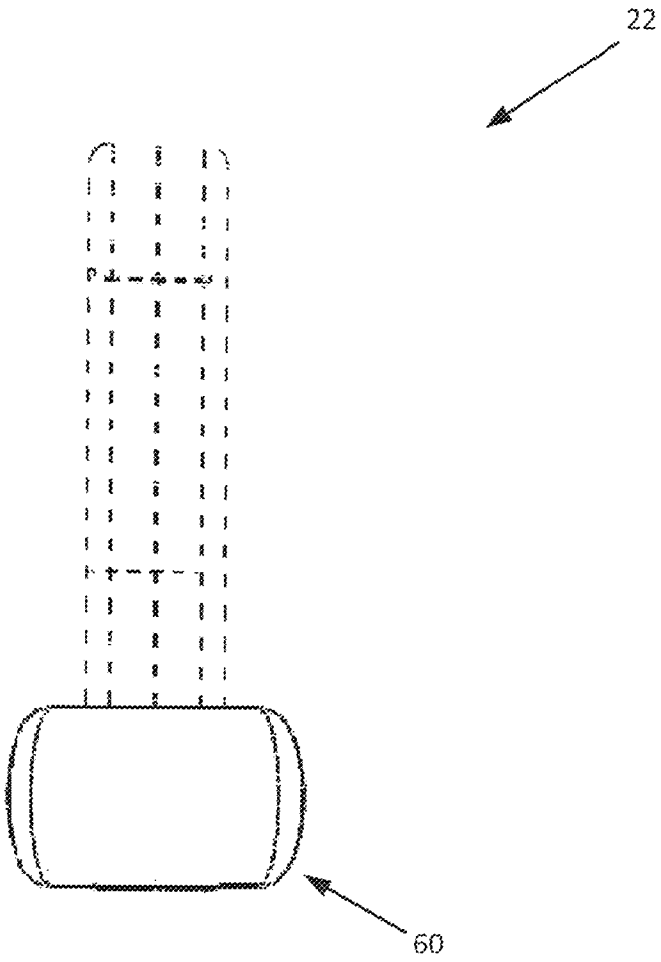
FIG. 74 shows a top view of a hook type hanging member for an object hanging system, in accordance with one or more arrangements.
Figure 75:
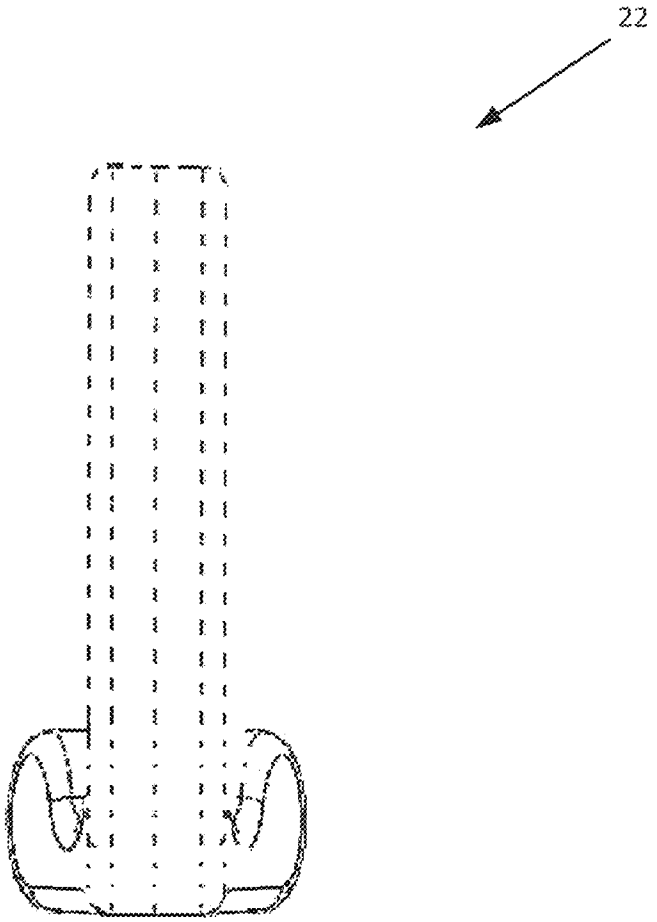
FIG. 75 shows a bottom view of a hook type hanging member for an object hanging system, in accordance with one or more arrangements.
Figure 76:
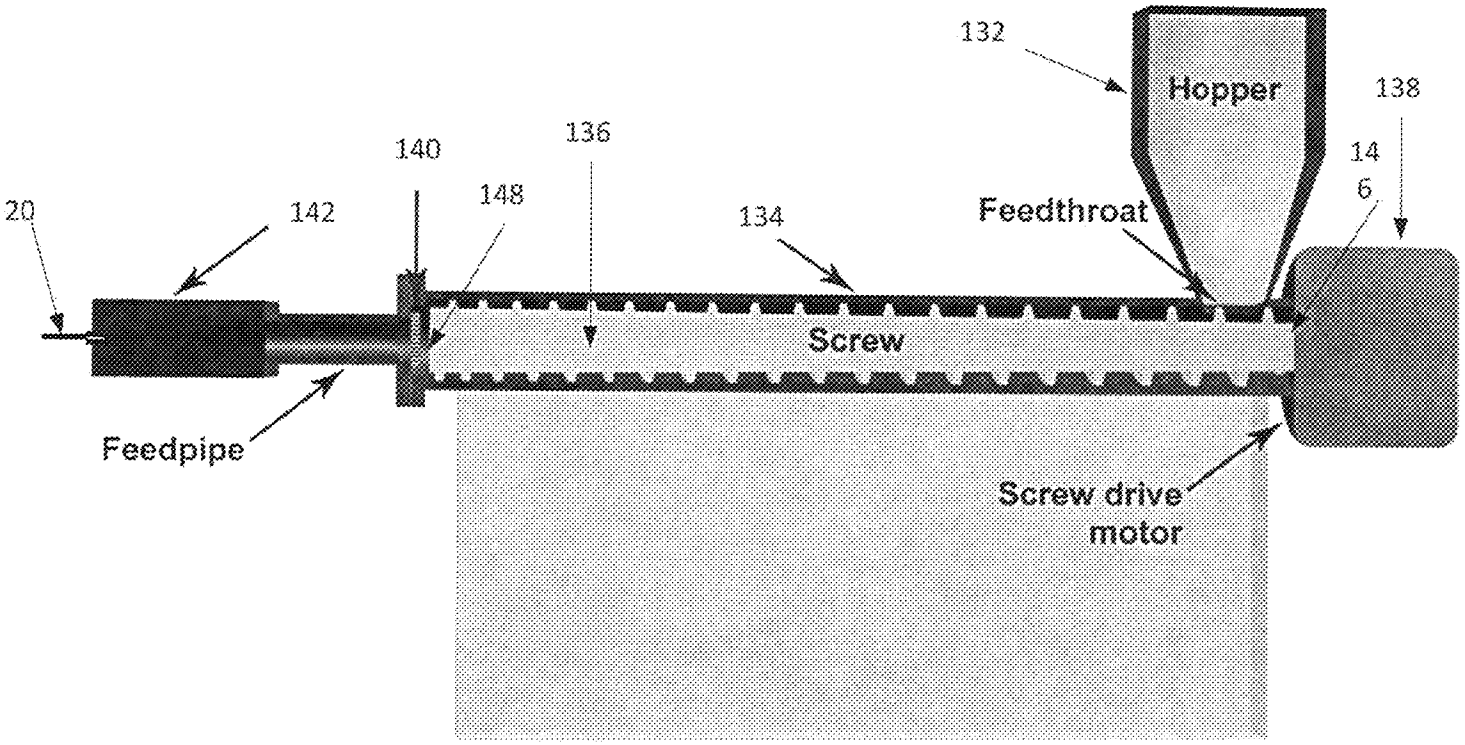
FIG. 76 shows a side view of an extrusion system 130 for formation of a mounting rail, in accordance with one or more arrangements.
Figure 77:
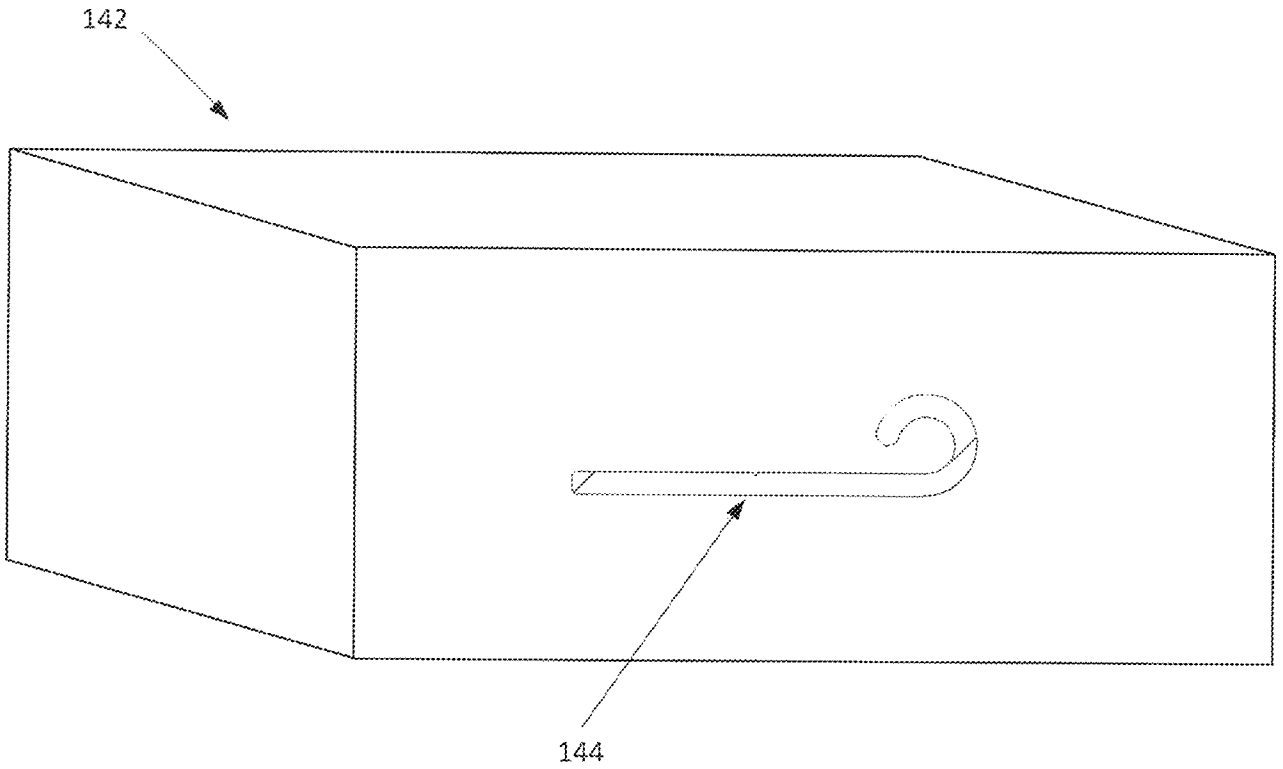
FIG. 77 shows an upper front right side perspective view of a die of an extrusion system, in accordance with one or more arrangements; the view showing a mounting rail being extruded from the die.
Figure 78:
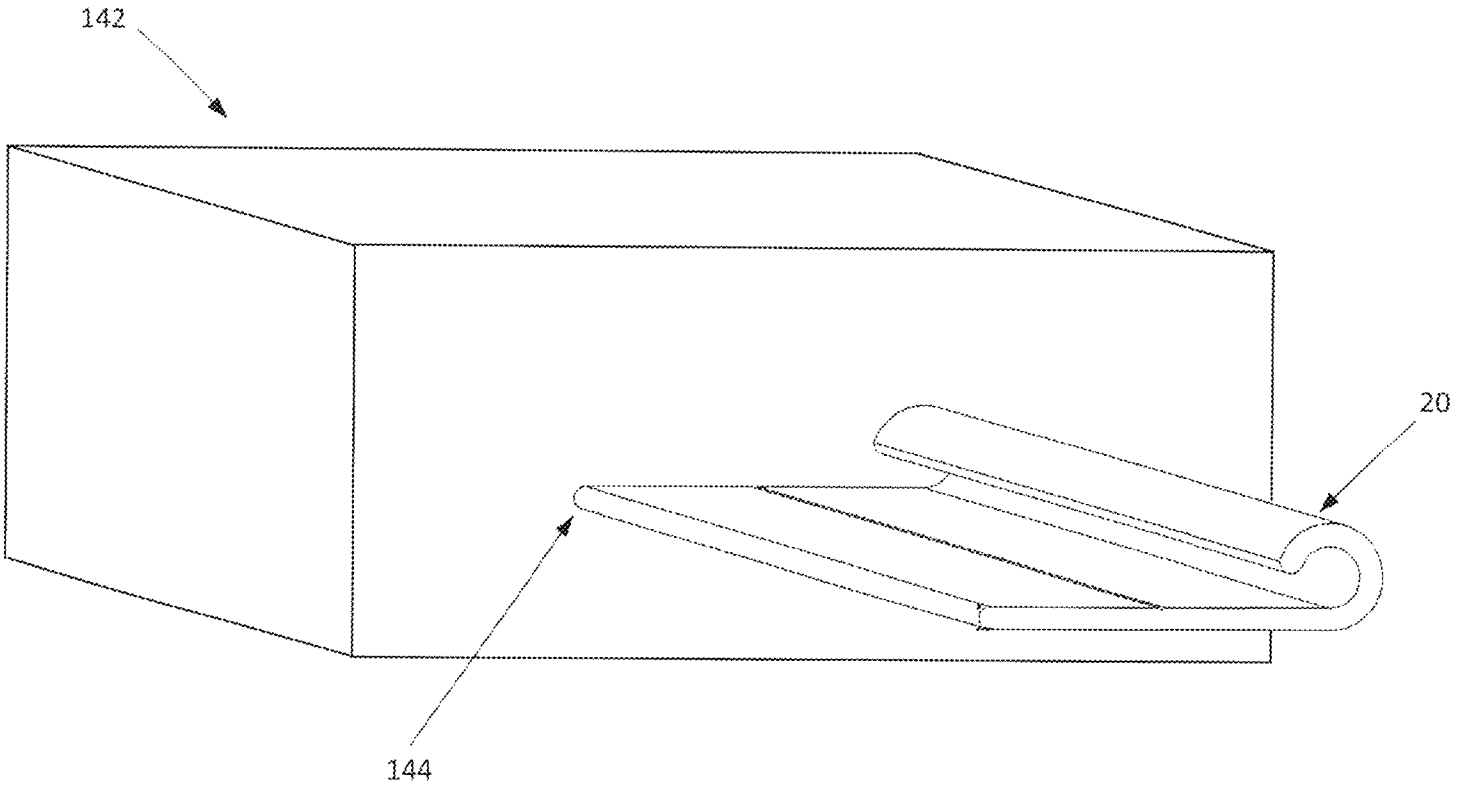
FIG. 78 shows an upper front right side perspective view of a die of an extrusion system, in accordance with one or more arrangements.
Figure 79:
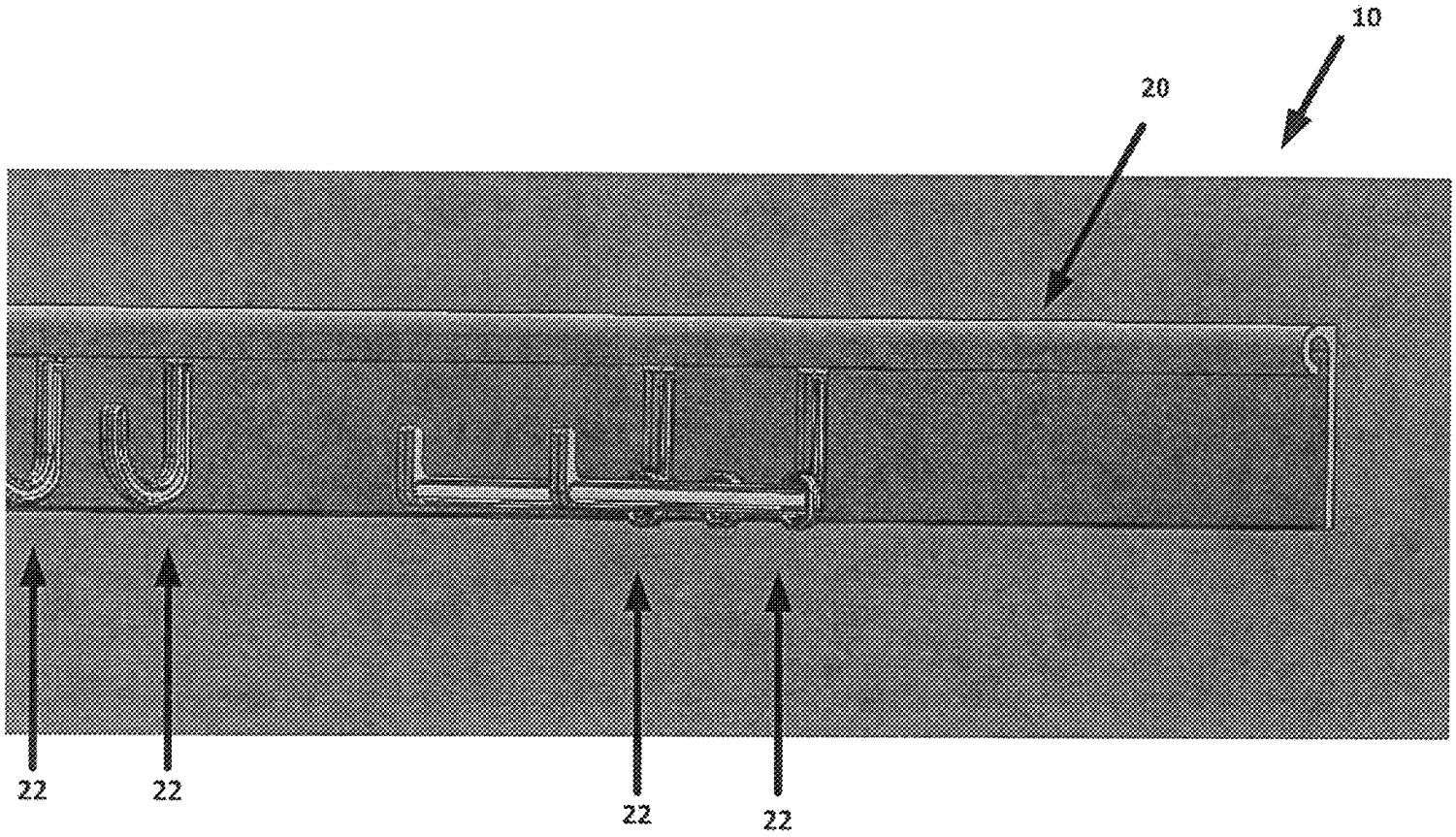
FIG. 79 shows a front left perspective view of an object hanging system, in accordance with one or more arrangements.
Figure 80:
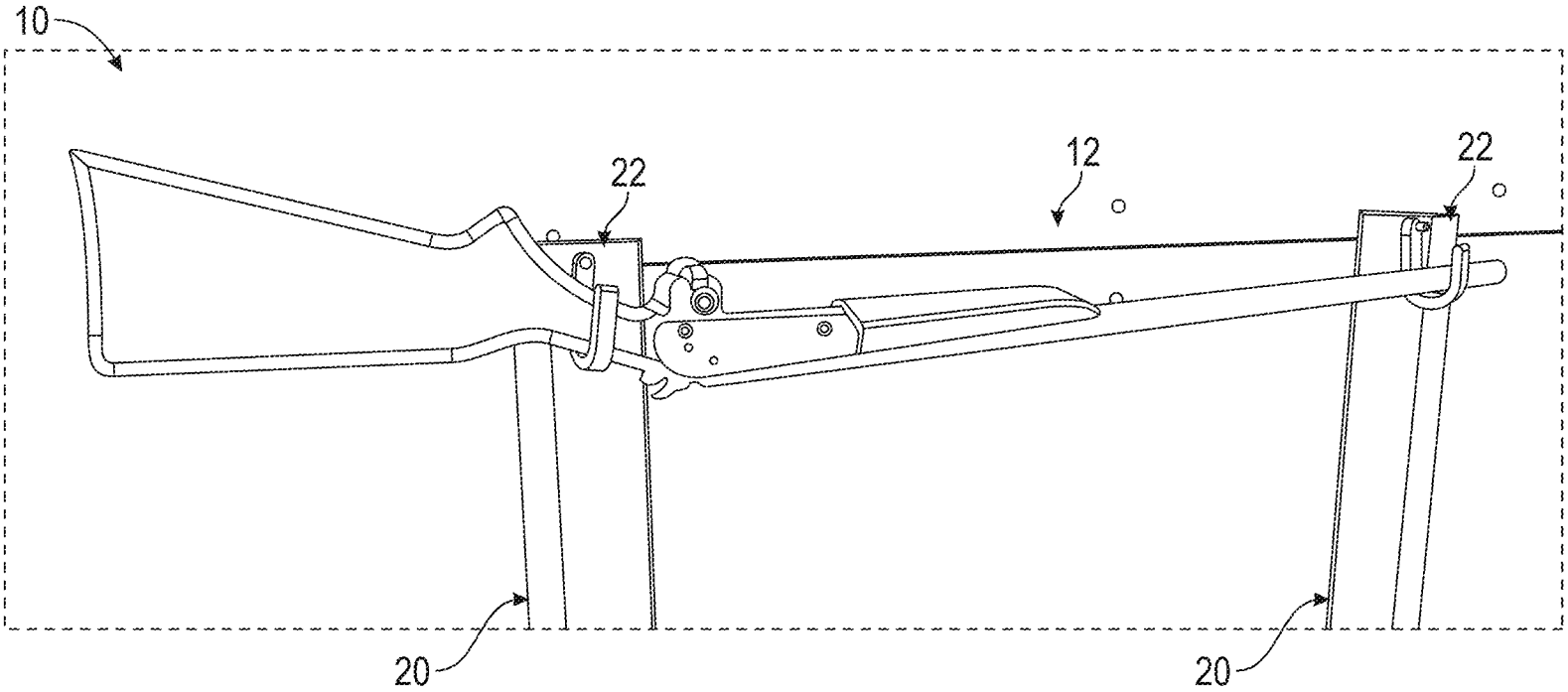
FIG. 80 shows an upper front right perspective view of an object hanging system, in accordance with one or more arrangements; the view showing the system with two vertically mounted mounting rails used for hanging of a rifle.
Figure 81:
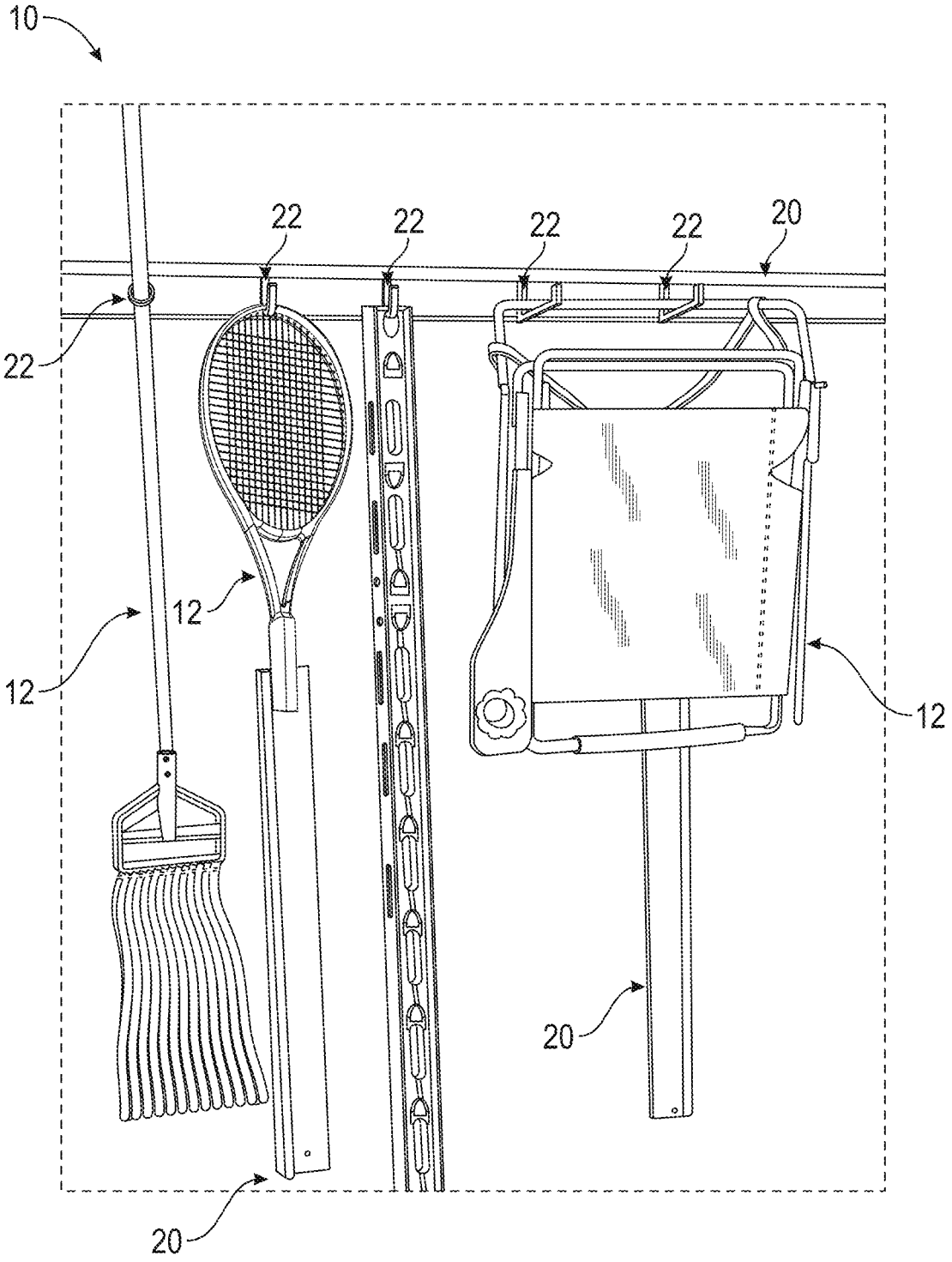
FIG. 81 shows a lower front perspective view of an object hanging system, in accordance with one or more arrangements; the view showing a mop, a racket, a level, and a folding chair being hung from a horizontally mounted mounting rail.

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in or described with reference to certain figures or embodiments, it will be appreciated that features from one figure or embodiment may be combined with features of another figure or embodiment even though the combination is not explicitly shown or explicitly described as a combination. In the depicted embodiments, like reference numbers refer to like elements throughout the various drawings.

It should be understood that any advantages and/or improvements discussed herein may not be provided by various disclosed embodiments, or implementations thereof. The contemplated embodiments are not so limited and should not be interpreted as being restricted to embodiments which provide such advantages or improvements. Similarly, it should be understood that various embodiments may not address all or any objects of the disclosure or objects of the invention that may be described herein. The contemplated embodiments are not so limited and should not be interpreted as being restricted to embodiments which address such objects of the disclosure or invention. Furthermore, although some disclosed embodiments may be described relative to specific materials, embodiments are not limited to the specific materials or apparatuses but only to their specific characteristics and capabilities and other materials and apparatuses can be substituted as is well understood by those skilled in the art in view of the present disclosure.

It is to be understood that the terms such as "left, right, top, bottom, front, back, side, height, length, width, upper, lower, interior, exterior, inner, outer, and the like as may be used herein, merely describe points of reference and do not limit the present invention to any particular orientation or configuration.

As used herein, "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof, unless expressly indicated otherwise. For example, if an embodiment of a system is described at comprising an article, it is understood the system is not limited to a single instance of the article unless expressly indicated otherwise, even if elsewhere another embodiment of the system is described as comprising a plurality of articles.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected or engaged, respectively, in any manner that facilitates operation, which may include being directly connected, indirectly connected, electronically connected, wirelessly connected or connected by any other manner, method or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments or methods.

Similarly, the structures and operations discussed herein may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually or sequentially, to provide looping or other series of operations aside from single operations described below. It should be presumed that any embodiment or method having features and functionality described below, in any workable combination, falls within the scope of example embodiments.

As used herein, various disclosed embodiments may be primarily described in the context of hanging of objects on walls. However, the embodiments are not so limited. It is appreciated that the embodiments may be adapted for use for supporting of various other objects in various other applications. The support system is merely shown and described as being used in the context of hanging objects on wall for ease of description and as one of countless examples.

Object Hanging System 10:

With reference to the figures, an system for hanging objects 10 (or object hanging system 10 or simply system 10) is presented. Object hanging system 10 is formed of any suitable size, shape, and design and is configured to facilitate the quick, easy and safe hanging of various objects 12. In the arrangement shown, as one example, object hanging system 10 includes a mounting rail 20 and various hanging members 22 configured to attach to the mounting rail 20 and facilitate hanging of objects 12 therefrom.

Hanging Object 12:

In the arrangement shown, as one example, object hanging system 10 is used in association with hanging of various objects 12 onto a mounting surface 14 (e.g. wall, ceiling, door, cabinet, etc.) including but not limited to, for example, tools, lawn and garden equipment, brooms, mops, exercise equipment, bicycles, skis, guns, fishing poles, other sporting goods, pictures, mirrors, decorative objects, and/or any other hanging object.

Mounting Rail 20:

Mounting rail 20 is formed of any suitable size, shape, and design and is configured to attach to a mounting surface 14 and provide a channel configured to receive and connect with hanging members 22. In the arrangement shown, as one example, mounting rail 20 has a wall attachment member 26 and a channel member 24 attached thereto.

Wall Attachment Member 26:

In the arrangement shown, as one example, mounting rail 20 includes a wall attachment member 26. Wall attachment member 26 is formed of any suitable size, shape, and design and is configured to facilitate attachment of system 10 to mounting surface 14. In the arrangement shown, as one example, wall attachment member 26 serves as the main body or main structural member of mounting rail 20. In this example arrangement wall attachment member 26 has an elongated generally rectangular planar shape having a front surface and 28 a rear surface 30 extending between an upper end 32, a lower end 34, and opposing sides 36.

In the arrangement shown, as one example, rear surface 30 of wall attachment member 26 is generally flat and straight and planar in shape which serves to engage a flat and straight and planar wall in flat and flush engagement so as to maximize surface area of engagement. In one or more arrangements, wall attachment member 26 includes a set of holes 38 (not shown) extending from the front surface 28 to rear surface 30 to facilitate attachment of wall attachment member 26 to mounting surface 14 using fasteners 40 (not shown).

Fastener 40 is formed of any suitable size shape and design and is configured to facilitate attachment of wall attachment member 26 to mounting surface 14. In some various arrangements, fasteners 40 may be configured to install mounting rail 20 onto mounting surface 14 using various methods and means including but not limited to, for example, screws, bolts, nails, tacks, anchors or any other fastening device. In one or more arrangements, mounting rail 20 is installed onto mounting surface 14 by placing the rear surface 30 of wall attachment member 26 onto mounting surface 14 at the desired position followed by the insertion of fasteners 40 through holes 38 and into mounting surface 14 thereby mechanically affixing mounting rail 20 to mounting surface 14.

In some arrangements, mounting rail 20 may be sold with pre-drilled holes 38 to facilitate easy attachment of mounting rail 20 to mounting surface 14 (e.g., using fasteners 40). However, the embodiments are not so limited. Rather, it is contemplated that in one or more arrangements, an installer may install mounting rail 20 without predrilled holes 38. For example, in one or more arrangements, an installer may form holes 38 in mounting rail 20 (e.g., by drilling and/or screwing) at desired locations at which mounting rail 20 is to be attached to mounting surface 14 (e.g., using fasteners 40). Additionally or alternatively, in one or more arrangement, mounting rail 20 includes one or more recessed grooves 42 in front surface 28 of wall attachment member 26 to facilitate positioning and starting of fasteners 40 (e.g., screws) in wall attachment member 26 of mounting rail 20. In the arrangement shown, as one example, wall attachment member 26 has one groove 42 positioned centrally between upper end 32 and lower end 34 of wall attachment member 26 and extending between opposing sides 36 of wall attachment member 26.

Channel Member 24:

Channel member 24 is formed of any suitable size, shape, and design and having a channel 46 configured to receive and hold hanging members 22 within the channel 46 to facilitate attachment of hanging member 22 to mounting rail 20. In the arrangement shown, as one example, channel member 24 includes a c-shaped channel 46 attached to the upper end 32 of wall attachment member 26 of mounting rail 20. In this example arrangement, the channel member 24 is formed by a curved flange 50 that extends forward from upper end 32, curves downward and back toward wall attachment member 26 before terminating in a free end to form a c-shaped channel 46 having a downward facing open end 48 that is more narrow than a hollow interior 54 of the c-shaped channel 46 of channel member 24. In this example arrangement, the c-shaped channel 46 has a circular arc shaped front portion formed by flange 50 and a planar rear portion 52 formed by the wall attachment member 26. However, the embodiments are not so limited. Rather, in various embodiments c-shaped channel 46 may have a triangle shape, a square shape, rectangular shape, or any other shape.

Hanging Member 22:

Hanging members 22 are formed of any suitable size, shape, and design and are configured to be received and held within channel member 24 and facilitate hanging of one or more objects therefrom. In an arrangement shown, as one example, hanging member 22 has a head portion 60, a neck portion 62, and a body 64, among other components.

Head Portion 60:

Head portion 60 of hanging member 22 is formed of any suitable size, shape, and design and is configured to fit and held within c-shaped channel 46 of channel member 24 to facilitate attachment of hanging member 22 with channel member 24 of mounting rail 20. In the arrangement shown, as one example, head portion 60 has an elongated shape extending between opposing ends 70. In this example arrangement, head portion 60 has a cross section that is substantially the same shape as a cross section of c-shaped channel 46 of channel member 24. More specifically, in this example arrangement, the cross section of head portion 60 is circular shaped with a planar back. However, the embodiments are not so limited. Rather, it is contemplated that in one or more arrangements head portion 60 may be any shape configured to prevent head portion 60 from being pulled through the open end 48 of channel member 24.

In the arrangement shown, head portion 60 is configured to be inserted into c-shaped channel 46 of channel member 24 from one of the opposing sides 36 of wall attachment member 26. However, the embodiments are not so limited. Rather, it is contemplated that in one or more arrangements head portion 60 may be configured to be inserted into c-shaped channel 46 of channel member 24 through open end 48. For example, in one or more arrangements, head portion 60 has a shape head portion 60 member to be inserted into channel member 24 at an angle through open end 48 and then rotated to an upright position, at which head portion 60 cannot pass through open end 48.

Neck Portion 62:

Neck portion 62 of hanging member 22 is formed of any suitable size, shape, and design and is configured to connect head portion 60 to body 64 through open end 48 while head portion 60 is held within a hollow interior 54 of c-shaped channel 46 of channel member 24. In an arrangement shown, as one example, neck portion 62 has an elongated generally rectangular shape extending from a lower end of head portion 60 to an upper end of body 64. However, it is contemplated that neck portion 62 may have any shape capable of extending through open end 48 to operably connect head portion 60 with body 64.

Interconnect 66:

In one or more arrangements, body 64 is connected to neck portion 62 of hanging member 22 by an interconnect 66. Interconnect 66 is formed of any suitable size, shape, and design and is configured to facilitate connection of body 64 to and disconnection from neck portion 62. In one or more arrangements, interconnect 66 permits body 64 for one type of hanging member 22 to be disconnected from head portion 60 and neck portion 62 and replaced with body for a different type of hanging member 22 without removing head portion 60 and neck portion 62 from channel member 24 of mounting rail 20.

In one or more arrangements, interconnect 66 is a hinged interconnect 66 configured to permit body 64 to be rotated relative to head portion 60 and neck portion 62. In some various arrangements, hinged interconnect 66 may be configured to facilitate rotation of body from side to side, forward and backward, and/or any other direction of rotation. Hinged interconnect 66 may be any suitable size, shape, and design and is configured to provide a hinged connection between body 64 and neck portion 62. Hinged connection may be useful, for example, to facilitate use of hanging member 22 when mounting rail 20 is mounted horizontally or when mounting rail 20 is mounted vertically.

In the arrangement shown, as one example, hinged interconnect 66 includes a first tab 76 connected to neck portion 62, a second tab 78 connected to body 64, and a bolt 82 extending through holes 80 in first tab 76 and second tab 78 to form a hinge. In this example arrangement, bolt 82 may be unscrewed and removed from holes 80 to allow body 64 to be disconnected from head portion 60 and neck portion 62. However, the embodiments are not so limited. Rather, it is contemplated that in one or more arrangements, interconnect 66 may include various types of connectors including but not limited to, screws, bolts, clips, clamps, snaps, and/or any other means or method for providing semi-permanent connection.

Body 64:

Body 64 of hanging member 22 is formed of any suitable size, shape, and design and is configured to be operably connected to neck portion 62 of hanging member 22 and facilitate holding or hanging of one or more various objects therefrom. In some various arrangements, body 64 may provide various structures for holding or hanging various objects 12, including but baskets, broom handle clamps, magnetic landing plates, hose hangers, and/or any other structure for holding and/or hanging of objects.

Lock Member 68:

In one or more arrangements, hanging member 22 includes a lock member 68 configured to lock hanging member 22 in place on mounting rail 20. Lock member 68 is formed of any suitable size, shape, and design and is configured to prevent movement of hanging member 22. In an arrangement shown, lock member 68 is a set screw threaded in a hole 80 extending from front 90 to back 92 of body 64. In this example arrangement, when tightened, the set screw extends rearward from body 64 and engages a portion of mounting rail 20 to prevent movement of hanging member 22. However, the arrangements are not limited to these examples. Rather, it is contemplated that in one or more arrangements lock member 68 may include but is not limited to, for example, screws bolts, clamps, latches, pins, stops, and/or any other means of method for providing mechanical or frictional connection between hanging member 22 and mounting rail 20.

Additionally or alternatively, in one or more arrangements, system 10 may include lock members 68 that are implemented separate from the hanging member(s) 22. For example, in one or more arrangements, system 10 includes lock member 68 configured to be positioned next to head portion 60 within c-shaped channel 46 and prevent movement of head portion 60 within c-shaped channel 46. For instance, in one or more arrangements, lock member 68 is configured to be positioned next to head portion 60 within c-shaped channel 46 and frictionally engage channel member 24 to prevent unintended movement of head portion 60 within c-shaped channel 46. In one or more arrangements lock member 68 may be shaped (e.g., with an angled side surface) to cause lock member to move against channel member 24 and bind in place within c-shaped channel 46 when head portion 60 of a hanging member 22 is pressed against lock member 68.

Hook Type Hanging Member 22:

In one or more arrangements, body 64 is configured for use as a hook type hanging member 22. In an arrangement shown, as one example, body 64 has a rear portion 86 and a front portion 88. In this example arrangement, rear portion 86 has an elongated rectangular shape having a front 90, back 92, and opposing sides 94 and extending from an upper end 96, where body 64 is connected to neck portion 62 and/or interconnect 66 to a lower end 98. In use, when head portion 60 of hanging member 22 is held within channel member 24, back 92 of hanging member 22 rests against front surface 28 of wall attachment member 26 of mounting rail 20, which helps to stabilize hanging member 22 to prevent downward or side to side movement of hanging member 22.

In one or more arrangements, front portion 88 is a hook-shaped member connected to lower end 98 of rear portion 86. In an arrangement shown, as one example, front portion 88 is a generally curved member that extends forward from lower end 98 in a U shape or J shape. In another example, front portion 88 is a square or rectangular shaped hook member having that extends a distance horizontally outward from lower end 98 of rear portion 86 and then turns upward (e.g., at a 90 degree angle) before terminating at an outward end. However, the embodiments are not so limited. Rather, it is hereby contemplated that, in one or more arrangements, body 64 of hanging member 22 may be formed in any other hook shape.

Loop Strap Hanging Member 22:

In one or more arrangements, body 64 is configured for use as a loop strap type hanging member 22. In an arrangement shown, as one example, body 64 includes a flexible loop strap 106 and a ring fitting 108. Loop strap 106 is formed of any suitable size, shape, and design and is configured to facilitate attachment to an object 12 for hanging from mounting rail 20. In the arrangement shown, as one example, loop strap 106 has a generally elongated rectangular shape extending between opposing ends 110. In this example arrangement, ends 110 are attached to neck portion 62 of hanging member 22 or alternatively to interconnect 66 (if included) in hanging member 22 to form a loop. In some various arrangements, loop strap 106 may be formed of various materials including but not limited to, rubbers, flexible polymers, natural fibers, synthetic fibers, and/or any other suitable strap material. In the arrangement shown, as one example, both ends 110 of loop strap 106 pass through ring fitting. In this arrangement, with an object 12 inserted through loop strap 106, loop strap 106 may be tightened around an object 12 by moving ring fitting 108 toward object 12.

Endcap 114:

In one or more arrangements, system 10 includes endcaps 114 that may be inserted into ends of channel member 24 at opposing sides 36 of mounting rail 20. Endcap 114 may be any suitable size, shape, and design and is configured to be inserted into an open end of channel member 24 to cover the opening and provide an aesthetically pleasing appearance. In the arrangement shown, as one example, endcap 114 has an elongated shaft 116 between an inner end 118 and an outer end 120. In this example arrangement, shaft 116 has a cross section that is substantially the same shape as a cross section of hollow interior 54 of c-shaped channel 46 of channel member 24. More specifically, in this example arrangement, the cross section of shaft 116 is circular shaped with a planar back. However, the embodiments are not so limited. Rather, shaft 116 may be any shape configured to be inserted in the end of channel member 24 and hold shaft 116 therein by frictional and/or mechanical engagement. In this example arrangement, endcap 114 has a flange 122 that extends outward from outer end 120 to form a decorative cover having an aesthetically pleasing appearance.

In Operation:

Object hanging system 10 may be used to hang objects 12 in a variety of residential, business, industrial and/or mobile applications including but not limited to storage, organization, and/or display of objects 12 in any of a variety of locations. Some example locations for use of object hanging system 10 include garages, attics, basements, workshops, closets, pantries, kitchens, porches, hallways, stairwells, retail counters, and/or any other location. Object hanging system may also be used for various mobile applications in vehicles such as boats, trucks, cargo vans, campers and recreational vehicles, planes, and any other vehicle. As an example mobile application, object hanging system 10 may be used in a work vehicle to organize tools, parts, and other work materials used by a tradesperson. As another example mobile application, object hanging system 10 may be used in a vehicle to organize and provide easy access to outdoor and sporting equipment, for example, for hunting, fishing, skiing, hiking, camping, and/or any other outdoor activity.

In the arrangement shown, as one example, object hanging system 10 is used in the following manner. First, the location of the object hanging system 10 is determined on mounting surface 14. In various applications, the mounting surface 14 may be a generally vertical surface (e.g., a wall, door, or cabinet), a generally horizontal surface (e.g., ceiling, under cabinet mounting, or workbench), or any other surface.

After location is selected, the mounting rail 20 of object hanging system 10 is attached to mounting surface 14 at the selected location. Depending on the objects 12 to be hung, mounting rail 20 may be attached to the mounting surface 14 in a horizontal orientation, in a vertical orientation, and/or in any other orientation (e.g., diagonal). When mounted on a vertical mounting surface 14 in a horizontal orientation, mounting rail 20 permits hanging members 22 to be repositioned horizontally to an infinite number of positions along channel member 24. Conversely, when mounted on a vertical mounting surface 14 in a vertical orientation, mounting rail 20 permits hanging members 22 to be repositioned vertically to an infinite number of positions along channel member 24.

In some applications, prior to attaching mounting rail 20 to mounting surface 14, in some applications, mounting rail 20 may be cut from a manufactured length to a desired length. Alternatively, in one or more arrangements, mounting rail 20 may be custom manufactured to a desired length via an extrusion manufacturing process.

Mounting rail 20 may be attached to a mounting surface 14 using various attachment means. In one or more arrangements, mounting rail 20 is attached to mounting surface 14 using fasteners 40, e.g., a screw, bolt, nail, tack, anchor or any other fastening device, for example, by driving, screwing, hammering, or otherwise extending fastener 40 through holes 38 in wall attachment member 26 of mounting rail 20 and into mounting surface 14.

Additionally or alternatively, in one or more arrangements, wall attachment member 26 of mounting rail 20 may be attached to mounting surface 14 using an adhesive (not shown). For example, an adhesive may be applied to rear surface 30 of wall attachment member 26 of mounting rail 20. Adhesive may cover all or a portion of rear surface 30 of wall attachment member 26. Adhesive may be formed of any form of an adhesive device, system or component such as a layer of glue, a layer of two-sided tape, a layer of two-sided adhesive foam, a layer of adhesive gel, pressure sensitive adhesives (e.g., Tesa® Powerstrips® from tesa AG, 3M Command® Adhesive Strips from 3M, and/or Plastofix® Formule Force 1300 Adhesive Strips from Plasto S.A.) or any other form of an adhesive device, system or component.

In one or more arrangements, adhesive is formed of or includes a compressible material, such as a compressible layer of foam or gel or the like, that accommodates variations in the surface of mounting surface 14 thereby facilitating a stronger hold on mounting surface 14. In one or more arrangements, adhesive is not necessarily configured to adhere to mounting surface 14. For instance in an example arrangement, adhesive is formed of a somewhat compressible material that has a high coefficient of friction that helps to prevent object hanging system 10 from sliding down mounting surface 14. In this example arrangement, object hanging system 10 is attached to mounting surface 14 by way of fasteners 40 though wall attachment member 26 into mounting surface 14 and the high coefficient of friction material that forms adhesive helps to prevent sliding of object hanging system 10 along mounting surface 14.

With mounting rail 20 attached to mounting surface 14, one or more hanging members 22 are attached to channel member 24 of mounting rail 20. In the arrangement shown, as one example, hanging members 22 of a desired hanging structure are attached to channel member 24 by inserting head portion 60 of hanging member 22 into hollow interior 54 of c-shaped channel 46 of channel member 24 through an open end along the side 36 of mounting rail 20, with neck portion 62 extending downward facing open end of channel member 24. In some applications, once all desired hanging members 22 are placed within c-shaped channel 46 of channel member 24, endcaps 114 may be inserted into ends of channel member to provide an aesthetically pleasing finished appearance.

With head portion 60 of hanging members 22 in c-shaped channel 46 of channel member 24, hanging members 22 may be moved to desired positions along mounting rail 20 for hanging of objects 12 therefrom. If desired and available on a hanging member 22, a user may use a lock member 68 to inhibit unintentional movement of hanging member 22 in c-shaped channel 46 of channel member 24.

For any hanging member 22 having a hinged interconnect 66, the body 64 of hanging members may be rotated relative to mounting rail 20 to reposition body 64 to the intended use. For example, a hook type hanging member 22 having a hinged interconnected 66 may be rotated to allow the hook to be used to hang objects 12 from a mounting rail 20 mounted vertically, horizontally or at any angle therebetween.

With hanging members 22 in the desired positions, objects 12 may then hanged from or otherwise attached to body 64 of hanging members 22 by a user. If desired by a user, hanging members 22 may be repositioned along mounting rail 20 to facilitate rearrangement of objects 12 and/or facilitate hanging of new of different objects 12. If desired by a user, body 64 of a hanging member 22 having an interconnect 66 may be removed and replaced with another body 64, for example, for a different type of hanger.

Materials and Manufacture:

Mounting rail 20 and hanging members 22 of object hanging system 10 may be formed of any suitable material that is strong enough to meet the needs of object hanging system 10 including but not limited to polymer plastics (e.g., acrylic, ABS, Nylon, PLA, Polybenzimidazole, polycarbonate, polyether sulfone, polyoxymethylene, polyetherimide, polyethylene, polyethylene oxide, polyethylene sulfide, polypropylene, polystyrene, polyamide, polypropylene, alkyd, silicon resins, polyvinyl chloride, polyvinylidene fluoride, Teflon, acrylic, epoxy, polyurethane, polyamide, polycarbonate, polypropylene, alkyd, and/or silicon resins), metallic materials (e.g., aluminum, steel, iron, brass, copper, lead, tin, magnesium, zinc, pewter, titanium, or any other metallic material or alloy or the like), and/or composite materials.

In one or arrangements, mounting rail 20 and hanging members 22 are formed of a polymer plastic having a durometer configured to facilitate snug and secure attachment of hanging members 22 within channel member 24 of mounting rail 20 while permitting a user to purposely reposition hanging members 22 within channel member 24. Through careful observation, it has been surprisingly discovered that a material having a durometer in the range of 50-60 (preferably approximately 55) provides for ideal engagement between hanging members 22 and channel member 24 of mounting rail 20 to hold hanging members 22 securely in place while in use but permitting a user to reposition handing members within channel member 24 when desired.

In one or more arrangements, mounting rail 20 has a cross section shape that permits mounting rail 20 to be formed as a unitary continuous member via an extrusion process. Extrusion based manufacture permits mounting rail 20 to be manufactured at less cost and more quickly than other methods, such as injection molding, which are required for manufacture of component parts for some current object hanging systems. Furthermore, extrusion permits mounting rails 20 of any length to be manufactured.

It has been discovered that a mounting rail 20 having non-uniform thickness may cause mounting rail 20 to form a bend as it cools due to differential tempering. In one or more arrangements, mounting rail 20 has a cross section shape with a generally uniform thickness extending through wall attachment member 26 and channel member 24 to facilitate uniform tempering of mounting rail 20 as materials cool following extrusion. In one or more arrangements, an extrusion system 130 is provided for manufacture of a mounting rail 20 for objected hanging system 10. Extrusion system 130 is formed of any suitable size, shape, and design and is configured to form input materials 128 into a shape of mounting rail 20. In the arrangement shown, as one example, extrusion system 130 includes a hopper 132, a barrel 134, an auger screw 136, a motor 138, a breaker plate 140, and a die 142.

Hopper 132:

Hopper 132 is formed of any suitable size, shape, and design and is configured to receive and hold input materials 128 for processing by extrusion system 130. In the arrangement shown, as one example, hopper 132 is a container having a conical shaped bottom configured to feed input materials 128 from hopper 132 into an input port of barrel 134.

Barrel 134 and Auger Screw 136:

Barrel 134 and auger screw 136 are formed of any suitable size, shape, and design and are configured to receive input materials 128 from hopper 132 and compress materials 128 while transporting the materials 128 through barrel 134 as auger screw 136 is rotated. In the arrangement shown, as one example, barrel 134 has a generally cylindrical shape extending from an input end 146 to and output end 148. In this example arrangement, auger screw 136 is a shaft with a helical blade configured to fit within barrel 134 and move input materials 128 toward the output end 148 of barrel 134 when rotated by motor 138

In one or more arrangements, barrel 134 is heated by a heating element (not shown) to facilitate melting of the input materials 128 as they are moved through the barrel 134. Additionally or alternatively, in one or more arrangements, barrel 134 may be cooled by a cooling element (not shown) to prevent input materials 128 from being over heated due to intense pressure and friction forces inside of barrel 134.

Motor 138:

Motor 138 is formed of any suitable size, shape, and design and is configured to generate mechanical movement to facilitate rotation of auger screw 136. In the arrangement shown, as one example, motor 138 is an electric motor (e.g., a DC motor or an AC motor) configured to convert electric power into rotational motion. However, the embodiments are not so limited. For example, in some arrangements, motor 138 may be an internal combustion engine, a fluid driven engine (e.g., steam, water, and/or air driven), or any other type of motor or engine.

Breaker Plate 140:

At the front of the barrel 134, the molten input material 128 is pushed by auger screw 136 through breaker plate 140. Breaker plate 140 is formed of any suitable size, shape, and design and is configured to remove any contaminants and regulate pressure and flow of the molten input material 128. In an example arrangement, breaker plate 140 is a thick metal puck having a number of holes through which the molten input material 128 is flowed. After passing through the breaker plate molten input material 128 enters die 142.

Die 142:

Die 142 is formed of any suitable size, shape, and design and is configured to form molten input materials into the shape of mounting rail 20 as it is pushed through die 142 by auger screw 136. In the arrangement shown, as one example, die has output opening 144 having the shape of the cross section of mounting rail 20. As molten input material 128 is pushed through die 142 and out through opening 144, the input material is shaped to form mounting rail 20.

Not Limited to Extrusion Manufacturing:

While arrangements are primarily described with reference to mounting rail 20 being manufactured via an extrusion process, the embodiments are not so limited. For instance, as one example alternative to extrusion, in one or more arrangements mounting rail 20 may be manufactured by bending or forging a length of metal stock into the shape of the mounting rail 20. As another example alternative, mounting rail 20 may be formed by an additive process. However, it is contemplated that mounting rail may be manufactured using any other manufacturing process.

Objectives Met:

From the above discussion it will be appreciated that the improved object hanging system 10 and related methods of use, presented herein improves upon the state of the art. Specifically, the improved object hanging system and related methods of use presented: that may be manufacture with less manufacturing costs; that can be cheaply manufactured using an extrusion based manufacturing process; that can be cheaply manufactured from polymer materials; that allows secure mounting of objects to a supporting surface; that reduces installation time; that can hold heavy objects; that may be used with various types of hangers; that can be used on vertical and horizontal mounting surfaces; that is easy to use; that is intuitive to use; that can be used with practically any hanging object; that has a long useful life; that is strong; that allows repositioning of objects; that allows repositioning of objects to an infinite number of positions; that allows objects to be repositioned vertically or horizontally; and/or that has an aesthetically pleasing appearance, among countless other advantages and improvements.

Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the invention. It is intended that this invention be limited only by the following claims, and the full scope of equivalents thereof.

What is claimed:

1. An object hanging system, comprising:

a mounting rail;

the mounting rail having a wall attachment member and a channel member;

the wall attachment member having a front surface and a rear surface extending between an upper end, a lower end, and opposing ends;

the wall attachment member extending a length in a continuous manner between the opposing ends;

the channel member positioned adjacent the upper end of the wall attachment member;

the channel member having opposing sides;

the channel member extending a length in a continuous manner between the opposing sides;

the channel member having a channel;

the channel having a downward facing open end;

wherein the front surface and the rear surface of the wall attachment member extend in a parallel and linear manner continuously from the channel member to the lower end at which point the wall attachment member terminates at the lower end;

at least one hanging member;

the at least one hanging member having a head portion;

wherein the head portion of the at least one hanging member is configured to be inserted into and held within the channel of the channel member;

wherein the head portion of the at least one hanging member is wider than the downward facing open end of the channel;

the at least one hanging member having a body;

the body of the at least one hanging member having a rear portion;

wherein the rear portion of the body of the at least one hanging member extends in a linear fashion;

the at least one hanging member having a neck portion;

wherein the neck portion of the at least one hanging member is connected to and positioned between the head portion and the body;

wherein the neck portion is configured to extend through an open end of the channel when the head portion is held within the channel;

wherein the neck portion is narrower than the head portion and the downward facing opening of the channel;

wherein when the at least one hanging member is installed in the wall attachment member the linear rear portion of the body of the at least one hanging member is configured to contact and extend in a parallel manner to the linear front surface of the wall attachment member;

wherein the narrower neck portion and the wider head portion of the at least one hanging member are configured to be inserted into or removed from the channel through an opening located on one of the opposing sides of the channel member;

wherein the narrower neck portion and the wider head portion of the at least one hanging member prevent insertion into or removal from the channel through the downward facing opening of the channel of the channel member.

2. The system of claim 1, wherein the mounting rail is a single unitary piece of material.

3. The system of claim 1, wherein the channel member and the wall attachment member are a single unitary piece of material.

4. The system of claim 1, wherein the channel member and the wall attachment member are a single unitary piece of material;

wherein the unitary piece of material forming the channel member and the wall attachment member has a substantially uniform thickness.

5. The system of claim 1, wherein the channel member curves upward and forward from the upper end of the wall attachment member and then curves forward and downward and then downward and then curves rearward to form the channel.

6. The system of claim 1, wherein the body of the at least one hanging member includes a hook.

7. The system of claim 1, wherein the body of the at least one hanging member includes a hook;

wherein the hook is a U-shaped hook.

8. The system of claim 1, wherein the body of the at least one hanging member includes a hook;

wherein the hook is a J-shaped hook.

* * * * *